US012643139B2

(12) United States Patent
Sugawara et al.

(10) Patent No.: US 12,643,139 B2
(45) Date of Patent: Jun. 2, 2026

(54) MANUFACTURING METHOD OF PRESS-FORMED ARTICLE AND PRESS LINE

(71) Applicant: NIPPON STEEL CORPORATION, Tokyo (JP)

(72) Inventors: Minoru Sugawara, Tokyo (JP); Takashi Yamamoto, Tokyo (JP); Yasuharu Tanaka, Tokyo (JP); Takashi Miyagi, Tokyo (JP); Misao Ogawa, Tokyo (JP); Junki Natori, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 353 days.

(21) Appl. No.: 18/030,409

(22) PCT Filed: Oct. 8, 2021

(86) PCT No.: PCT/JP2021/037432

§ 371 (c)(1),
(2) Date: Apr. 5, 2023

(87) PCT Pub. No.: WO2022/075464

PCT Pub. Date: Apr. 14, 2022

(65) Prior Publication Data

US 2023/0381848 A1 Nov. 30, 2023

(30) Foreign Application Priority Data

Oct. 9, 2020 (JP) ..... 2020-170894

(51) Int. Cl.
*B21D 22/20* (2006.01)

(52) U.S. Cl.
CPC ..... *B21D 22/20* (2013.01)

(58) Field of Classification Search
CPC ..... B21D 20/02; B21D 20/20; B21D 20/22; B21D 53/88
See application file for complete search history.

(56) References Cited

U.S. PATENT DOCUMENTS

2016/0243604 A1* 8/2016 Shiozaki ..... B21D 22/02

FOREIGN PATENT DOCUMENTS

JP 5708757 B1 4/2015

* cited by examiner

*Primary Examiner* — Debra M Sullivan
(74) *Attorney, Agent, or Firm* — Birch, Stewart, Kolasch & Birch, LLP

(57) ABSTRACT

A manufacturing method of a press-formed article (200) including: press-forming a metal sheet into a preformed article (100) including a preformed bottom sheet portion (110), a first preformed standing wall portion (120*a*), a second preformed standing wall portion (120*b*), a preformed ridge portion (130) provided between the first preformed standing wall portion (120*a*) and the second preformed standing wall portion (120*b*), and a swollen portion (140) provided between the preformed bottom sheet portion (110) and the first and second preformed standing wall portions (120*a*) and (120*b*); and press-forming the preformed article (100) into a press-formed article (200) including a bottom sheet portion (210), a first standing wall portion (220*a*) adjacent to the bottom sheet portion (210), a second standing wall portion (220*b*) adjacent to the bottom sheet portion (210), and a ridge portion (230) provided between the first standing wall portion (220*a*) and the second standing wall portion (220*b*).

4 Claims, 40 Drawing Sheets

(a)

(b)

(a)

(b)

(a)

(b)

(a)

(b)

(a)

(b)

MANUFACTURING METHOD OF PRESS-FORMED ARTICLE AND PRESS LINE

TECHNICAL FIELD OF THE INVENTION

The present invention relates to a manufacturing method of a press-formed article and a press line.

Priority is claimed on Japanese Patent Application No. 2020-170894, filed on Oct. 9, 2020, the content of which is incorporated herein by reference.

RELATED ART

Electric vehicles have been rapidly developed with the aim of reducing emissions of $CO_2$ such as regulations based on the corporate average fuel efficiency (CAFE). High-priced electric vehicles are currently becoming mainstream, but in order to reduce the prices of electric vehicles, it is necessary to develop components made of metals such as iron steel materials. As an example thereof, forming technologies for battery boxes, front pillar lowers, door inners, or the like made of an iron steel material or the like have been developed.

Usually, these components have a ridge portion (also referred to as a corner portion) and are manufactured by welding and assembling a plurality of members. However, in the forming technologies according to the related arts, in a case where the ridge portion had a relatively small radius of curvature, it was not possible to suppress cracks due to a local reduction in sheet thickness at the ridge portion, and it was not possible to perform forming into a desired shape.

As a method of manufacturing a formed article having a ridge portion, for example, Patent Document 1 discloses a press forming method in which in a step of forming a press-formed article having an L-shape, an L-shaped bent portion (ridge portion) is projected outward from a standing wall portion in an arc shape with a radius of curvature larger than the radius of curvature of a cross section crossing an extension direction of the bent portion, and a ridge portion connected to a top sheet portion is formed into an outwardly projecting shape with a radius of curvature larger than the radius of curvature of a cross section crossing an extension direction of the ridge portion.

PRIOR ART DOCUMENT

Patent Document

[Patent Document 1] Japanese Patent No. 5708757

DISCLOSURE OF THE INVENTION

Problems to be Solved by the Invention

The present invention is contrived in view of the above problems, and an object of the present invention is to provide a manufacturing method of a press-formed article and a press line for obtaining a formed article in which cracks or wrinkles are suppressed at a ridge portion.

Means for Solving the Problem (1) A manufacturing method of a press-formed article according to an aspect of the present invention includes:

press-forming a metal sheet into a preformed article including a preformed bottom sheet portion, a first preformed standing wall portion, a second preformed standing wall portion, a preformed ridge portion provided between the first preformed standing wall portion and the second preformed standing wall portion, and a swollen portion provided between the preformed bottom sheet portion and the first and second preformed standing wall portions; and press-forming the preformed article into a press-formed article including a bottom sheet portion, a first standing wall portion adjacent to the bottom sheet portion, a second standing wall portion adjacent to the bottom sheet portion, and a ridge portion provided between the first standing wall portion and the second standing wall portion, in which when a preformed article-cross section passing midway between the first preformed standing wall portion and the second preformed standing wall portion and a press-formed article-cross section passing midway between the first standing wall portion and the second standing wall portion are overlapped so that the preformed bottom sheet portion and the bottom sheet portion are overlapped and the preformed ridge portion and the ridge portion are overlapped, the swollen portion includes a first part which is provided inside the press-formed article and adjacent to the preformed ridge portion and a second part which is provided outside the press-formed article and adjacent to the preformed bottom sheet portion, and the first part and the second part are adjacent to each other.

(2) In the manufacturing method of a press-formed article according to (1), the second part may include a second A-part which is closer to the first part than a point farthest from the preformed bottom sheet portion in a thickness direction of the preformed bottom sheet portion in the second part and a second B-part which is closer to the preformed bottom sheet portion than the point, and a radius of curvature of an inner surface of a smallest bend in the second A-part and the first part in the preformed article-cross section may be 15 times or greater a sheet thickness of the metal sheet.

(3) In the manufacturing method of a press-formed article according to (1) or (2), when the preformed article-cross section and the press-formed article-cross section are overlapped so that the preformed bottom sheet portion and the bottom sheet portion are overlapped and the preformed ridge portion and the ridge portion are overlapped, an absolute value of a difference between a line length of the swollen portion and a line length of a part of the press-formed article which is separated from the swollen portion may be 4 times or less a sheet thickness of the metal sheet.

(4) In the manufacturing method of a press-formed article according to any one of (1) to (3), when the preformed article-cross section and the press-formed article-cross section are overlapped so that the preformed bottom sheet portion and the bottom sheet portion are overlapped and the preformed ridge portion and the ridge portion are overlapped, a distance from an intersection point C of an extension line of the bottom sheet portion and an extension line of the ridge portion to the preformed bottom sheet portion may be 60 times or less a sheet thickness of the metal sheet, and a distance from the intersection point C to the preformed ridge portion in a direction perpendicular to the bottom sheet portion may be 60 times or less the sheet thickness of the metal sheet.

(5) In the manufacturing method of a press-formed article according to any one of (1) to (4), the preformed article may include a flange portion adjacent to an end portion of the preformed ridge portion, and when the preformed article-cross section and the press-formed article-cross section are overlapped so that the preformed bottom sheet portion and the bottom sheet portion are overlapped and the preformed ridge portion and the ridge portion are overlapped, the flange portion of the press-formed article may be closer to the bottom sheet portion than the flange portion of the preformed article.

(6) In the manufacturing method of a press-formed article according to (5), when the preformed article-cross section and the press-formed article-cross section are overlapped so that the preformed bottom sheet portion and the bottom sheet portion are overlapped and the preformed ridge portion and the ridge portion are overlapped, the flange portion of the press-formed article may be moved by a distance of twice or greater and 30 times or less a sheet thickness of the metal sheet in a direction perpendicular to the bottom sheet portion from the flange portion of the preformed article.

(7) In the manufacturing method of a press-formed article according to (5) or (6), in the preformed article-cross section, a radius of curvature of an inner surface of a bend of a flange ridge portion between the flange portion and the preformed ridge portion of the preformed article may be 6 times or greater and 30 times or less a sheet thickness of the metal sheet.

(8) In the manufacturing method of a press-formed article according to any one of (5) to (7), in the press-formed article-cross section, a radius of curvature of an inner surface of a bend of a flange ridge portion may be 10 times or less a sheet thickness of the metal sheet.

(9) In the manufacturing method of a press-formed article according to any one of (1) to (8), in a cross section passing through the ridge portion parallel to the bottom sheet portion, a radius of curvature inside a bend of the ridge portion may be 30 times or less a sheet thickness of the metal sheet.

(10) In the manufacturing method of a press-formed article according to any one of (1) to (9), a cross section of the press-formed article parallel to the bottom sheet portion, which has the first standing wall portion, the second standing wall portion, and the ridge portion, may be a closed cross section.

(11) A press line according to an aspect of the present invention includes:

a first press portion including a first die, a first punch, and a first holder; and a second press portion including a second die and a second punch, in which a surface of a die hole of the first die has a first die-bottom surface portion, a first die-first side surface portion, a first die-second side surface portion, and a first die-concave ridge portion, the first die-concave ridge portion is provided between the first die-first side surface portion and the first die-second side surface portion, a first die-bottom surface concave portion which is partially recessed more than a center portion of the first die-bottom surface portion is provided at a position adjacent to an end portion of the first die-concave ridge portion in the first die-bottom surface portion, a surface of a die hole of the second die has a second die-bottom surface portion, a second die-first side surface portion, a second die-second side surface portion, and a second die-concave ridge portion, the second die-concave ridge portion is provided between the second die-first side surface portion and the second die-second side surface portion, and when a first die-cross section passing midway between the first die-first side surface portion and the first die-second side surface portion and a second die-cross section passing midway between the second die-first side surface portion and the second die-second side surface portion are overlapped so that the first die-bottom surface portion and the second die-bottom surface portion are overlapped and the first die-concave ridge portion and the second die-concave ridge portion are overlapped, the first die-bottom surface concave portion includes a first part which is provided outside the second die and adjacent to the first die-concave ridge portion and a second part which is provided inside the second die and adjacent to the first part.

(12) In the press line according to (11), when the first die-cross section and the second die-cross section are overlapped so that the first die-bottom surface portion and the second die-bottom surface portion are overlapped and the first die-concave ridge portion and the second die-concave ridge portion are overlapped, the second part may include a second A-part which is closer to the first part than a point recessed deepest in the second part and a second B-part which is closer to a center portion of the first die-bottom surface portion than the point, and a smallest radius of curvature in the second A-part and the first part in the first die-cross section may be 16 times or greater a clearance between the first die and the first punch.

(13) In the press line according to (11) or (12), when the first die-cross section and the second die-cross section are overlapped so that the first die-bottom surface portion and the second die-bottom surface portion are overlapped and the first die-concave ridge portion and the second die-concave ridge portion are overlapped, an absolute value of a difference between a line length of the first die-bottom surface concave portion and a line length of the second die-bottom surface portion which is separated from the first die-bottom surface concave portion may be 4 times or less a clearance between the first die and the first punch.

(14) In the press line according to any one of (11) to (13), when the first die-cross section and the second die-cross section are overlapped so that the first die-bottom surface portion and the second die-bottom surface portion are overlapped and the first die-concave ridge portion and the second die-concave ridge portion are overlapped, a distance from an intersection point C of an extension line of the second die-bottom surface portion and an extension line of the second die-concave ridge portion to an end portion of the second part on a first die-bottom surface portion side may be 60 times or less a clearance between the first die and the first punch, and a distance from the intersection point C to an end portion of the first part on a first die-concave ridge portion side in a direction perpendicular to the first die-bottom surface portion may be 60 times or less the clearance.

(15) In the press line according to any one of (11) to (14), in a cross section passing through the first die-concave ridge portion parallel to the first die-bottom surface portion, a radius of curvature of the first die-concave ridge portion may be 31 times or less a clearance between the first die and the first punch.

Effects of the Invention

According to a manufacturing method of a press-formed article and a press line of the present invention, it is possible to obtain a formed article in which cracks or wrinkles are suppressed at a ridge portion.

EMBODIMENTS OF THE INVENTION

Figure 1:
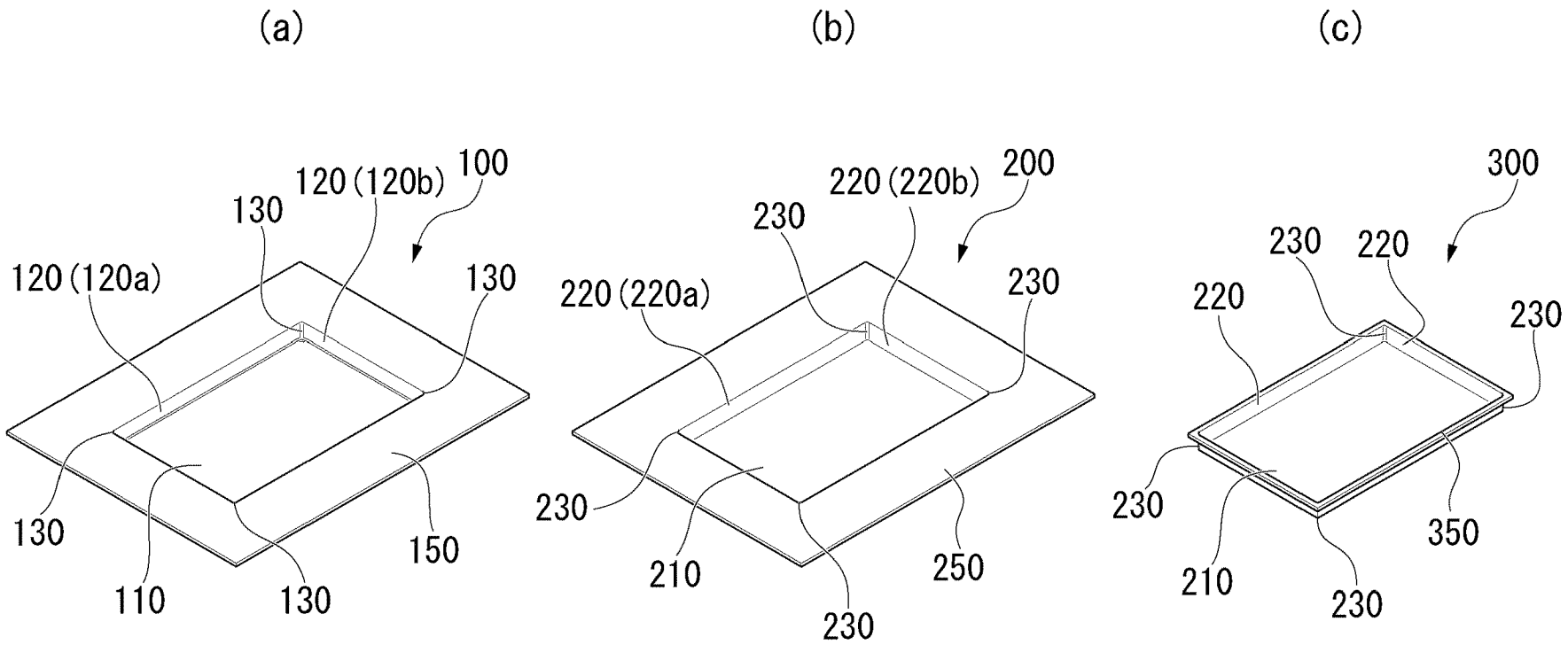
FIG. 1 is a schematic perspective view of (a) a preformed article, (b) a formed article, and (c) a product.

The present inventors have studied a forming method capable of forming a shape which requires strict forming conditions and in which the radius of curvature of a ridge portion of a cross section crossing an extension direction of the ridge portion is small. Hereinafter, the radius of curvature of the ridge portion of the cross section crossing the extension direction of the ridge portion will be referred to as the radius of curvature of the ridge portion. According to the studies of the present inventors, it has been found that in a case where preforming is performed so that the standing wall side is projected as in the technology disclosed in Patent Document 1, there is a concern that cracks may occur during preforming or wrinkles may occur during main forming at a ridge portion (corner portion) in which the standing walls are connected to each other. Therefore, the present inventors have studied a manufacturing method of a press-formed article in which cracks or wrinkles are suppressed at a ridge portion. The present invention is contrived in view of the above circumstances.

Hereinafter, embodiments of the present invention will be described with reference to examples, but it is obvious that the present invention is not limited to the examples to be described below. In the following description, specific numerical values and materials may be provided as examples, but other numerical values and materials may be applied as long as the effect of the present invention can be obtained. In addition, constituent elements of the following embodiments can be combined with each other.

First Embodiment

A manufacturing method of a press-formed article according to the present embodiment includes a step of press-forming a metal sheet into a preformed article including a preformed bottom sheet portion, a first preformed standing wall portion, a second preformed standing wall portion, a preformed ridge portion provided between the first preformed standing wall portion and the second preformed standing wall portion, and a swollen portion provided between the preformed bottom sheet portion and the first and second preformed standing wall portions. In addition, the manufacturing method of a press-formed article according to the present embodiment includes a step of press-forming the preformed article into a press-formed article including a bottom sheet portion, a first standing wall portion adjacent to the bottom sheet portion, a second standing wall portion adjacent to the bottom sheet portion, and a ridge portion provided between the first standing wall portion and the second standing wall portion. In the manufacturing method of a press-formed article according to the present embodiment, when a preformed article-cross section passing midway between the first preformed standing wall portion and the second preformed standing wall portion and a press-formed article-cross section passing midway between the first standing wall portion and the second standing wall portion are overlapped so that the preformed bottom sheet portion and the bottom sheet portion are overlapped and the preformed ridge portion and the ridge portion are overlapped, the swollen portion includes a first part which is provided inside the press-formed article and adjacent to the preformed ridge portion and a second part which is provided outside the press-formed article and adjacent to the preformed bottom sheet portion, and the first part and the second part are adjacent to each other.

In the manufacturing method of the press-formed article having the above-described configuration, the swollen portion is formed in an end portion region of the preformed bottom sheet portion in the preforming step, and is press-formed in the main forming step so as to be a part of the bottom sheet portion and the standing wall portion of the formed article, so that a formed article in which cracks or wrinkles are suppressed at the ridge portion can be obtained.

In FIG. 1, (a) shows a schematic perspective view of a preformed article, (b) shows a schematic perspective view of a press-formed article, and (c) shows a schematic perspective view of a product. In a preforming step (S1), a metal sheet (not shown) is press-formed to form a preformed article 100 as shown in (a) in FIG. 1. In a main forming step (S2), the preformed article 100 is further press-formed to form a press-formed article 200 as shown in (b) in FIG. 1. The press-formed article 200 may be made into a product 300 as shown in (c) in FIG. 1 through a further processing step (S3). Alternatively, the press-formed article 200 may be used as a final product. The product 300 can be preferably used as, for example, a battery box for a vehicle. It is necessary for the battery box for a vehicle to have a high capacity and to secure a sealing performance for dealing with leakage of battery liquid. In order to satisfy the requirements, it is more advantageous to form a rectangular tubular shape such as the product 300 by integral forming than to form a rectangular tubular shape by joining a plurality of components.

Figure 2:
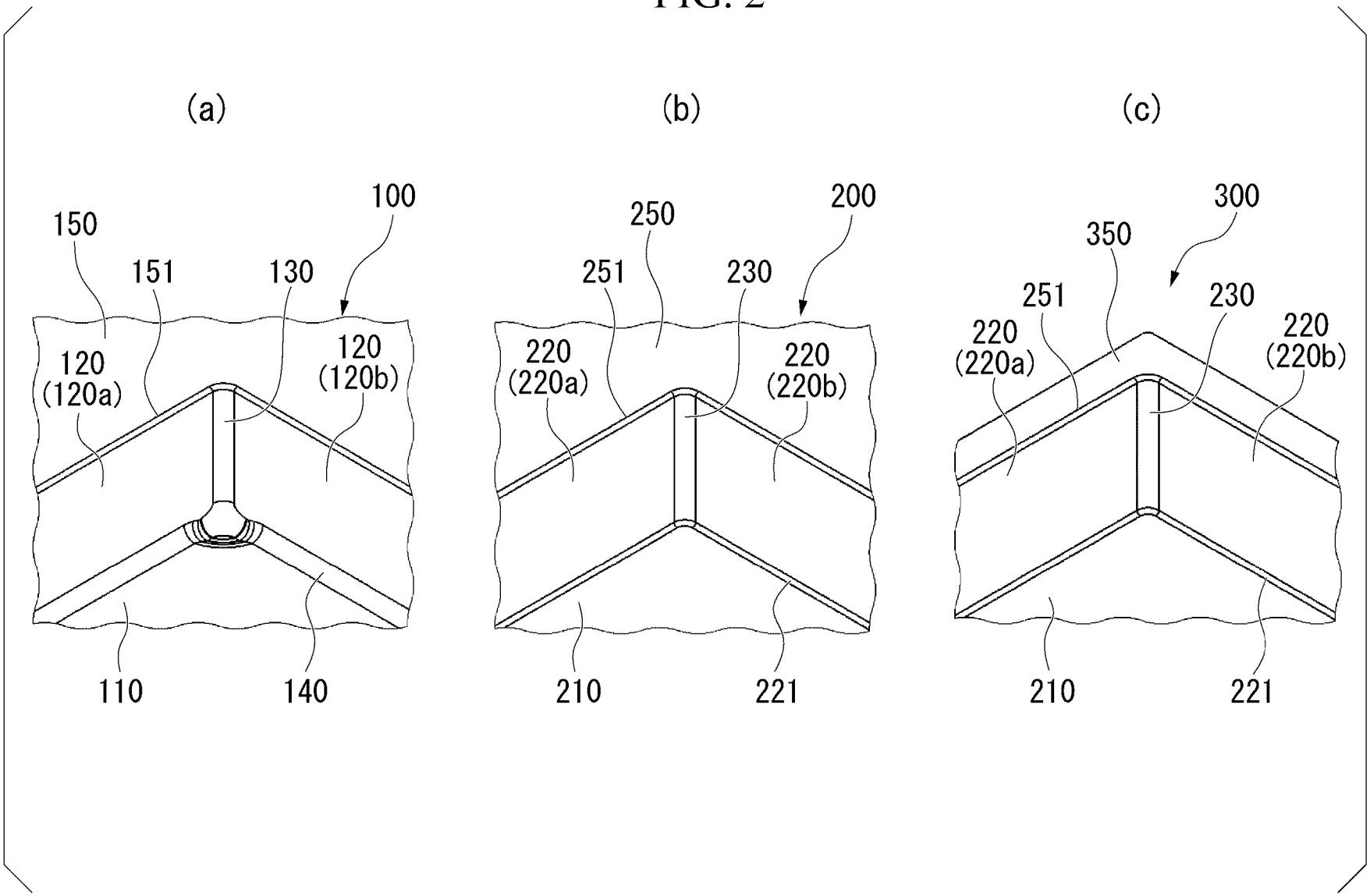
FIG. 2 is a schematic perspective view of a ridge portion or a preformed ridge portion of (a) the preformed article, (b) the formed article, and (c) the product.

FIG. 2 is an enlarged schematic perspective view of the vicinity of the ridge portion or the preformed ridge portion of (a) to (c) in FIG. 1. As shown in (a) in FIG. 2, the preformed article 100 includes a preformed bottom sheet portion 110, a preformed ridge portion 130 provided between preformed standing wall portions 120 (first preformed standing wall portion 120*a* and second preformed standing wall portion 120*b*), and a swollen portion 140 provided between the preformed bottom sheet portion 110 and the preformed standing wall portion 120. In the example of (a) in FIG. 2, the preformed article 100 further includes a flange portion 150. In addition, as shown in (b) in FIG. 2, the press-formed article 200 includes a bottom sheet portion 210 and a ridge portion 230 provided between standing wall portions 220 (first standing wall portion 220*a* and second standing wall portion 220*b*) adjacent to the bottom sheet portion 210. Furthermore, as shown in (c) in FIG. 2, the product 300 may include a trimmed flange portion 350.

(Preforming Step)

In the preforming step (S1), a metal sheet is press-formed to form a preformed article 100 including a preformed bottom sheet portion 110 corresponding to a bottom sheet portion 210, a plurality of preformed standing wall portions 120 (first preformed standing wall portion 120*a* and second preformed standing wall portion 120*b*) corresponding to standing wall portions 220 and standing from the preformed bottom sheet portion 110, and a preformed ridge portion 130 corresponding to a ridge portion 230 and connecting the preformed standing wall portions 120 to each other. The metal sheet may be a steel sheet, an aluminum alloy sheet, a titanium alloy sheet, or a composite material thereof. As the metal sheet, a steel sheet having a tensile strength of 270 to 440 MPa is more preferably used from the viewpoint of material elongation. In addition, the metal sheet may be subjected to processing such as plating for the purpose of preventing rust and corrosion.

In addition, in the preforming step (S1), in an end portion region 111 where the preformed standing wall portion 120 stands in the preformed bottom sheet portion 110, a swollen portion 140 is formed which is positioned closer to the preformed bottom sheet portion 110 than the preformed standing wall portion 120 as a whole and swells to the side opposite to the side on which the preformed standing wall portion 120 stands in a cross-sectional view orthogonal to the sheet surface of the preformed bottom sheet portion 110 and passing through the preformed ridge portion 130. The swollen portion 140 is connected to the preformed bottom sheet portion 110, the preformed standing wall portion 120, and the preformed ridge portion 130. The end portion region 111 is a partial region of the preformed bottom sheet portion 110, and is a region near an edge portion of the preformed bottom sheet portion 110 to which the preformed standing wall portion 120 and the preformed ridge portion 130 are connected. The preformed ridge portion 130 is a part of the preformed standing wall portion 120, and in the present embodiment, the preformed standing wall portion 120 can be replaced with the preformed ridge portion 130.

Figure 3:
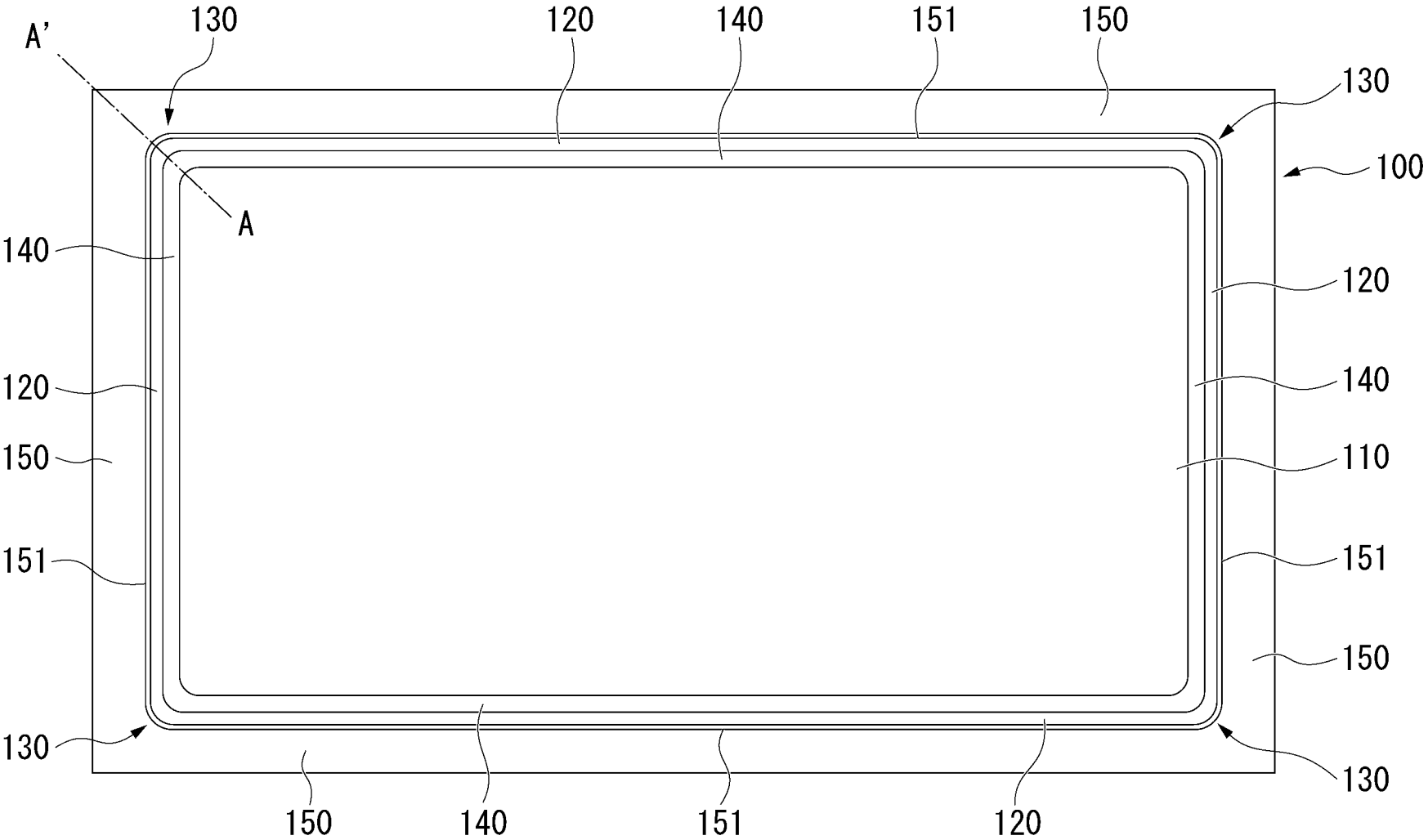
FIG. 3 is a schematic plan view of the preformed article viewed in a direction perpendicular to a preformed bottom sheet portion.
Figure 4:
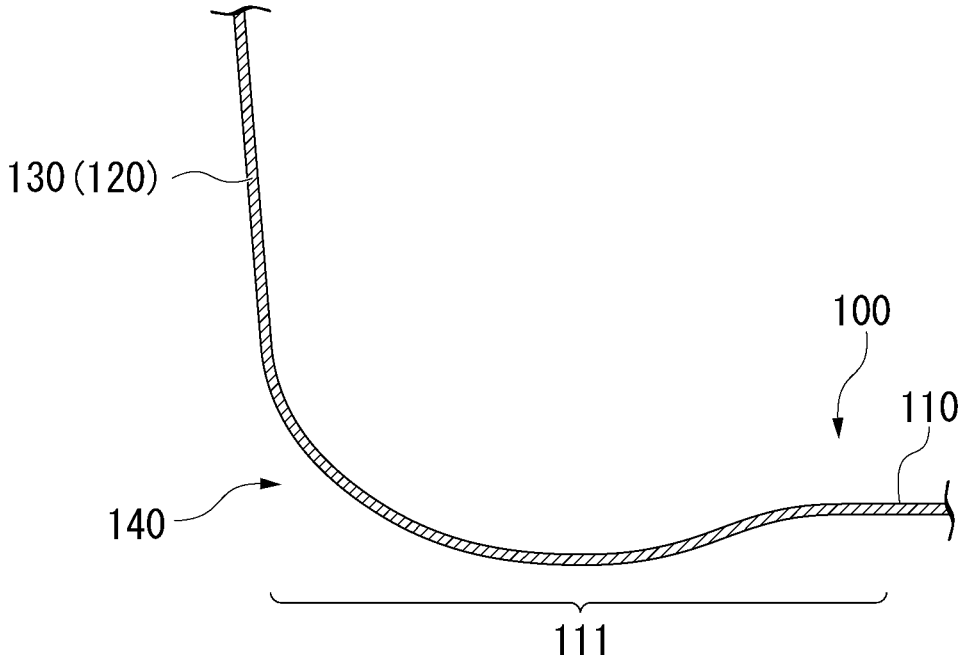
FIG. 4 is a schematic cross-sectional view of the preformed article in a cross-sectional view in a plane passing through the position of the line A-A' in FIG. 3.

FIG. 3 shows a schematic plan view of the preformed article 100 viewed in a direction perpendicular to the preformed bottom sheet portion 110. In the example of FIG. 3, the preformed article 100 includes a substantially rectangular preformed bottom sheet portion 110. FIG. 4 shows a schematic cross-sectional view of the preformed article 100 in a cross-sectional view in a plane orthogonal to the sheet surface of the preformed bottom sheet portion 110 at the position of the line A-A' in FIG. 3. FIG. 4 is an example of a schematic cross-sectional view of the preformed article 100 in a cross-sectional view in a plane orthogonal to the sheet surface of the preformed bottom sheet portion 110 and passing through the preformed ridge portion 130. The plane passing through the position of the line A-A' in FIG. 3 may be a preformed article-cross section passing midway between the first preformed standing wall portion 120*a* and the second preformed standing wall portion 120*b*. Specifically, the plane may be a plane which is orthogonal to the sheet surface of the preformed bottom sheet portion 110 in the preformed article 100 and forms an equal angle with the sheet surface of each of the preformed standing wall portions 120 connected via the preformed ridge portion 130.

The swollen portion 140 is connected to the preformed bottom sheet portion 110, the preformed standing wall portion 120, and the preformed ridge portion 130. The entire swollen portion 140 is positioned closer to the preformed bottom sheet portion 110 than the preformed standing wall portion 120 or the preformed ridge portion 130. Specifically, the entire range of the swollen portion 140 is positioned closer to the preformed bottom sheet portion 110 than an imaginary line extending from the preformed standing wall portion 120 or the preformed ridge portion 130 in the above-described cross-sectional view. In addition, a part or the whole of the swollen portion 140 swells to the side opposite to the side on which the preformed standing wall portion 120 stands with respect to the sheet surface of the preformed bottom sheet portion 110.

The swollen portion 140 is preferably smoothly connected to the preformed bottom sheet portion 110, the preformed standing wall portion 120, and the preformed ridge portion 130, and preferably has a curved shape in the above-described cross-sectional view. In addition, it is more preferable that the swollen portion 140 extends to the side on which the preformed standing wall portion 120 stands with respect to the sheet surface of the preformed bottom sheet portion 110. The swollen portion 140 may be provided in a range including the entire preformed ridge portion 130 when viewed from a direction perpendicular to the sheet surface of the preformed bottom sheet portion 110, or provided in a part including a center portion of the preformed ridge portion 130. As shown in FIGS. 2 and 3, the swollen portion 140 may be optionally provided in the entire range of the end portion region 111 of the preformed bottom sheet portion 110.

The preformed article 100 obtained in the preforming step (S1) may be used as an intermediate article of the press-formed article. That is, the intermediate article according to the present embodiment is an intermediate article for manufacturing a press-formed article including a bottom sheet portion, a plurality of standing wall portions connected to the bottom sheet portion and standing from the bottom sheet portion, and a ridge portion connecting the standing wall portions to each other, and is an intermediate article including a preformed bottom sheet portion corresponding to the bottom sheet portion, a plurality of preformed standing wall portions corresponding to the standing wall portions and standing from the preformed bottom sheet portion, and a preformed ridge portion corresponding to the ridge portion and connecting the preformed standing wall portions to each other, in which in an end portion region where the preformed standing wall portion stands in the preformed bottom sheet portion, a swollen portion is provided which is positioned closer to the preformed bottom sheet portion than the preformed standing wall portion as a whole so as to be connected to the preformed standing wall portion, and swells to the side opposite to the side on which the preformed standing wall portion stands so as to be connected to the preformed bottom sheet portion in a cross-sectional view orthogonal to the sheet surface of the preformed bottom sheet portion and passing through the preformed ridge portion.

The intermediate article having the above-described configuration has a swollen portion in an end portion region of the preformed bottom sheet portion. By press-forming the swollen portion of the intermediate article so that the swollen portion becomes a part of a bottom sheet portion and a standing wall portion of a formed article, a formed article in which cracks or wrinkles are suppressed in a ridge portion can be obtained.

(Main Forming Step)

Figure 5:
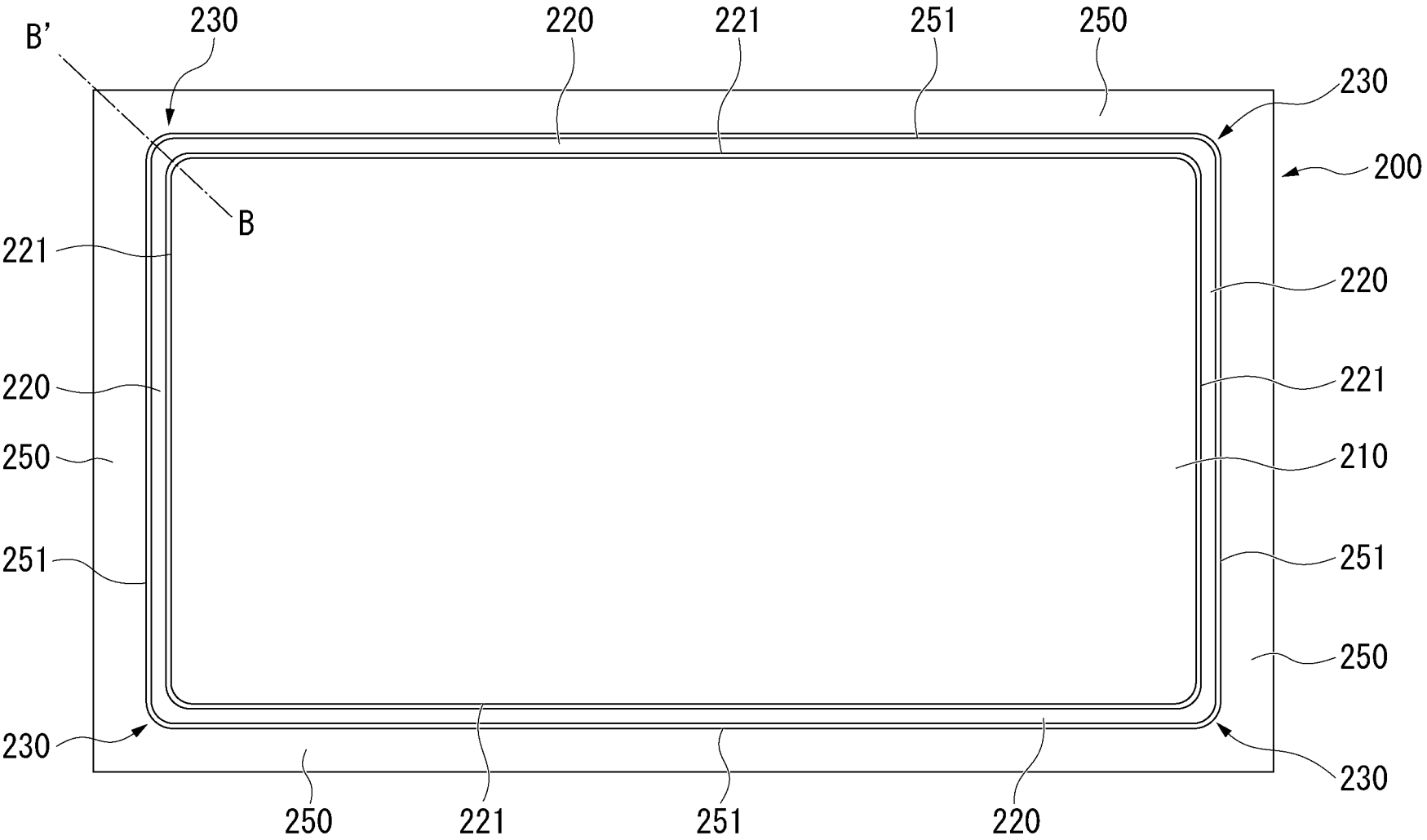
FIG. 5 is a schematic plan view of the formed article viewed in a direction perpendicular to a bottom sheet portion.
Figure 6:
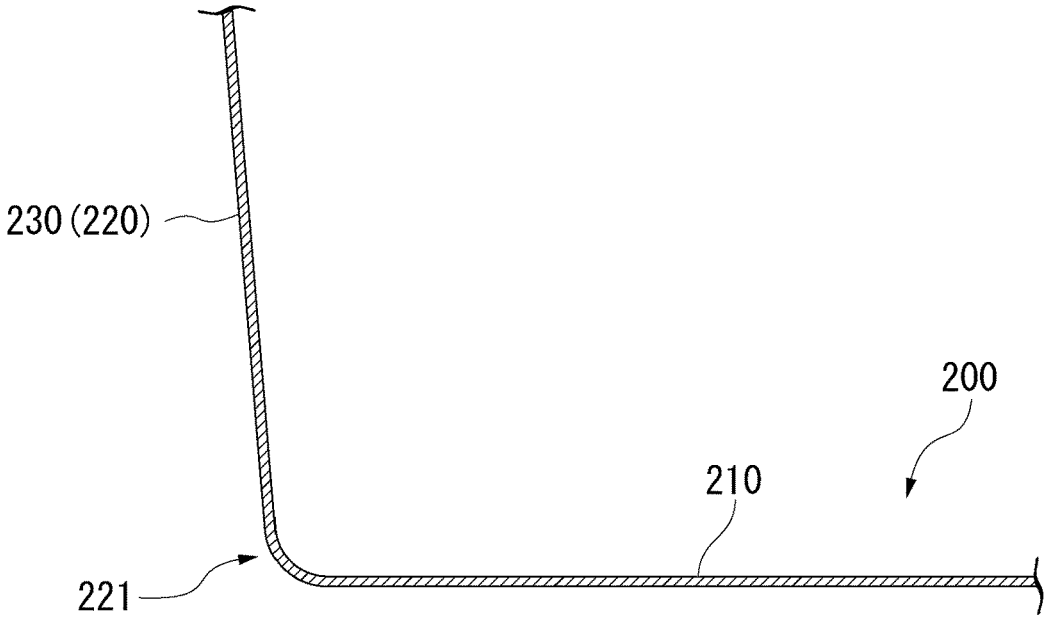
FIG. 6 is a schematic cross-sectional view of the formed article in a cross-sectional view in a plane passing through the position of the line B-B' in FIG. 5.

In the main forming step (S2), the preformed article 100 is press-formed into a press-formed article 200 including a bottom sheet portion 210, standing wall portions 220 (first standing wall portion 220*a* and second standing wall portion 220*b*) adjacent to the bottom sheet portion 210, and a ridge portion 230 provided between the standing wall portions 220. FIG. 5 shows a schematic plan view of the press-formed article 200 viewed in a direction perpendicular to the sheet surface of the bottom sheet portion 210. In addition, FIG. 6 shows a schematic cross-sectional view of the press-formed article 200 in a cross-sectional view in a plane orthogonal to the sheet surface of the bottom sheet portion 210 at the position of the line B-B' in FIG. 5. The cross-sectional view shown in FIG. 6 is an example of the cross-sectional view orthogonal to the sheet surface of the bottom sheet portion 210 and passing through the ridge portion 230. The plane passing through the position of the line B-B' in FIG. 5 may be a press-formed article-cross section passing midway between the first standing wall portion 220*a* and the second standing wall portion 220*b*. Specifically, the plane may be a plane which is orthogonal to the sheet surface of the bottom sheet portion 210 in the press-formed article 200 and forms an equal angle with the sheet surface of each of the standing wall portions 220 connected via the ridge portion 230. In the main forming step (S2), the swollen portion 140 as shown in FIG. 4 is press-formed so as to be a part of the bottom sheet portion 210, the standing wall portion 220, and the ridge portion 230, and thus the bottom sheet portion 210 and the standing wall portion 220 (or the ridge portion 230) are connected by a standing wall ridge portion 221 as shown in FIG. 6. The ridge portion 230 is a part of the standing wall portion 220, and in the present embodiment, the standing wall portion 220 can be replaced with the ridge portion 230.

In the press-formed article-cross section passing midway between the first standing wall portion 220*a* and the second standing wall portion 220*b*, the radius of curvature Rw of an inner surface of the standing wall ridge portion 221 is preferably 10 times or less the sheet thickness of the metal sheet. The surface on the inside of the standing wall ridge portion 221 is the inner surface of the standing wall ridge portion 221. The standing wall ridge portion 221 is connected to the bottom sheet portion 210, the standing wall portion 220, and the ridge portion 230.

After the main forming step (S2), a further processing step (S3) may be performed. In the processing step (S3), machining, bending, trimming of the flange portion, and the like may be performed. In the example of (c) in FIG. 1, the flange portion 250 is trimmed.

In addition, when a preformed article-cross section passing midway between the preformed standing wall portions 120 (first preformed standing wall portion 120*a* and second preformed standing wall portion 120*b*) in this step and a press-formed article-cross section passing midway between the standing wall portions 220 (first standing wall portion 220*a* and second standing wall portion 220*b*) are overlapped so that the preformed bottom sheet portion 110 and the bottom sheet portion 210 are overlapped and the preformed ridge portion 130 and the ridge portion 230 are overlapped, the swollen portion 140 includes a first part 141 which is provided inside the press-formed article 200 and adjacent to the preformed ridge portion 130 and a second part 142 which is provided outside the press-formed article 200 and adjacent to the preformed bottom sheet portion 110, and the first part 141 and the second part 142 are adjacent to each other.

The inside of the press-formed article 200 means the inside of a bend of the press-formed article 200. Similarly, the outside of the press-formed article 200 means the outside of the bend of the press-formed article 200. In addition, the expression "when . . . the preformed ridge portion 130 and the ridge portion 230 are overlapped" mentioned here represents the relationship when the cross-sectional views are overlapped. The bend of the press-formed article 200 refers to a bend between the bottom sheet portion 210 and the standing wall portion 220. The cross-sectional view shown in FIG. 8 will be described in detail later.

In the manufacturing method of a press-formed article according to the present embodiment, the second part 142 may include a second A-part which is closer to the first part than a point farthest from the preformed bottom sheet portion 110 in the thickness direction of the preformed bottom sheet portion 110 in the second part 142 and a second B-part which is closer to the preformed bottom sheet portion 110 than the point, and the radius of curvature of an inner surface of a smallest bend in the second A-part and the first part 141 in the preformed article-cross section may be 15 times or greater the sheet thickness of the metal sheet.

Figure 7:
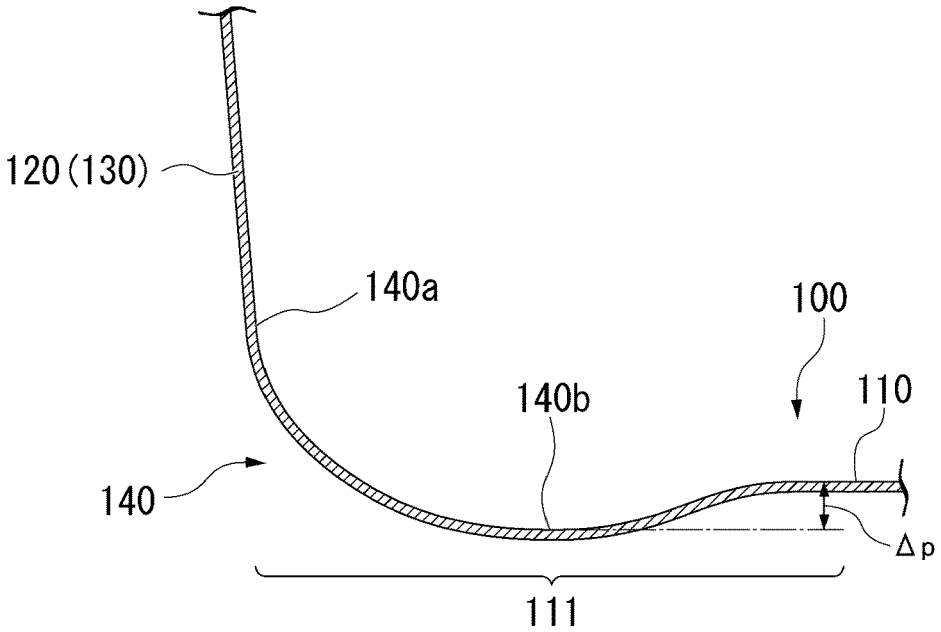
FIG. 7 is a view showing the radius of curvature of a swollen portion, and is a schematic cross-sectional view in the preformed ridge portion of the preformed article.

FIG. 7 shows a cross-sectional view of the preformed article passing midway between the first preformed standing wall portion 120*a* and the second preformed standing wall portion 120*b*. The term "midway" mentioned here means a plane which is orthogonal to the sheet surface of the preformed bottom sheet portion 110 in the preformed article 100 and forms an equal angle with the sheet surface of each of the preformed standing wall portions 120 connected via the preformed ridge portion 130. A point 140*a* of the swollen portion 140 connected to the preformed standing wall portion 120 (or the preformed ridge portion 130) means a boundary between the preformed standing wall portion 120 (or the preformed ridge portion 130) having a substantially linear cross section and the swollen portion 140 having a curved cross section as shown in FIG. 7. The point 140*a* is a point on the inner surface of the preformed article 100 in the cross-sectional view of FIG. 7. A point 140*b* of the swollen portion 140 farthest from the preformed bottom sheet portion 110 means a point at which the distance (Op in FIG. 7) in a direction perpendicular to the sheet surface of the preformed bottom sheet portion 110 from the inner surface of the preformed bottom sheet portion 110 is maximized on the inner surface of the swollen portion 140 as shown in FIG. 7. Here, the inner surfaces of the preformed bottom sheet portion 110 and the swollen portion 140 mean a surface on the side on which the preformed standing wall portion 120 is positioned with respect to the preformed bottom sheet portion 110.

Figure 8:
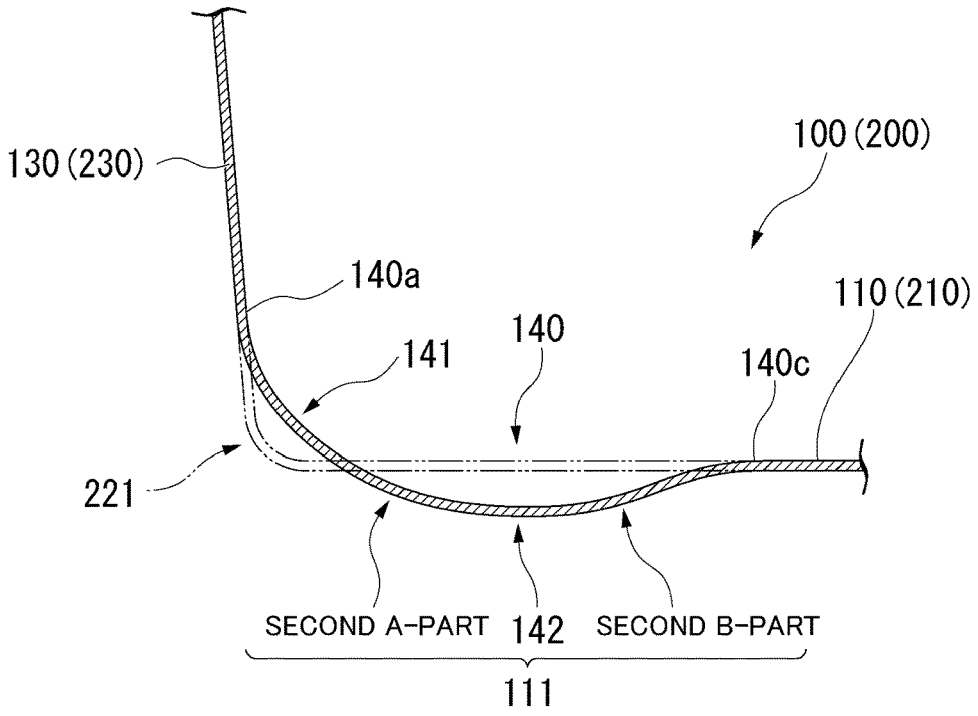
FIG. 8 is a view showing a difference in line length between the preformed article and the formed article, and is a schematic cross-sectional view in the preformed ridge portion of the preformed article and the ridge portion of the press-formed article.

In addition, FIG. 8 shows a cross-sectional view in which the cross section (solid line) of the preformed article 100 and the cross section (chain double-dashed line) of the press-formed article 200 are overlapped. A point 140*c* of the swollen portion 140 connected to the preformed bottom sheet portion 110 means a boundary between the preformed bottom sheet portion 110 having a substantially linear cross section and the swollen portion 140 having a curved cross section as shown in FIG. 8. The point 140*c* is a point on the inner surface of the preformed article 100 in the cross-sectional view of FIG. 8. Here, the inner surface of the preformed article 100 refers to the inner surfaces of the swollen portion 140 and the preformed bottom sheet portion 110 described above.

The shape of the preformed article 100 is a shape by which strain concentration is reduced in the press forming. That is, when the second part 142 is flattened, the metal is pushed from the second part 142 toward the first part 141, and thus the strain concentration in the first part 141 can be reduced. Since the metal is directly pushed from the second part 142 to the first part 141, the first part 141 and the second part 142 are adjacent to each other. In a case where the first part 141 and the second part 142 are separated from each other, the metal extruded from the second part 142 is absorbed in a part between the first part 141 and the second part 142. The second part 142 projects toward the outside of the press-formed article 200. In a case where the second part 142 projects inward, a bent portion is provided between the first part 141 and the second part 142. In a case where a bent portion is formed, the flow of the metal from the second part 142 to the first part 141 may be suppressed. By setting the radius of curvature of an inner surface of a smallest bend in the second A-part and the first part 141 in the above-described cross section to 15 times or greater the sheet thickness of the metal sheet, cracks can be more stably suppressed. In addition, it is more preferable that the radius of curvature is 18 times or greater the sheet thickness of the metal sheet. Here, the radius of curvature is the radius of curvature of the inner surface of the preformed bottom sheet portion 110.

In the manufacturing method of a press-formed article according to the present embodiment, when the preformed article-cross section and the press-formed article-cross section are overlapped so that the preformed bottom sheet portion 110 and the bottom sheet portion 210 are overlapped and the preformed ridge portion 130 and the ridge portion 230 are overlapped, the absolute value of a difference between the line length of the swollen portion 140 and the line length of a part of the press-formed article 200 which is separated from the swollen portion 140 may be 4 times or less the sheet thickness of the metal sheet.

The absolute value of the difference between the line length of the swollen portion 140 and the line length of a part of the press-formed article 200 which is separated from the swollen portion 140 in the cross section of FIG. 8 is represented by ΔL.

In the example of FIG. 8, the cross section passing through the position of the line A-A' in FIG. 3 and the cross section passing through the position of the line B-B' in FIG. 5 are the same. That is, in FIG. 8, the absolute value ΔL of the difference between the line length of the press-formed article 200 represented by the chain double-dashed line and the line length of the shaded preformed article 100 in the section between the point 140*a* and the point 140*c* may be 4 times or less the sheet thickness of the metal sheet.

In a case where the line length of the preformed article 100 is too large as compared with that of the press-formed article 200, the first part 141 cannot completely absorb the inflow of the metal from the second part 142, and thus wrinkles occur in the press-formed article 200. On the contrary, in a case where the line length of the preformed article 100 is too small as compared with that of the press-formed article 200, the metal flowing to the first part 141 is insufficient, and cracks occur in the press-formed article. In a case where ΔL is 4 times or less the sheet thickness of the metal sheet, the occurrence of cracks or wrinkles in the ridge portion 230 in the main forming step can be more stably suppressed. In addition, it is more preferable that ΔL is twice or less the sheet thickness of the metal sheet.

In the manufacturing method of a press-formed article according to the present embodiment, when the preformed article-cross section and the press-formed article-cross section are overlapped so that the preformed bottom sheet portion 110 and the bottom sheet portion 210 are overlapped and the preformed ridge portion 130 and the ridge portion 230 are overlapped, the distance from an intersection point C of the extension line of the bottom sheet portion 210 and the extension line of the ridge portion 230 to the preformed bottom sheet portion 110 may be 60 times or less the sheet thickness of the metal sheet, and the distance from the intersection point C to the preformed ridge portion 130 in a direction perpendicular to the bottom sheet portion 210 may be 60 times or less the sheet thickness of the metal sheet.

Figure 9:
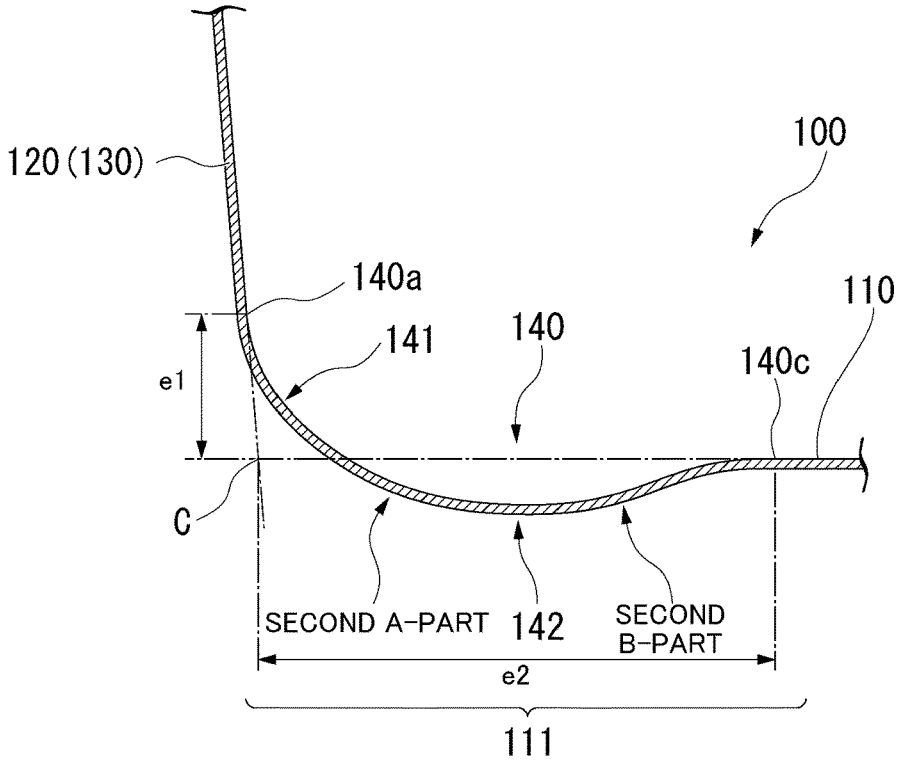
FIG. 9 is a view showing an intersection point of an imaginary line extending from a preformed standing wall portion and an imaginary line extending from the preformed bottom sheet portion, and is a schematic cross-sectional view of the preformed article and the press-formed article viewed in an overlapping manner in the preformed ridge portion (ridge portion).

FIG. 9 shows a cross-sectional view in which the cross section of the preformed article 100 (solid line) and the cross section of the press-formed article 200 (chain double-dashed line) are overlapped as in FIG. 8. The intersection point C is an intersection point of an imaginary line extending from the bottom sheet portion 210 (preformed bottom sheet portion 110) and an imaginary line extending from the ridge portion 230 (preformed ridge portion 130) in the above-described cross section. By setting a distance e1, which is a distance from the intersection point C to the preformed bottom sheet portion 110, and a distance e2, which is the distance from the intersection point C in a direction perpendicular to the preformed bottom sheet portion 110, to 60 times or less the sheet thickness of the metal sheet, the swollen portion 140 can be allowed to effectively flow toward the standing wall ridge portion 221 in the main forming step. In addition, it is more preferable that the distance e1 and the distance e2 are 45 times or less the sheet thickness of the metal sheet. The distance e1 and the distance e2 may be rephrased as a height e1 of the swollen portion 140 and a length e2 of the swollen portion 140, respectively. The lower limits of the distance e1 and the distance e2 are 5 times or greater the sheet thickness of the metal sheet.

In the manufacturing method of a press-formed article according to the present embodiment, the preformed article 100 may include a flange portion 150 adjacent to an end portion of the preformed ridge portion 130, and when the preformed article-cross section and the press-formed article-cross section are overlapped so that the preformed bottom sheet portion 110 and the bottom sheet portion 210 are overlapped and the preformed ridge portion 130 and the ridge portion 230 are overlapped, the flange portion 150 of the press-formed article 200 may be closer to the bottom sheet portion 210 than the flange portion 150 of the preformed article 100.

Figure 10:
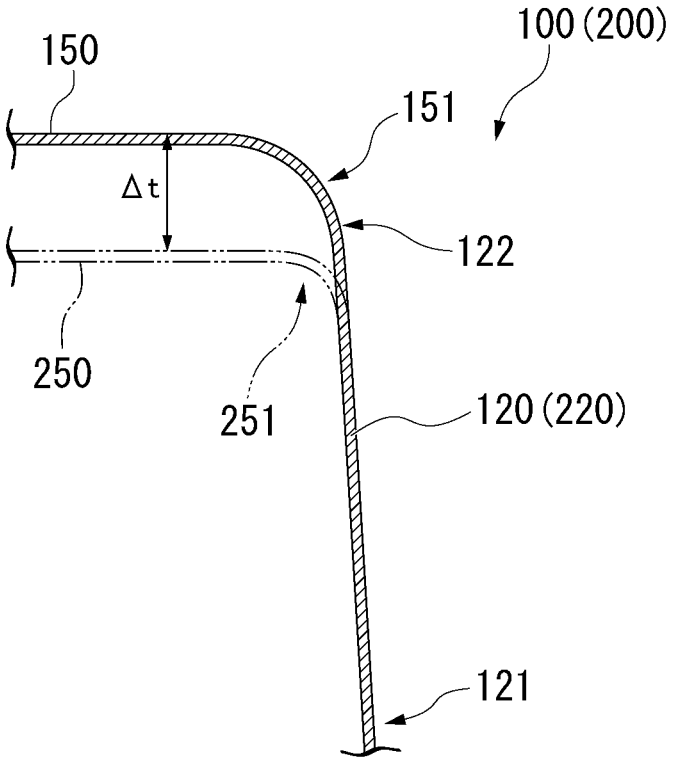
FIG. 10 is a view showing a flange portion and a flange ridge portion, and is a schematic cross-sectional view in the preformed ridge portion of the preformed article.

In the preforming step (S1), the flange portion 150 may be formed. FIG. 10 shows an example of a schematic cross-sectional view of the preformed article 100 in a cross-sectional view in a plane orthogonal to the sheet surface of the preformed bottom sheet portion 110 and passing through the preformed ridge portion 130. As shown in FIG. 10, the flange portion 150 is connected to the preformed standing wall portion 120 via a flange ridge portion 151 at a tip end portion 122 of the preformed standing wall portion 120 (preformed ridge portion 130). In addition, although not shown, the preformed standing wall portion 120 is connected to the preformed bottom sheet portion 110 at a base end portion 121 of the preformed standing wall portion 120. FIG. 10 illustrates a cross section passing through the preformed ridge portion 130, but the flange portion 150 and the flange ridge portion 151 may be constituted in the same manner also in a cross section which is orthogonal to the sheet surface of the preformed bottom sheet portion 110 and does not pass through the preformed ridge portion 130.

In the main forming step (S2), the flange portion 150 is relatively moved with respect to the bottom sheet portion 210 so that the flange portion 150 and the bottom sheet portion 210 are close to each other in a direction perpendicular to the sheet surface of the bottom sheet portion 210, and thus the flange portion 250 of the press-formed article 200 is disposed closer to the bottom sheet portion 210 than the flange portion 150 of the preformed article 100. Accordingly, in the ridge portion 230 of the press-formed article 200, the occurrence of cracks or wrinkles in the flange portion 250 in which the flange portion 150 is deformed can be suppressed.

In addition, in the manufacturing method of a press-formed article according to the present embodiment, when the preformed article-cross section and the press-formed article-cross section are projected so that the preformed bottom sheet portion 110 and the bottom sheet portion 210 are overlapped and the preformed ridge portion 130 and the ridge portion 230 are overlapped, the flange portion 250 of the press-formed article 200 may be moved by a distance of twice or greater and 30 times or less the sheet thickness of the metal sheet in a direction perpendicular to the bottom sheet portion 210 from the flange portion 150 of the preformed article 100. With such a configuration, the surplus material of the flange portion 150 generated in the preforming step can be effectively elongated in the circumferential direction of the preformed ridge portion 130. It is more preferable that the moving distance is 5 times or greater and 25 times or less the sheet thickness of the metal sheet in a direction perpendicular to the sheet surface of the bottom sheet portion 210.

In addition, in the manufacturing method of a press-formed article according to the present embodiment, in the preformed article-cross section, the radius of curvature of an inner surface of a bend of the flange ridge portion 151 between the flange portion 150 and the preformed ridge portion 130 of the preformed article 100 may be 6 times or greater and 30 times or less the sheet thickness of the metal sheet. In addition, in a case where the radius of curvature changes in the flange ridge portion 151, the radius of curvature may be 6 times or greater and 30 times or less the sheet thickness in the entire range. The inner surface of the bend of the flange ridge portion 151 means a surface on the inside of the flange ridge portion 151, and means a surface on the side on which the flange portion 150 is positioned with respect to the preformed standing wall portion 120. With such a configuration, the flange portion 150 can be prevented from material breaking, and the surplus material of the flange portion 150 can be effectively elongated in the circumferential direction of the preformed ridge portion 130. It is more preferable that the radius of curvature is 10 times or greater and 25 times or less the sheet thickness of the metal sheet.

In the manufacturing method of a press-formed article according to the present embodiment, in the press-formed article-cross section, the radius of curvature of an inner surface of a bend of the flange ridge portion 251 may be 10 times or less the sheet thickness of the metal sheet. In addition, in a case where the radius of curvature changes in the flange ridge portion 251, the radius of curvature may be 10 times or less the sheet thickness of the metal sheet in the entire range. The inner surface of the bend of the flange ridge portion 251 means a surface on the side on which the flange portion 250 is positioned with respect to the standing wall portion 220.

In the manufacturing method of a press-formed article according to the present embodiment, in a cross section passing through the ridge portion 230 parallel to the bottom sheet portion 210, the radius of curvature inside the bend of the ridge portion 230 may be 30 times or less the sheet thickness of the metal sheet. In addition, in a case where the radius of curvature changes in the ridge portion 230, the radius of curvature may be 30 times or less the sheet thickness of the metal sheet in the entire range. The radius of curvature of the ridge portion 230 is the radius of curvature of the inner surface of the ridge portion 230 viewed from a direction perpendicular to the sheet surface of the bottom sheet portion 210 at the boundary between the standing wall portion 220 or the ridge portion 230 and the standing wall ridge portion 221.

In the manufacturing method of a press-formed article according to the present embodiment, the cross section of the press-formed article 200 parallel to the bottom sheet portion 210, which has the first standing wall portion 220*a*, the second standing wall portion 220*b*, and the ridge portion 230, may be a closed cross section.

In addition, the manufacturing method of a press-formed article according to the present embodiment is a manufacturing method of a press-formed article including a bottom sheet portion, a plurality of standing wall portions connected to the bottom sheet portion and standing from the bottom sheet portion, and a ridge portion connecting the standing wall portions to each other. The manufacturing method of a press-formed article may have a preforming step of press-forming a metal sheet to form a preformed article including a preformed bottom sheet portion corresponding to a bottom sheet portion, a plurality of preformed standing wall portions corresponding to standing wall portions and standing from the preformed bottom sheet portion, and a preformed ridge portion corresponding to a ridge portion and connecting the preformed standing wall portions to each other, and a main forming step of further press-forming the preformed article to form the bottom sheet portion, the standing wall portions, and the ridge portion; in the preforming step, in an end portion region where the preformed standing wall portion stands in the preformed bottom sheet portion, a swollen portion may be formed which is positioned closer to the preformed bottom sheet portion than the preformed standing wall portion as a whole so as to be connected to the preformed standing wall portion, and swells to the side opposite to the side on which the preformed standing wall portion stands so as to be connected to the preformed bottom sheet portion in a cross-sectional view orthogonal to a sheet surface of the preformed bottom sheet portion and passing through the preformed ridge portion; and in the main forming step, the swollen portion may be press-formed so as to be formed to be a part of the bottom sheet portion and the standing wall portion.

Second Embodiment

A press line according to the present embodiment includes a first press portion including a first die (second die and punch), a first punch (first die and punch), and a first holder (third die and punch), and a second press portion including a second die (fourth die and punch) and a second punch (fifth die and punch), a surface of a die hole of the first die has a first die-bottom surface portion, a first die-first side surface portion, a first die-second side surface portion, and a first die-concave ridge portion, the first die-concave ridge portion is provided between the first die-first side surface portion and the first die-second side surface portion, a first die-bottom surface concave portion which is partially recessed more than a center portion of the first die-bottom surface portion is provided at a position adjacent to an end portion of the first die-concave ridge portion in the first die-bottom surface portion, a surface of a die hole of the second die has a second die-bottom surface portion, a second die-first side surface portion, a second die-second side surface portion, and a second die-concave ridge portion, the second die-concave ridge portion is provided between the second die-first side surface portion and the second die-second side surface portion, and when a first die-cross section passing midway between the first die-first side surface portion and the first die-second side surface portion and a second die-cross section passing midway between the second die-first side surface portion and the second die-second side surface portion are overlapped so that the first die-bottom surface portion and the second die-bottom surface portion are overlapped and the first die-concave ridge portion and the second die-concave ridge portion are overlapped, the first die-bottom surface concave portion includes a first part which is provided outside the second die and adjacent to the first die-concave ridge portion and a second part which is provided inside the second die and adjacent to the first part.

Figure 11:
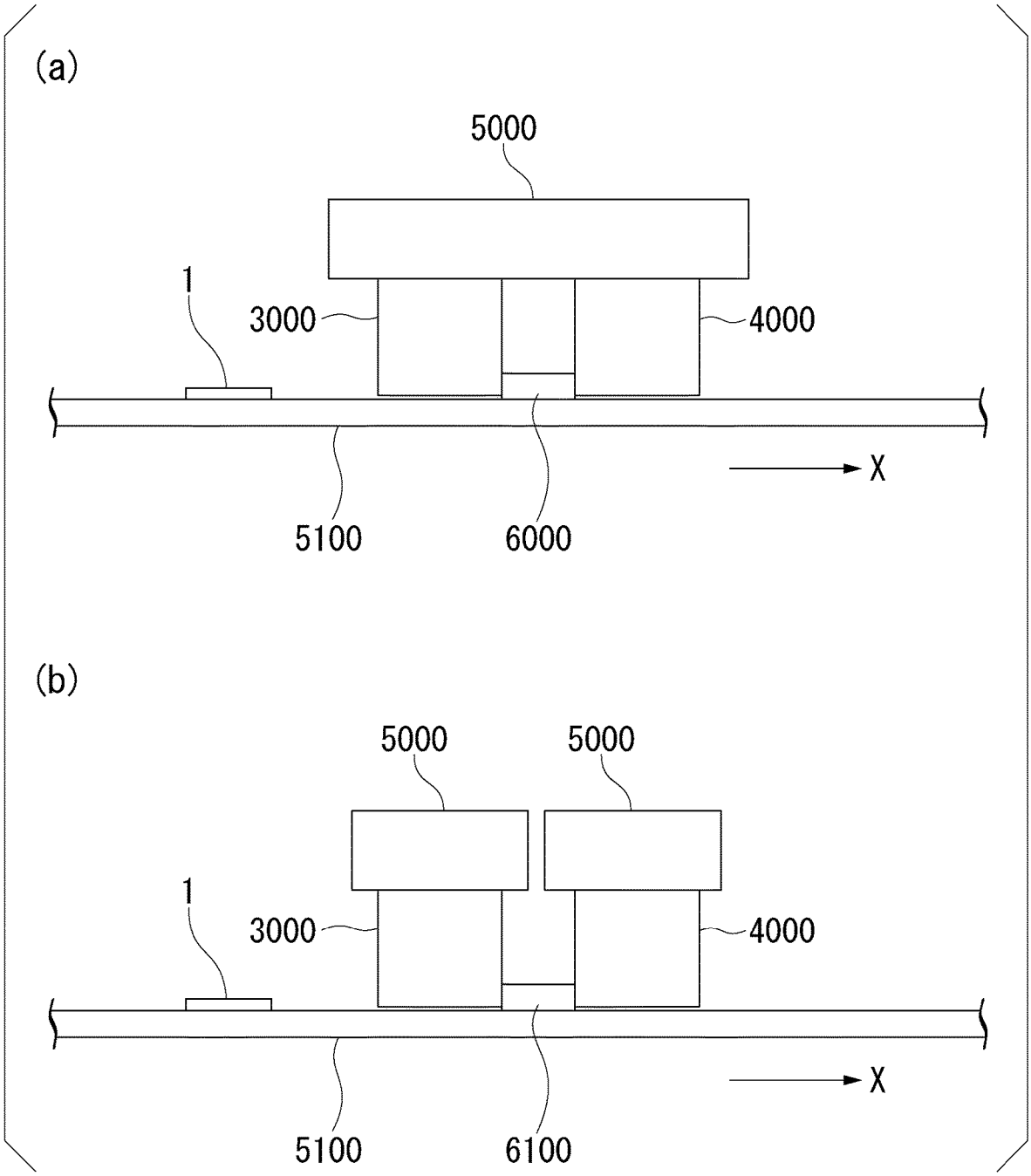
FIG. 11 is a schematic side view showing a press line according to a second embodiment, where (a) is a schematic side view of a transfer press line, and (b) is a schematic side view of a tandem press line.

FIG. 11 shows a side view of the press line according to the present embodiment. (a) shows a transfer press line, and a first press portion 3000 and a second press portion 4000 are set in one press machine 5000. A workpiece 1 is put on a transport conveyor 5100 and transported in a direction (X-direction) from the first press portion 3000 to the second press portion 4000. The workpiece 1 processed by the first press portion 3000 is a preformed article 100. The preformed article 100 is transported to the second press portion 4000 via an automatic transport mechanism 6000. In addition, the workpiece 1 processed by the second press portion 4000 is a press-formed article 200. The press forming in the second press portion 4000 may be draw forming or bending forming. (b) shows a tandem press line, and each press portion (first press portion 3000 and second press portion 4000) is set for one press machine 5000. A workpiece 1 is put on a transport conveyor 5100 and moved in a direction (X-direction) from the first press portion 3000 to the second press portion 4000. The workpiece 1 processed by the first press portion 3000 is a preformed article 100. The preformed article 100 is transported to the second press portion 4000 via a transport device 6100. In addition, the workpiece 1 processed by the second press portion 4000 is a press-formed article 200. The press forming in the second press portion 4000 may be draw forming or bending forming.

Figure 12:
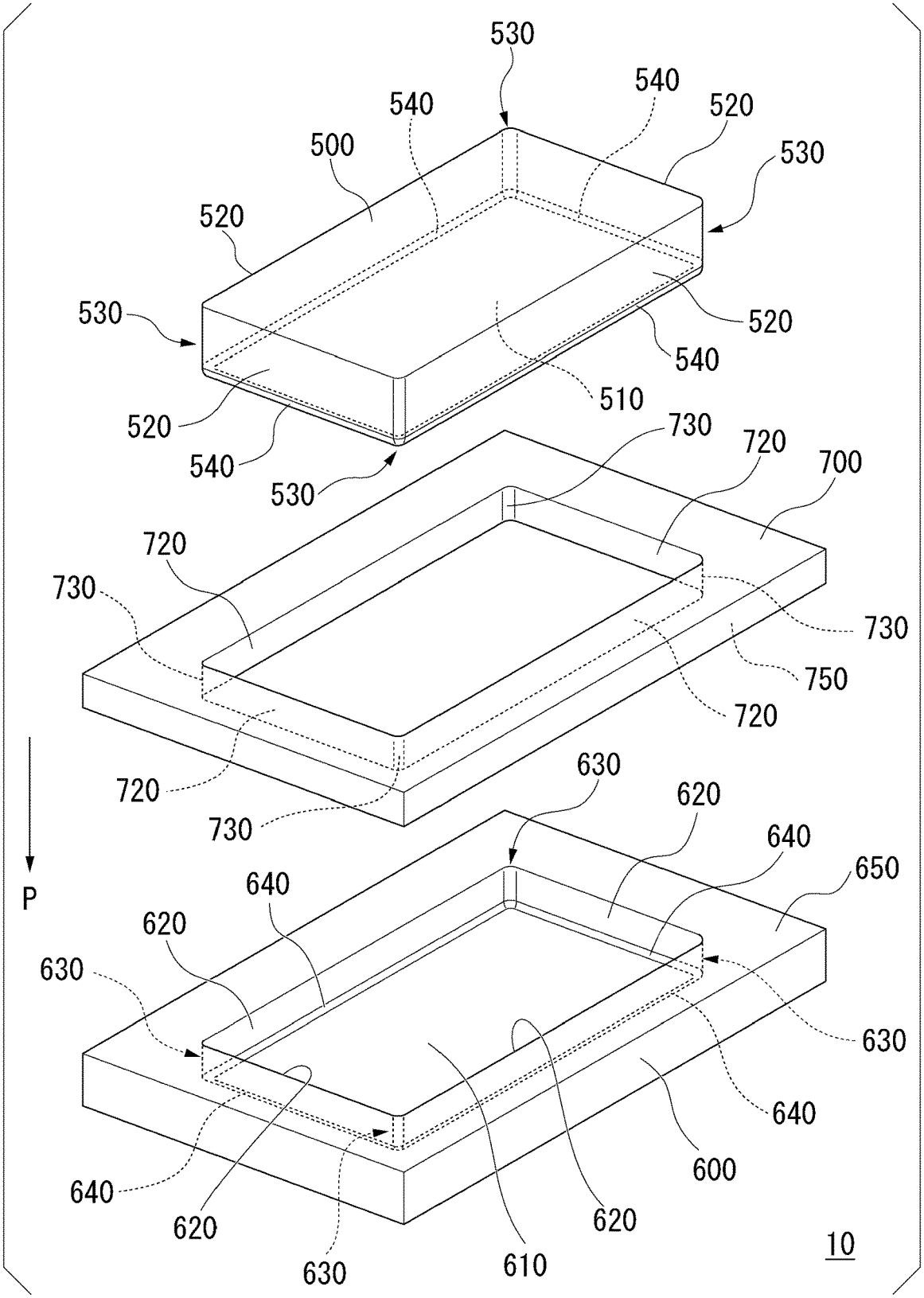
FIG. 12 is a schematic perspective view showing an example of a die and punch for preforming according to the second embodiment.

FIG. 12 shows an example of the first press portion 3000 (die and punch for preforming 10) according to the present embodiment. The first press portion 3000 includes a first punch 500, a first die 600 provided to sandwich the workpiece 1 between the first die 600 and the first punch 500, and a first holder 700 provided to movably sandwich the workpiece 1 in an in-plane direction of the workpiece 1 between the first holder 700 and the first die 600. As shown in FIG. 12, the first punch 500, the first die 600, and the first holder 700 are disposed along a pressing direction P. The first punch 500, the first die 600, and the first holder 700 are each relatively movable in the pressing direction P. In addition, the first punch 500, the first die 600, and the first holder 700 may be relatively movable in directions other than the pressing direction P. In addition, each of the first punch 500, the first die 600, and the first holder 700 may be an integrated body or may be divisible. For example, the first punch 500 may be divided into four division type parts in a direction perpendicular to the pressing direction, each including a first punch-convex ridge portion 530 to be described later. The number of divisions of the first punch 500 is not limited to four. For example, the first punch 500 may be divided into end type parts each including a first punch-convex ridge portion 530 and a center type part including a central region of a first punch-bottom surface portion 510. In addition, a drive portion or a cam mechanism constituted to relatively move the division type parts may be provided. The division type part including the first punch-convex ridge portion 530 may be relatively moved so that the first punch-convex ridge portion 530 is put close toward a first die-concave ridge portion 630 of the first die 600 as the first punch 500 is put close to the first die 600 during the course of press forming. By constituting the die and punch in a division manner, the force required for forming a preformed ridge portion is relaxed. A second punch 900 to be described later may also be constituted in a division manner as in the first punch 500.

(First Punch)

Figure 13:
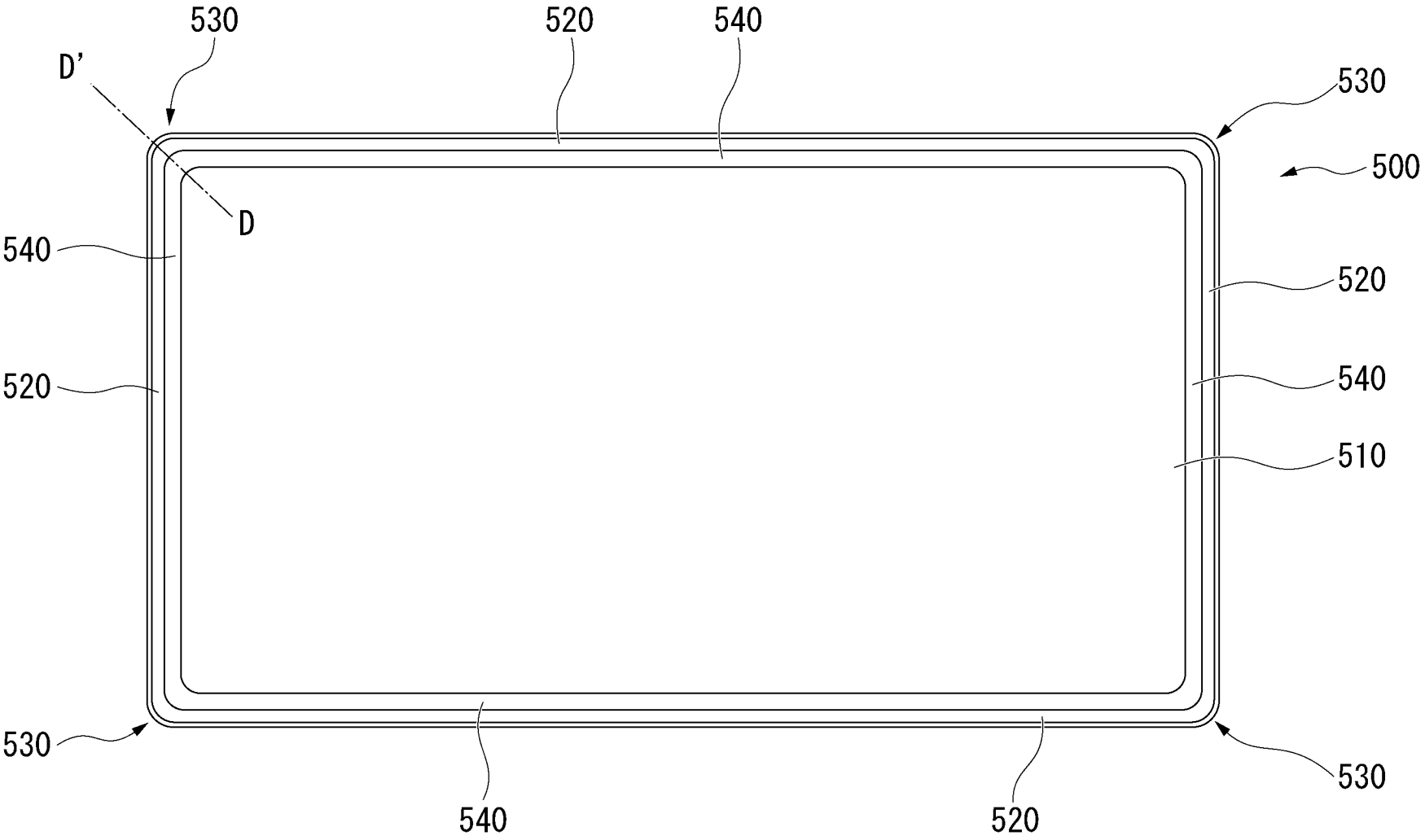
FIG. 13 is a schematic plan view of a first punch (first die and punch) viewed from the bottom surface portion side in a direction perpendicular to a bottom surface portion.
Figure 14:
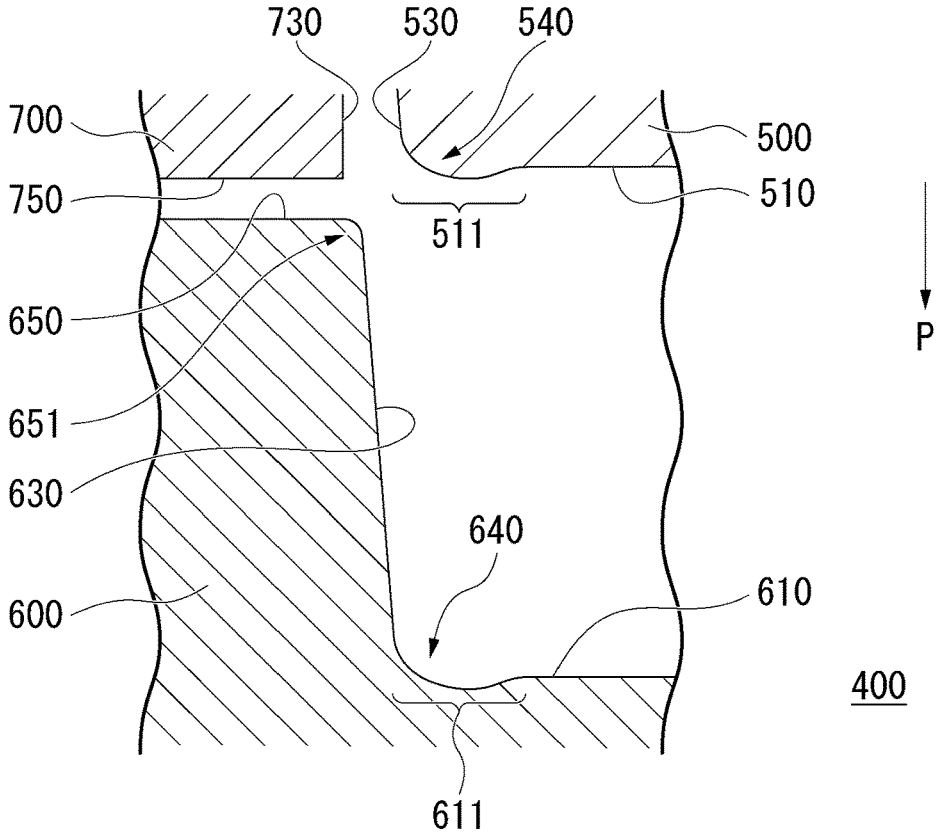
FIG. 14 is a schematic cross-sectional view of the die and punch for preforming in a cross-sectional view in a plane passing through the position of the line D-D' in FIG. 13.

FIG. 13 shows a schematic plan view of the first punch 500 viewed from a first punch-bottom surface portion 510 in a direction perpendicular to the first punch-bottom surface portion 510. In the example of FIG. 13, a surface of a die hole of the first punch 500 has a substantially rectangular first punch-bottom surface portion 510. FIG. 14 shows a schematic cross-sectional view of the first punch 500, the first die 600, and the first holder 700 in a cross-sectional view in a plane orthogonal to a sheet surface of the first punch-bottom surface portion 510 at the position of the line D-D' in FIG. 13. The plane passing through the position of the line D-D' in FIG. 13 may be a plane which is orthogonal to the sheet surface of the first punch-bottom surface portion 510 in the first punch 500 and forms an equal angle with a sheet surface of each of first punch-side surface portions 520 connected via the first punch-convex ridge portion 530.

The surface of the die hole of the first punch 500 includes the first punch-bottom surface portion 510, a plurality of the first punch-side surface portions (first punch-first side surface portion and first punch-second side surface portion) 520 connected to the first punch-bottom surface portion 510 and standing from the first punch-bottom surface portion 510, and the first punch-convex ridge portion 530 connecting the first punch-side surface portions 520 to each other. That is, the first punch-convex ridge portion 530 is provided between the first punch-first side surface portion and the first punch-second side surface portion. An end portion region 511 where the first punch-side surface portion 520 and the first punch-convex ridge portion 530 stand in the first punch-bottom surface portion 510 has a first punch-bottom surface convex portion 540 which is positioned closer to the first punch-bottom surface portion 510 than the first punch-side surface portion 520 as a whole so as to be connected to the first punch-side surface portion 520, and swells to the side opposite to the side on which the first punch-side surface portion 520 stands so as to be connected to the first punch-bottom surface portion 510 in a cross-sectional view orthogonal to the pressing surface of the first punch-bottom surface portion 510 and passing through the first punch-convex ridge portion 530. That is, the first punch-bottom surface convex portion 540 partially projecting from a center portion of the first punch-bottom surface portion 510 is present at a position adjacent to an end portion of the first punch-convex ridge portion 530 in the first punch-bottom surface portion 510. The end portion region 511 is a partial region of the first punch-bottom surface portion 510, and is a region near an edge portion to which the first punch-side surface portion 520 and the first punch-convex ridge portion 530 are connected. The first punch-convex ridge portion 530 is a part of the first punch-side surface portion 520, and in the present embodiment, the first punch-side surface portion 520 can be replaced with the first punch-convex ridge portion 530. In addition, the die hole may be a hole of not only a closed cross section where the first punch-side surface portion 520 is the closed cross section in a cross section of the first punch 500 parallel to the first punch-bottom surface portion 510, but also an open cross section where the first punch-side surface portion 520 is the open cross section in a cross section of the first punch 500 parallel to the first punch-bottom surface portion 510.

The first punch-bottom surface convex portion 540 is connected to the first punch-bottom surface portion 510, the first punch-side surface portion 520, and the first punch-convex ridge portion 530. The first punch-bottom surface convex portion 540 is positioned closer to the first punch-bottom surface portion 510 than the first punch-side surface portion 520 or the first punch-convex ridge portion 530 as a whole. Specifically, the entire range of the first punch-bottom surface convex portion 540 is positioned closer to the first punch-bottom surface portion 510 than an imaginary line extending from the first punch-side surface portion 520 or the first punch-convex ridge portion 530 in the above-described cross-sectional view. The first punch-bottom surface convex portion 540 swells to the side opposite to the side on which the first punch-side surface portion 520 stands with respect to the sheet surface of the first punch-bottom surface portion 510. The surface of the first punch-bottom surface convex portion 540 is preferably smoothly connected to the preformed bottom sheet portion 110, the first punch-side surface portion 520, and the first punch-convex ridge portion 530. The first punch-bottom surface convex portion 540 preferably has a curve in the above-described cross-sectional view.

(First Die)

The first die 600 has an outer surface shape corresponding to an outer surface shape of the pressing surface of the first punch 500. The pressing surface of the first punch 500 has an outer surface shape corresponding to outer surface shapes of a part of the first punch-bottom surface portion 510, the first punch-side surface portion 520, and the first punch-convex ridge portion 530, and the first punch-bottom surface convex portion 540. That is, the first die 600 includes a plurality of first die-side surface portions 620 connected to a first die-bottom surface portion 610 and standing from the first die-bottom surface portion 610, and a first die-concave ridge portion 630 connecting the first die-side surface portions 620 to each other. In addition, an end portion region 611 where the first die-side surface portion 620 stands in the first die-bottom surface portion 610 has a first die-bottom surface concave portion 640 which is positioned closer to the first die-bottom surface portion 610 than the first die-side surface portion 620 as a whole so as to be connected to the first die-side surface portion 620, and has a shape dented to the side opposite to the side on which the first die-side surface portion 620 stands so as to be connected to the first die-bottom surface portion 610 in a cross-sectional view orthogonal to the pressing surface of the first die-bottom surface portion 610 and passing through the first die-concave ridge portion 630. The end portion region 611 is a partial region of the first die-bottom surface portion 610, and is a region near an edge portion to which the first die-side surface portion 620 and the first die-concave ridge portion 630 are connected. The outer surface shape of the first die-bottom surface concave portion 640 corresponds to the first punch-bottom surface convex portion 540, and is connected to the first die-bottom surface portion 610, the first die-side surface portion 620, and the first die-concave ridge portion 630. The first die-bottom surface concave portion 640 is positioned closer to the first die-bottom surface portion 610 than the first die-side surface portion 620 or the first die-concave ridge portion 630. Specifically, the entire range of the first die-bottom surface concave portion 640 is positioned closer to the first die-bottom surface portion 610 than an imaginary line extending from the first die-side surface portion 620 or the first die-concave ridge portion 630 in the above-described cross-sectional view. The surface of the first die-bottom surface concave portion 640 is preferably smoothly connected to the first die-bottom surface portion 610, the first die-side surface portion 620, and the first die-concave ridge portion 630. The first die-bottom surface concave portion 640 preferably has a curve in the above-described cross-sectional view. The first die 600 further includes a support surface 650, and the first die-side surface portion 620 and the first die-concave ridge portion 630 are connected to the support surface 650 via a support surface ridge portion 651 at an end portion on the side opposite to the end portion connected to the first die-bottom surface concave portion 640. The first die-concave ridge portion 630 is a part of the first die-side surface portion 620, and in the present embodiment, the first die-side surface portion 620 can be replaced with the first die-concave ridge portion 630.

(First Holder)

The first holder 700 includes first holder-side surface portions 720, a first holder-concave ridge portion 730 connecting the first holder-side surface portions 720 to each other, and a support surface 750 substantially perpendicular to the first holder-side surface portion 720, and is provided to movably sandwich a workpiece 1 in an in-plane direction of the workpiece 1 between the first holder 700 and the support surface 650 of the first die 600. As shown in FIG. 14, the support surface 750 of the first holder 700 is disposed at a position opposed to the support surface 650 of the first die 600. In addition, as shown in FIG. 12, the first punch 500 can relatively move a region surrounded by the first holder-side surface portions 720 and the first holder-concave ridge portion 730 of the first holder 700 with respect to the first holder 700.

Figure 15:
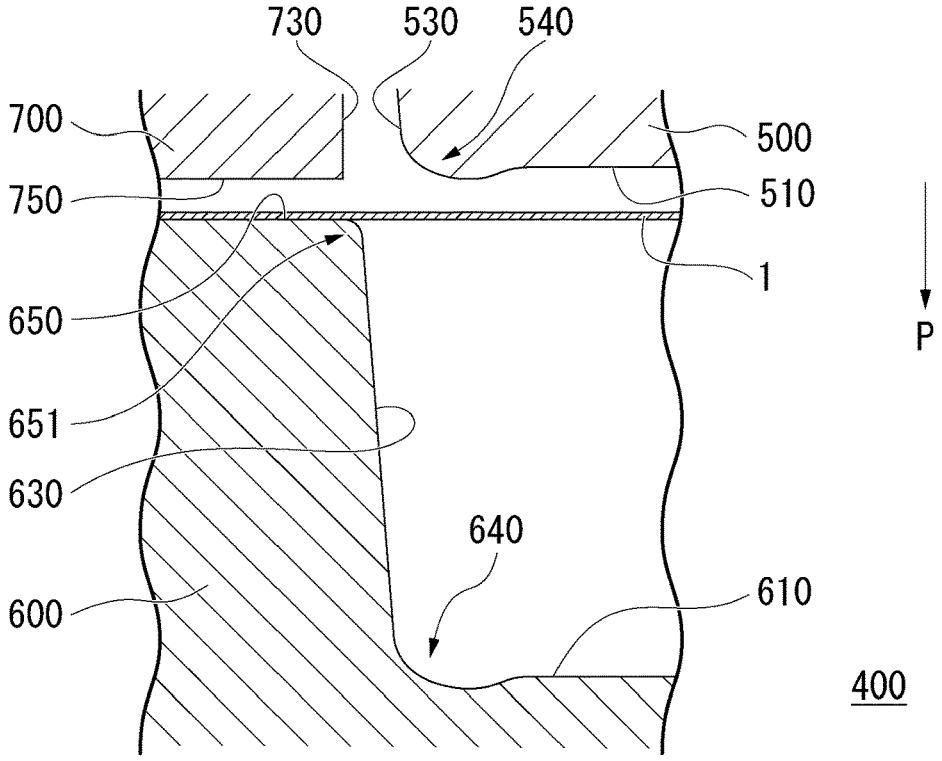
FIG. 15 is a view showing a state in which a workpiece is disposed in the die and punch for preforming, and is a schematic cross-sectional view of the die and punch for preforming and the workpiece in a cross-sectional view in a plane passing through the position of the line D-D' in FIG. 13.

Next, the movement of the first press portion 3000 will be described by taking as an example a case where the workpiece is press-formed to form the preformed article 100 described in the first embodiment. FIG. 15 is a cross-sectional view in the same plane as FIG. 14. First, as shown in FIG. 15, the workpiece (metal sheet) 1 is placed on the support surface 650 of the first die 600 in a state in which the first punch 500 is on the side of the first holder 700.

Figure 16:
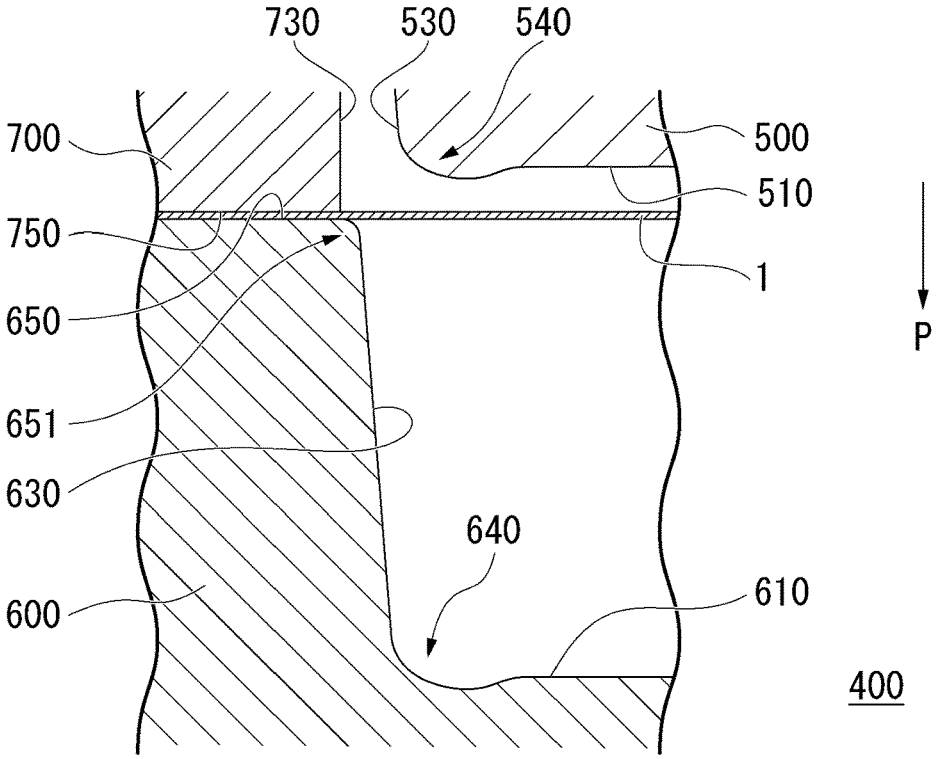
FIG. 16 is a view showing a state in which the workpiece is sandwiched between a first die (second die and punch) and a first holder (third die and punch), and is a schematic cross-sectional view of the die and punch for preforming and the workpiece in a cross-sectional view in a plane passing through the position of the line D-D' in FIG. 13.
Figure 17:
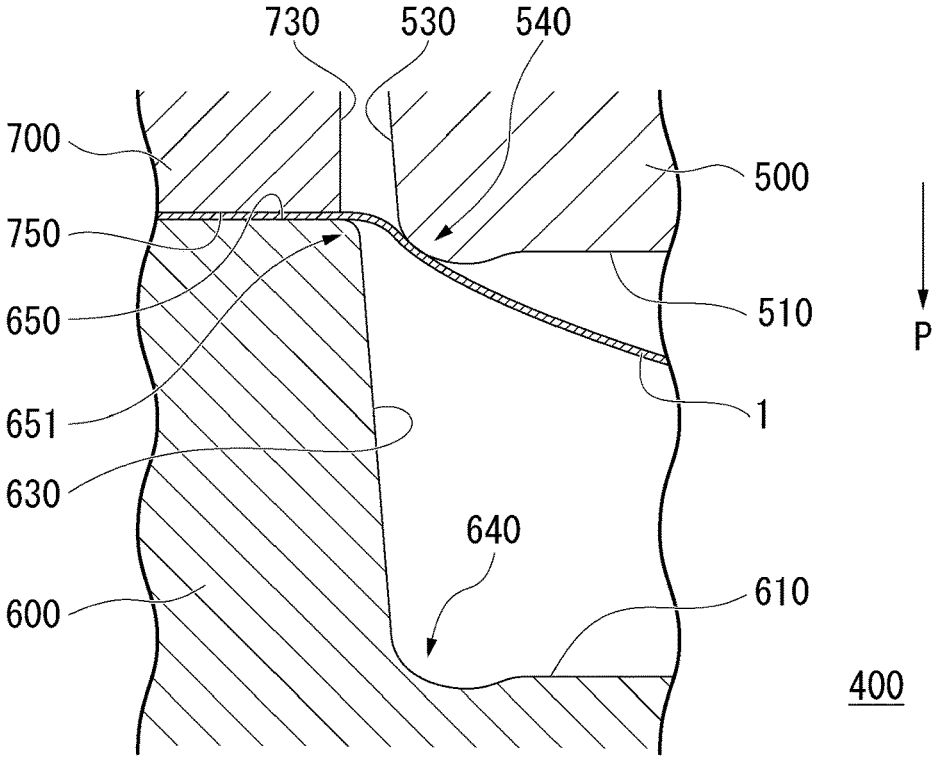
FIG. 17 is a view showing a state in which the first punch (first die and punch) is relatively moved with respect to the first die (second die and punch), and is a schematic cross-sectional view of the die and punch for preforming and the workpiece in a cross-sectional view in a plane passing through the position of the line D-D' in FIG. 13.

Next, as shown in FIG. 16, the first holder 700 is relatively moved with respect to the first die 600, and the workpiece 1 is sandwiched between the support surface 650 of the first die 600 and the support surface 750 of the first holder 700. Then, as shown in FIG. 17, the first punch 500 is relatively moved so as to be put close to the first die 600, and the workpiece 1 is thus deformed. The workpiece 1 is sandwiched between the support surface 650 of the first die 600 and the support surface 750 of the first holder 700 by a force that allows the workpiece 1 to be moved in an in-plane direction of the workpiece 1. Therefore, with the relative movement of the first punch 500 and the first die 600, the workpiece 1 receives a deforming force, and the material constituting the workpiece 1 moves from the range sandwiched between the support surface 650 of the first die 600 and the support surface 750 of the first holder 700 toward the first die-side surface portion 620 and the first die-concave ridge portion 630 of the first die 600.

Figure 18:
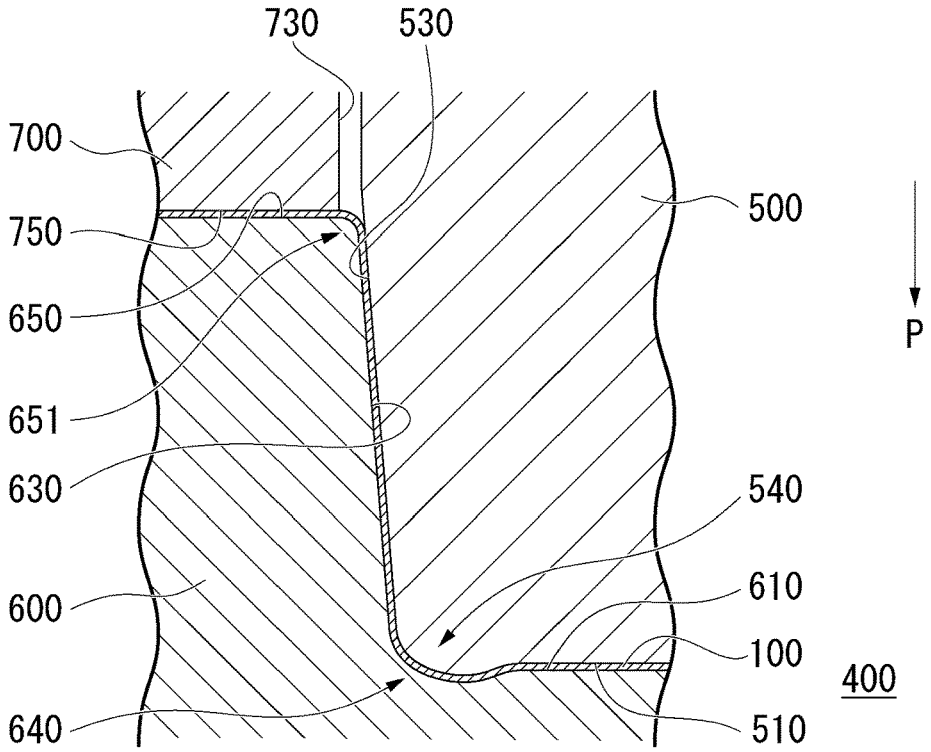
FIG. 18 is a view showing a state in which the first punch (first die and punch) reaches the bottom dead point, and is a schematic cross-sectional view of the die and punch for preforming and the preformed article in a cross-sectional view in a plane passing through the position of the line D-D' in FIG. 13.
Figure 19:
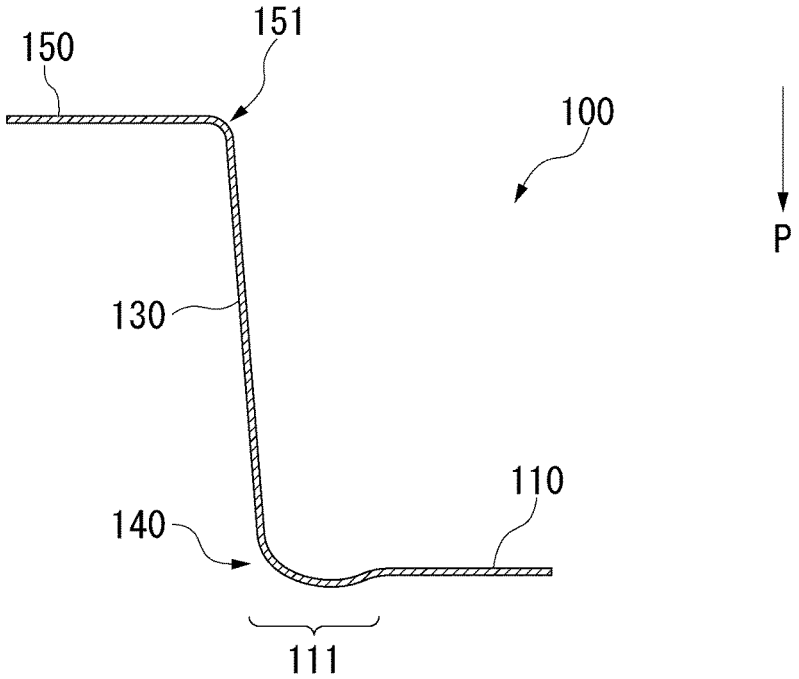
FIG. 19 is a schematic cross-sectional view of a preformed article formed by the die and punch for preforming.

FIG. 18 shows a schematic cross-sectional view of a state in which the first punch 500 reaches the bottom dead point. In a case where the first punch 500 reaches the bottom dead point, the preformed article 100 is formed. FIG. 19 shows a schematic cross-sectional view of the preformed article 100 formed by the above-described first press portion 3000. In the preformed article 100 of FIG. 19, the preformed bottom sheet portion 110, the preformed standing wall portion (not shown), the preformed ridge portion 130, the swollen portion 140, and the flange portion 150 are formed. The above steps correspond to the preforming step (S1) described in the first embodiment.

As described above, in the die and punch according to the present embodiment, the preformed article 100 described in the first embodiment can be formed. Next, a step of further press-forming the preformed article 100 thus obtained to obtain a press-formed article will be described. Subsequent steps correspond to the main forming step (S2) described in the first embodiment. In the subsequent steps, an example in which the preformed article 100 is press-formed using the second press portion 4000 including the second die and the second punch will be described.

Figure 20:
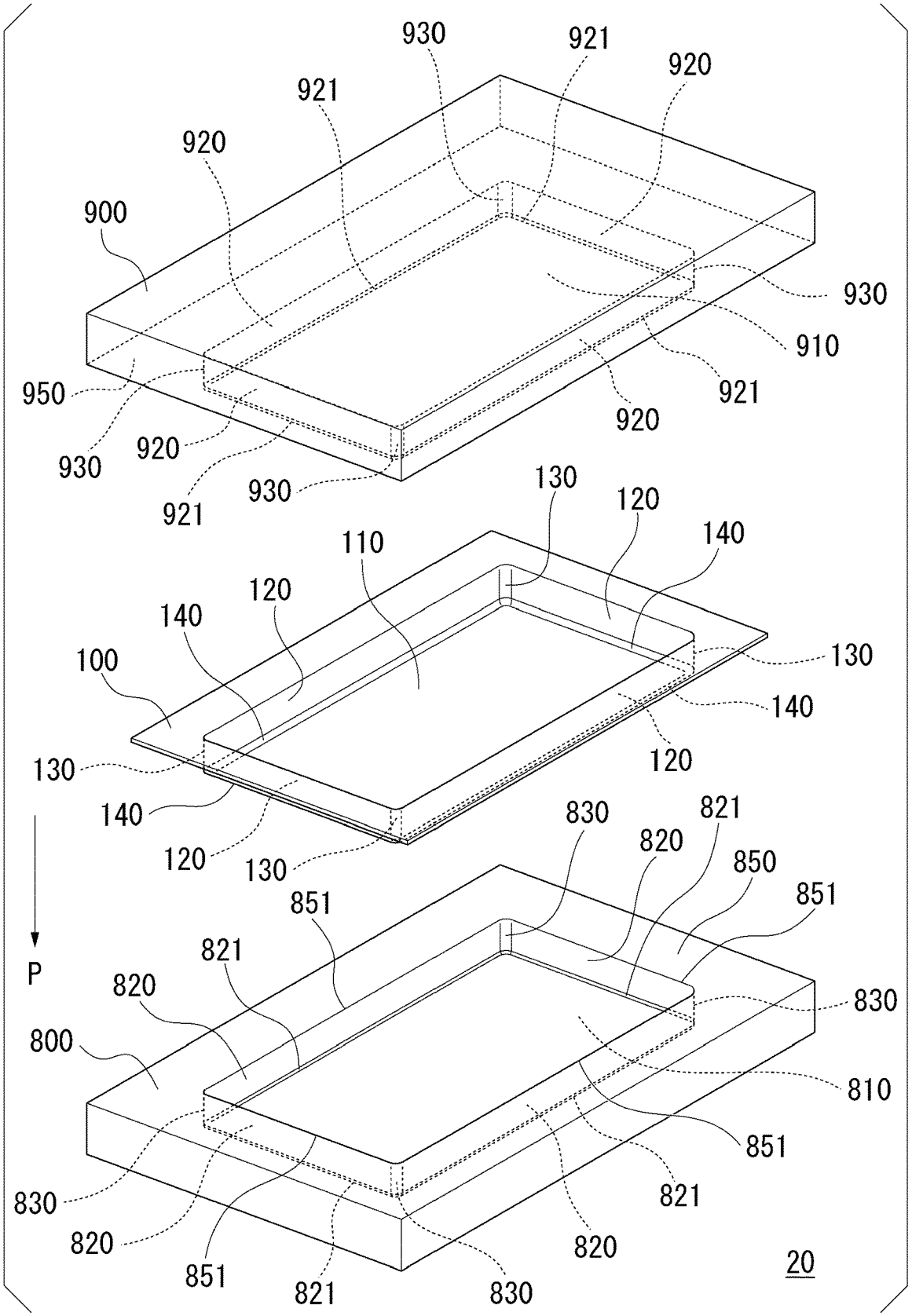
FIG. 20 is a schematic perspective view showing an example of a die and punch for main forming according to the second embodiment.

FIG. 20 shows an example of the second press portion 4000 (die and punch for main forming 20) according to the present embodiment. The second press portion 4000 includes a second die 800 and a second punch 900 provided to sandwich the preformed article 100 between the second punch 900 and the second die 800. As shown in FIG. 20, the second die 800 and the second punch 900 are disposed along the pressing direction P. The second die 800 and the second punch 900 are each relatively movable in the pressing direction P. In addition, the second die 800 and the second punch 900 may be relatively movable in directions other than the pressing direction P. In addition, each of the second die 800 and the second punch 900 may be an integrated body or may be divisible. As shown in FIG. 20, the preformed article 100 is disposed so that the preformed bottom sheet portion 110 faces a second die-bottom surface portion 810 of the second die 800.

(Second Die)

Figure 21:
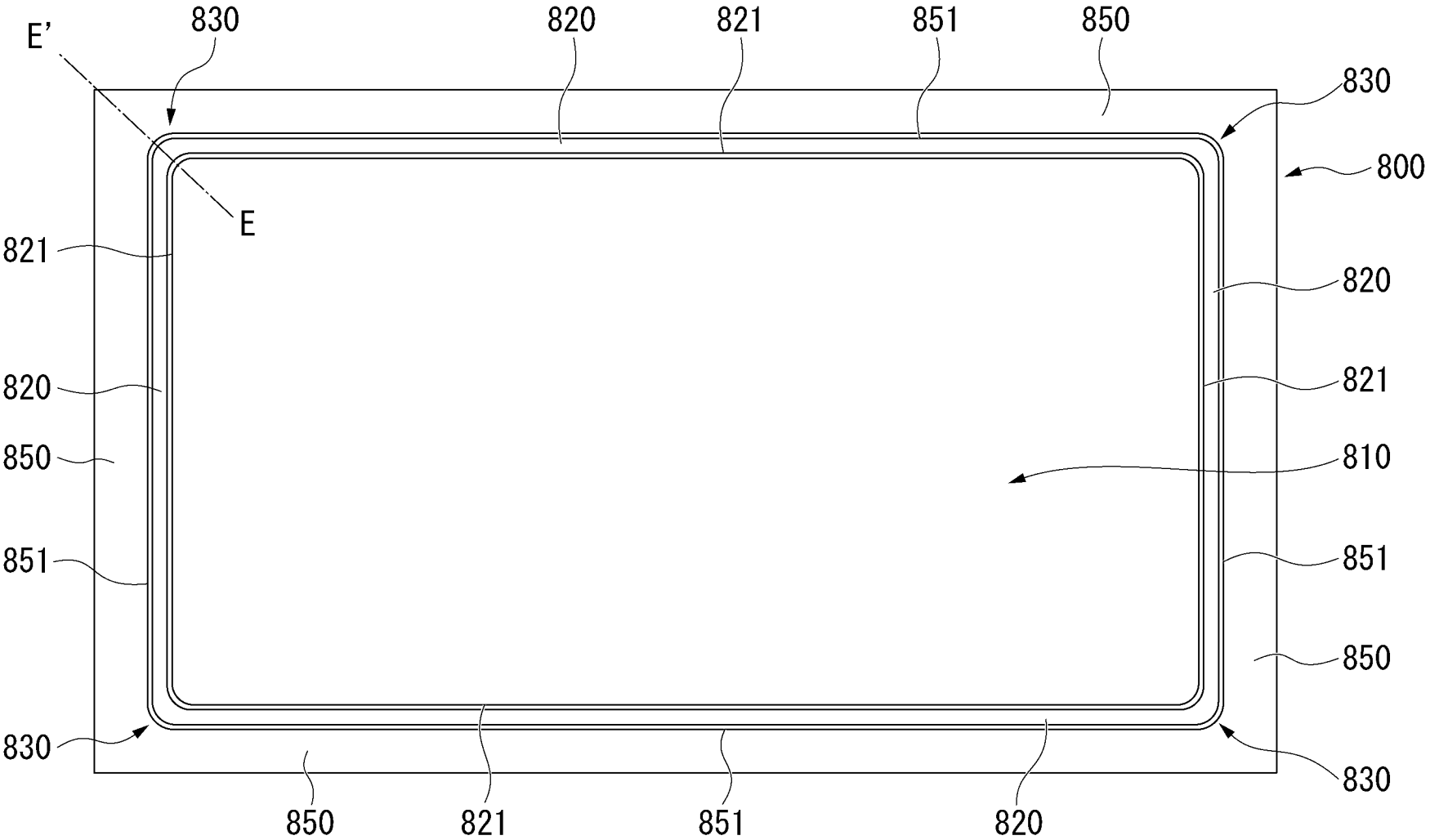
FIG. 21 is a schematic plan view of a second die (fourth die and punch) viewed from the bottom surface portion side in a direction perpendicular to a bottom surface portion.

FIG. 21 shows a schematic plan view of the second die 800 viewed from the surface side on which the preformed article 100 is placed in a direction perpendicular to the second die-bottom surface portion 810. In the example of FIG. 21, the second die 800 includes a substantially rectangular second die-bottom surface portion 810 on the surface of a die hole. The second die 800 includes the second die-bottom surface portion 810, a plurality of second die-side surface portions (second die-first side surface portion and second die-second side surface portion) 820 connected to the second die-bottom surface portion 810 and standing from the second die-bottom surface portion 810, and a second die-concave ridge portion 830 connecting the second die-side surface portions 820 to each other. As for the shape of the pressing surface of the second die 800, in a case where the preformed article 100 is placed in the second die 800, it is preferable that a part of the preformed standing wall portion 120 of the preformed article 100 is in contact with or put close to a part of the second die-side surface portion 820, and a part of the preformed ridge portion 130 is in contact with or put close to a part of the second die-concave ridge portion 830. In addition, the die hole may be a hole of not only a closed cross section where the second die-side surface portion 820 is the closed cross section in a cross section of the second die 800 parallel to the second die-bottom surface portion 810, but also an open cross section where the second die-side surface portion 820 is the open cross section in a cross section of the second die 800 parallel to the second die-bottom surface portion 810.

Figure 22:
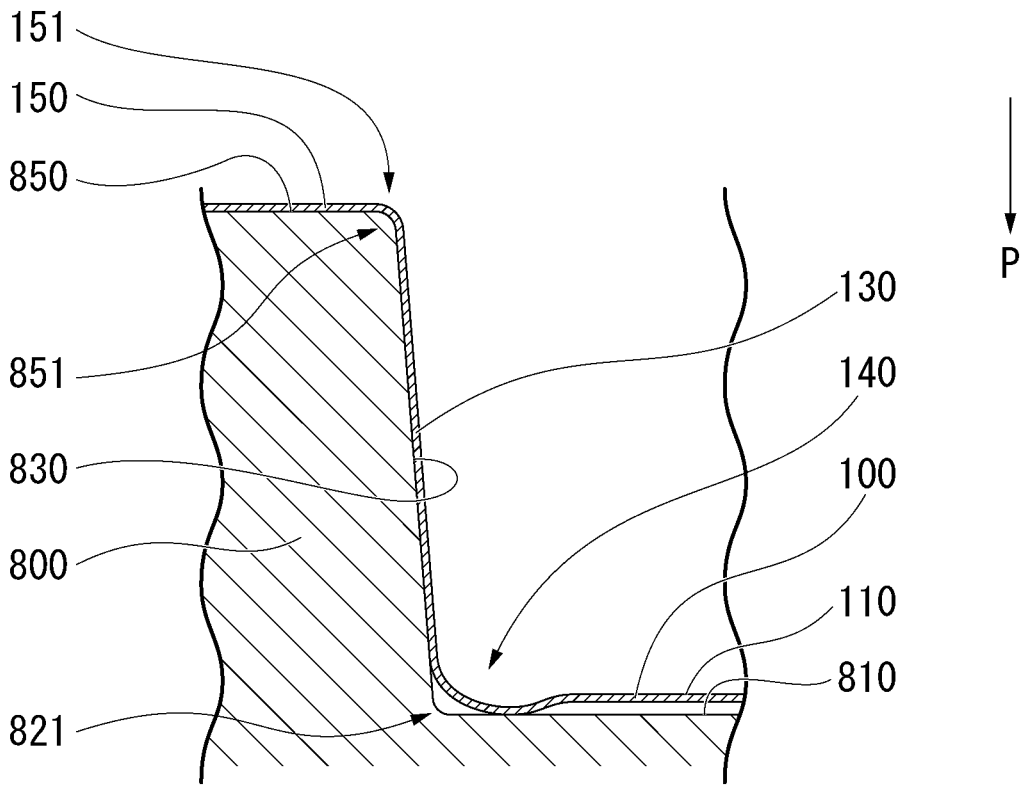
FIG. 22 is a view showing a state in which the preformed article is disposed in the second die (in the fourth die and punch), and is a schematic cross-sectional view of the second die (fourth die and punch) and the preformed article in a cross-sectional view in a plane passing through the position of the line E-E' in FIG. 21.

FIG. 22 shows a schematic cross-sectional view of the second die 800 and the preformed article 100 placed in the second die 800 in a cross-sectional view in a plane orthogonal to a sheet surface of the second die-bottom surface portion 810 at the position of the line E-E' in FIG. 21. The plane passing through the position of the line E-E' in FIG. 21 may be a plane which is orthogonal to the sheet surface of the second die-bottom surface portion 810 in the second die 800 and forms an equal angle with a sheet surface of each of the second die-side surface portions 820 connected via the second die-concave ridge portion 830. The second die-bottom surface portion 810 is connected to the second die-side surface portion 820 and the second die-concave ridge portion 830 by a side surface ridge portion 821. That is, the second die-concave ridge portion 830 exists between the second die-first side surface portion and the second die-second side surface portion. In addition, the second die 800 includes a support surface 850, and the second die-side surface portion 820 and the second die-concave ridge portion 830 are connected to the support surface 850 via a support surface ridge portion 851 at an end portion on the side opposite to the end portion connected to the second die-bottom surface portion 810. In the example of FIG. 22, a part of the swollen portion 140 of the preformed article 100 is in contact with the pressing surface of the second die-bottom surface portion 810 of the second die 800, the preformed ridge portion 130 is in contact with the second die-concave ridge portion 830 of the second die 800, and the flange portion 150 and the flange ridge portion 151 are in contact with the support surface 850 and the support surface ridge portion 851 of the second die 800. The second die-concave ridge portion 830 is a part of the second die-side surface portion 820, and in the present embodiment, the second die-side surface portion 820 can be replaced with the second die-concave ridge portion 830.

(Second Punch)

Figure 23:
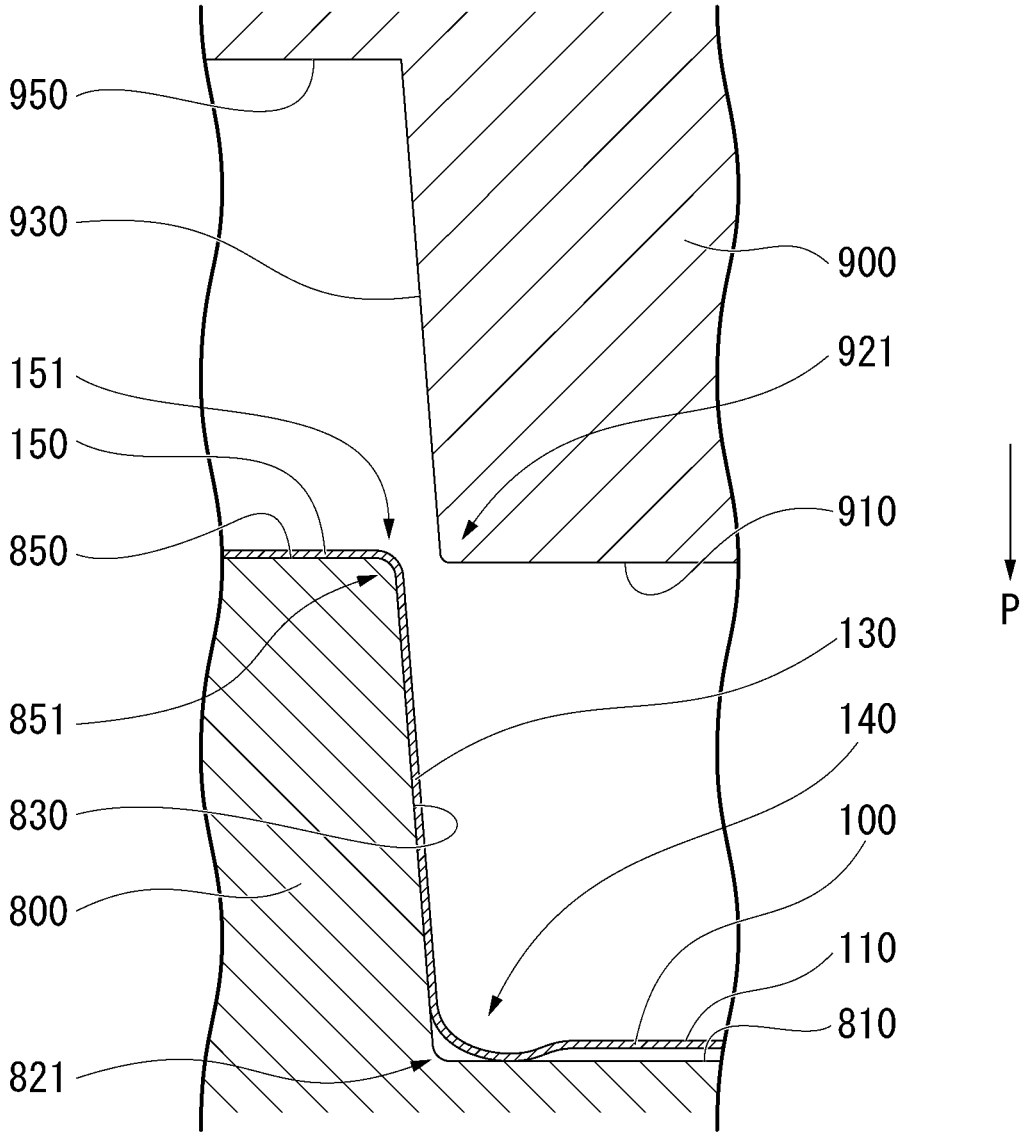
FIG. 23 is a schematic cross-sectional view of the die and punch for main forming and the preformed article in a cross-sectional view in a plane passing through the position of the line E-E' in FIG. 21.

FIG. 23 shows a schematic cross-sectional view of a state in which the second punch 900 is put close to the second die 800 at the position of the line E-E' in FIG. 21. The second punch 900 has an outer surface shape corresponding to an outer surface shape of the pressing surface of the second die 800. The pressing surface of the second punch 900 has an outer surface shape corresponding to a part of the second die-bottom surface portion 810, the second die-side surface portion 820, and the second die-concave ridge portion 830, and the side surface ridge portion 821. That is, the second punch 900 includes a plurality of second punch-side surface portions (second punch-first side surface portion and second punch-second side surface portion) 920 connected to a second punch-bottom surface portion 910 and standing from the second punch-bottom surface portion 910, and a second punch-concave ridge portion 930 connecting the second punch-side surface portions 920 to each other. The second punch-bottom surface portion 910 is connected to the second punch-side surface portion 920 and the second punch-concave ridge portion 930 by a side surface ridge portion 921. In addition, the second punch 900 includes a support surface 950, and the second punch-side surface portions 920 and the second punch-concave ridge portion 930 are connected to the support surface 950 at an end portion on the side opposite to the end portion connected to the second punch-bottom surface portion 910. The second punch-concave ridge portion 930 is a part of the second punch-side surface portion 920, and in the present embodiment, the second punch-side surface portion 920 can be replaced with the second punch-concave ridge portion 930.

Figure 24:
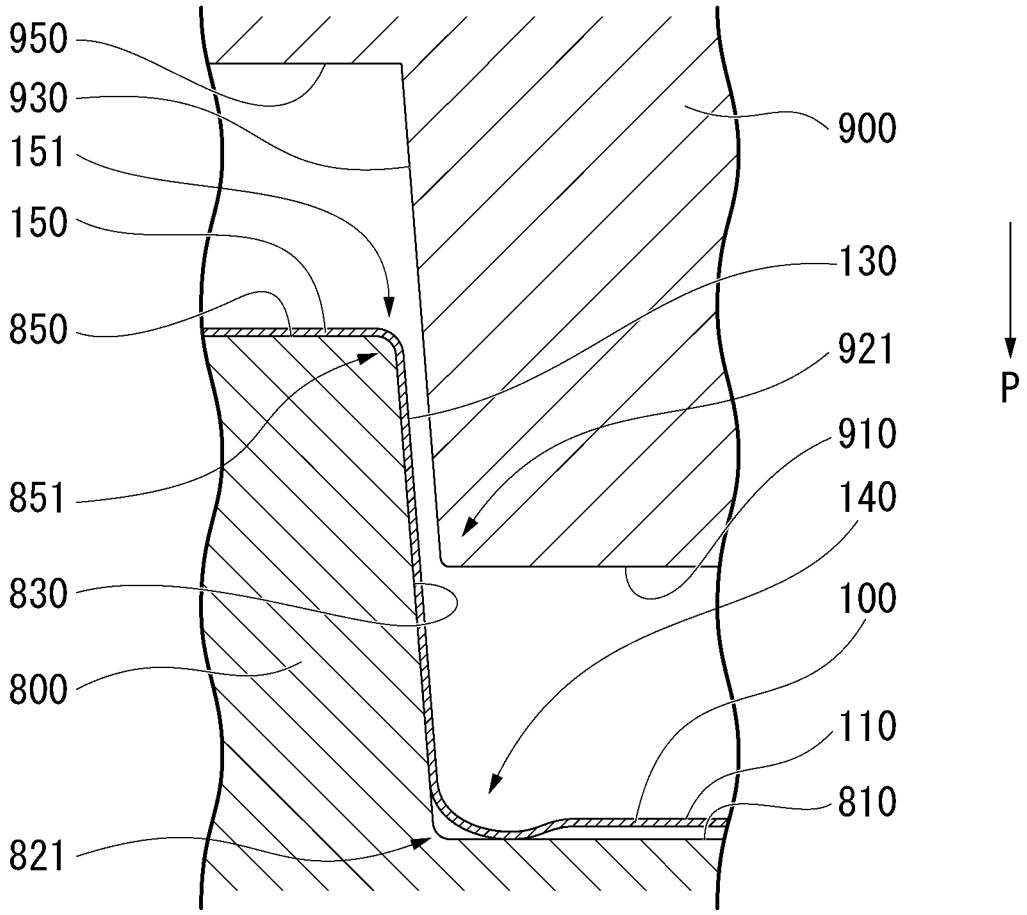
FIG. 24 is a schematic cross-sectional view showing a state in which a second punch (fifth die and punch) is relatively moved with respect to the second die (fourth die and punch) from the state of FIG. 23.
Figure 25:
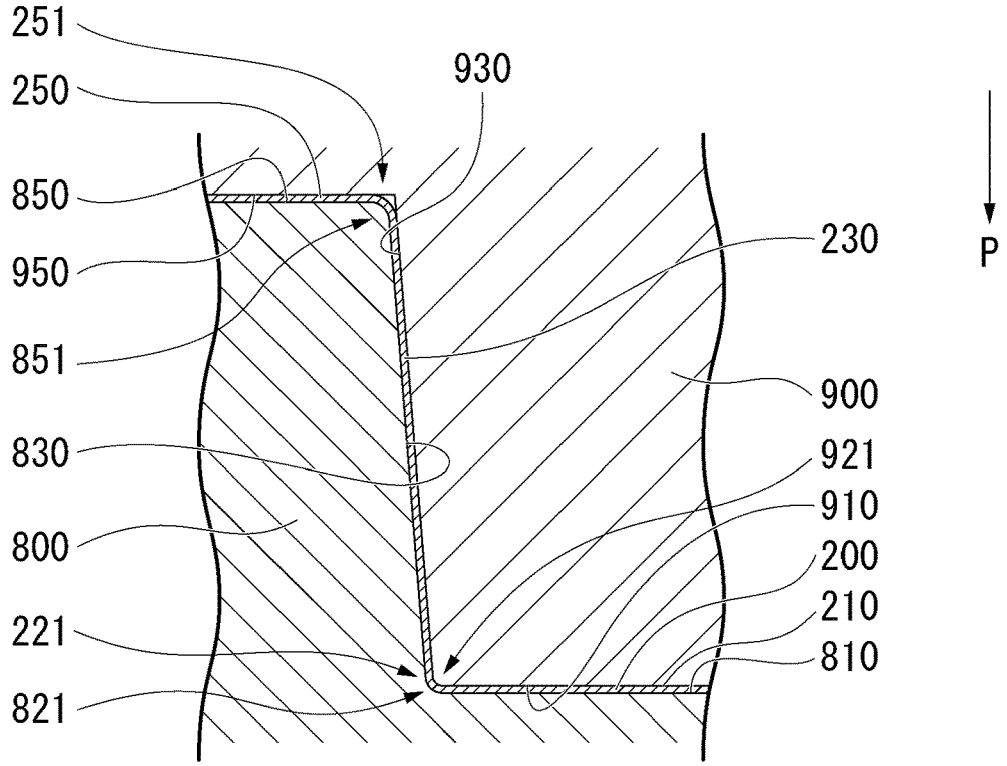
FIG. 25 is a schematic cross-sectional view showing a state in which the second punch (fifth die and punch) reaches the bottom dead point from the state of FIG. 24.
Figure 26:
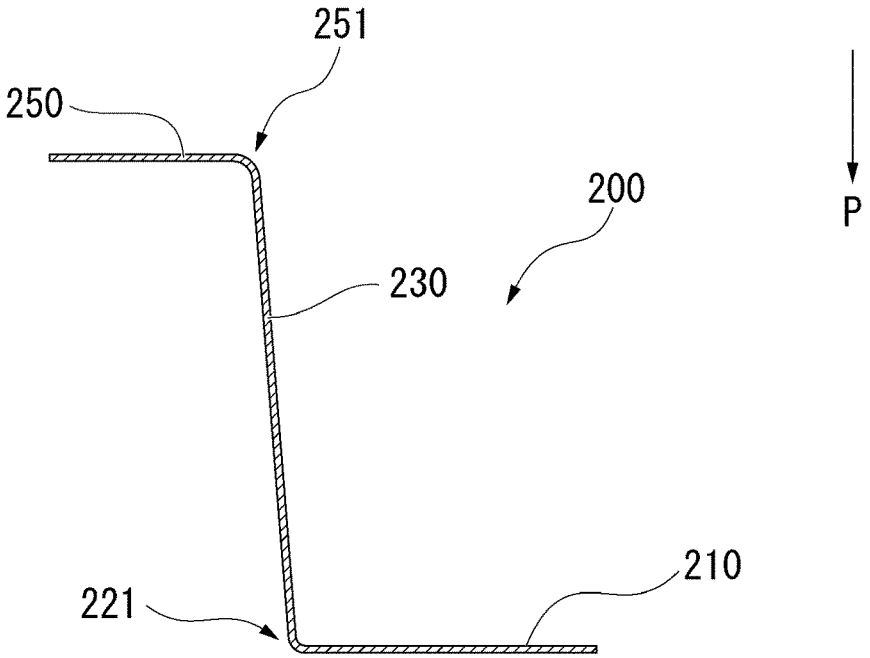
FIG. 26 is a schematic cross-sectional view of a press-formed article formed by the die and punch for main forming.

FIG. 24 shows a schematic cross-sectional view of a state in which the second punch 900 is relatively moved with respect to the second die 800. FIG. 25 shows a schematic cross-sectional view of a state in which the second punch 900 reaches the bottom dead point. In a case where the second punch 900 reaches the bottom dead point, the swollen portion 140 of the preformed article 100 is press-formed and formed as a part of the standing wall portion 220, the bottom sheet portion 210, and the ridge portion 230 of the press-formed article 200. FIG. 26 shows an example of the press-formed article 200. In the press-formed article 200 of FIG. 26, the bottom sheet portion 210, the standing wall portion (not shown), the ridge portion 230, the standing wall ridge portion 221, the flange portion 250, and the flange ridge portion 251 are formed.

Figure 27:
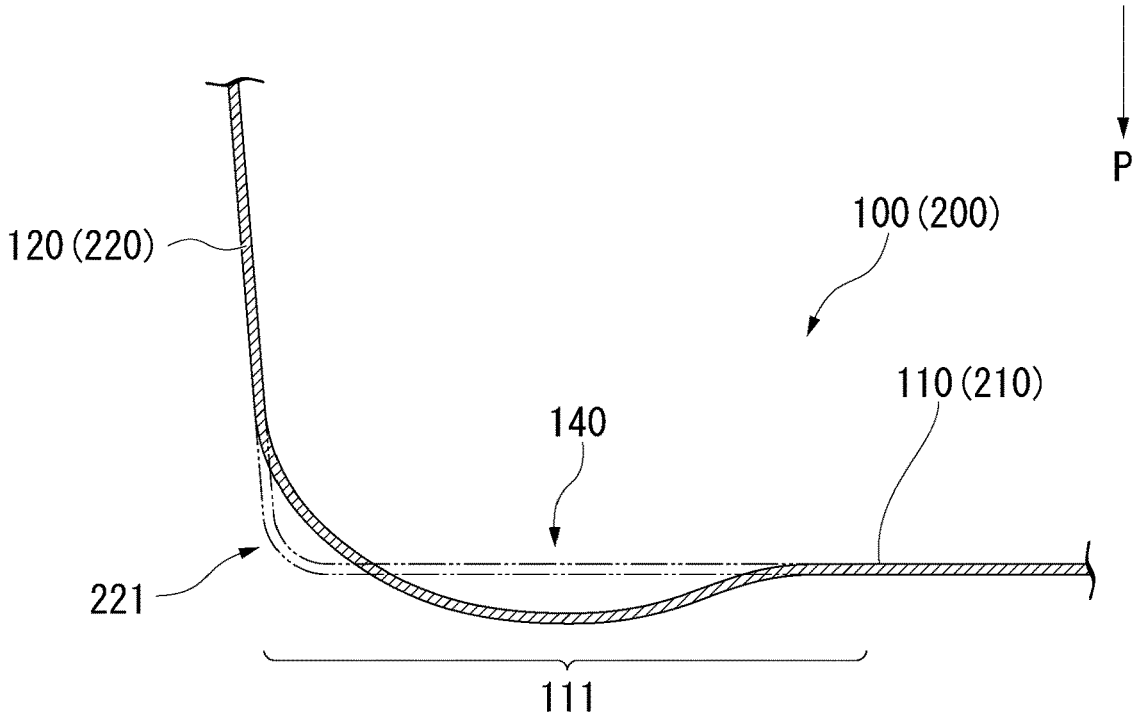
FIG. 27 is a schematic cross-sectional view in which the preformed article and the press-formed article are overlapped in the same cross section.

Specifically, as shown in FIG. 27, the swollen portion 140 of the preformed article 100 formed by the first punch 500 and the first die 600 is press-formed by the second die 800 and the second punch 900 so as to be a part of the bottom sheet portion 210, the standing wall portion 220, and the ridge portion 230 of the press-formed article 200, and a part of the standing wall ridge portion 221 (the cross section of the press-formed article 200 is represented by the chain double-dashed line). In the manufacturing of a product having a shape in which a ridge portion has a small radius of curvature, a method in which in the first step, forming is performed so that the radius of curvature of the portion is large, and in the second step, restriking is performed to reduce the radius of curvature has been attempted as a countermeasure against cracks in the draw forming according to the related art. However, in the manufacturing of a product having a shape which requires stricter forming conditions and in which a ridge portion has a smaller radius of curvature, there is a problem that cracks occur due to partial lack of material in the second restriking. Regarding this, in a case where the die and punch according to the present embodiment is used, it is possible to form a preformed article while suppressing cracks. In addition, it is possible to earn the necessary material for the main forming step. Therefore, cracks or wrinkles can be suppressed in the ridge portion 230 of the press-formed article 200.

In addition, when a first die-cross section passing midway between the first die-first side surface portion and the first die-second side surface portion and a second die-cross section passing midway between the second die-first side surface portion and the second die-second side surface portion are overlapped so that the first die-bottom surface portion 610 and the second die-bottom surface portion 810 are overlapped and the first die-concave ridge portion 630 and the second die-concave ridge portion 830 are overlapped, the first die-bottom surface concave portion 640 includes a first part 641 which is provided outside the second die 800 and adjacent to the first die-concave ridge portion 630 and a second part 642 which is provided inside the second die 800 and adjacent to the first part 641.

Figure 28:
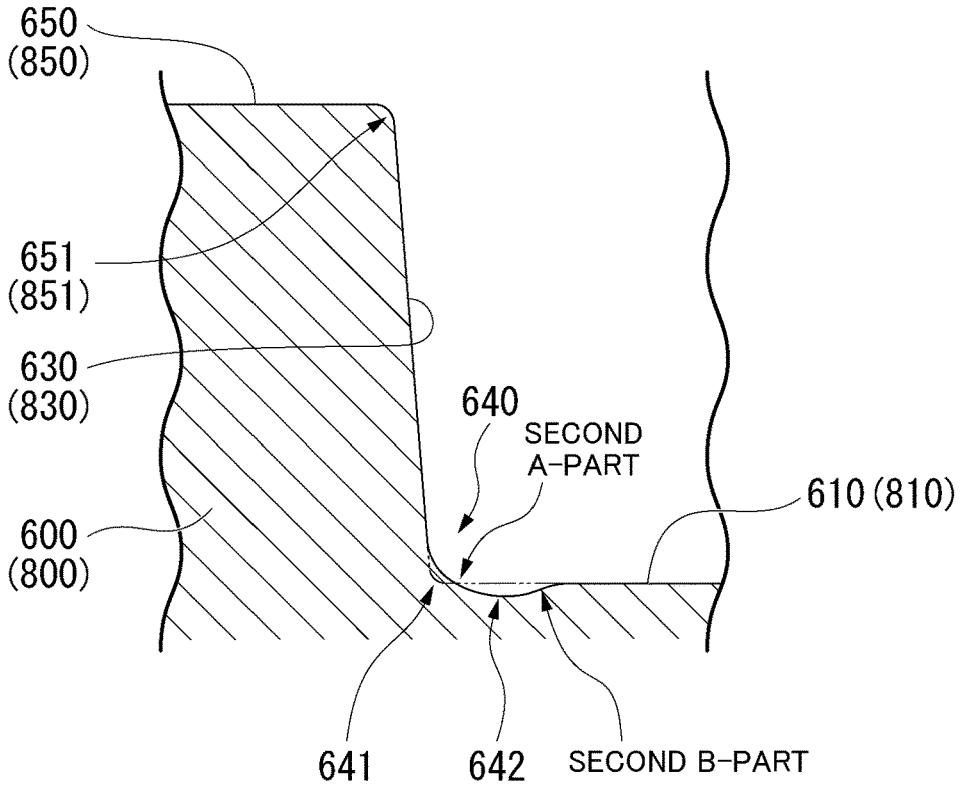
FIG. 28 is a schematic cross-sectional view in which the first die and the second die are overlapped in the same cross section.

FIG. 28 shows a cross-sectional view in which the first die-cross section (solid line) and the second die-cross section (chain double-dashed line) are overlapped. In FIG. 28, the die tool side is the outside and the die hole side is the inside. The first die-bottom surface concave portion 640 includes a first part 641 which is provided outside the second die 800 and adjacent to the first die-concave ridge portion 630 and a second part 642 which is provided inside the second die 800 and adjacent to the first die-bottom surface portion 610, and the first part 641 and the second part 642 are adjacent to each other.

In the above description, a state in which the first die 600 and the second die 800 are on the lower side has been illustrated. However, the present invention is not limited thereto, and the first punch 500 may be disposed below the first die 600. In addition, the pressing direction is not limited to the vertical direction, and may be a horizontal direction or another direction. In addition, the flange portion 150 of the preformed article 100 and the flange portion 250 of the press-formed article 200 may not be provided.

In the above-described example, a case where the distance from the first die-bottom surface portion 610 of the first die 600 to the support surface 650 in a direction perpendicular to the first die-bottom surface portion 610 is almost the same as the distance from the second die-bottom surface portion 810 of the second die 800 to the support surface 850 in a direction perpendicular to the second die-bottom surface portion 810 has been illustrated. That is, the distance from a point of the swollen portion 140 of the preformed article 100 farthest from the preformed bottom sheet portion 110 to the flange portion 150 in a direction perpendicular to the preformed bottom sheet portion 110 is almost the same as the distance from the bottom sheet portion 210 of the press-formed article 200 to the flange portion 250 in a direction perpendicular to the bottom sheet portion 210.

Figure 29:
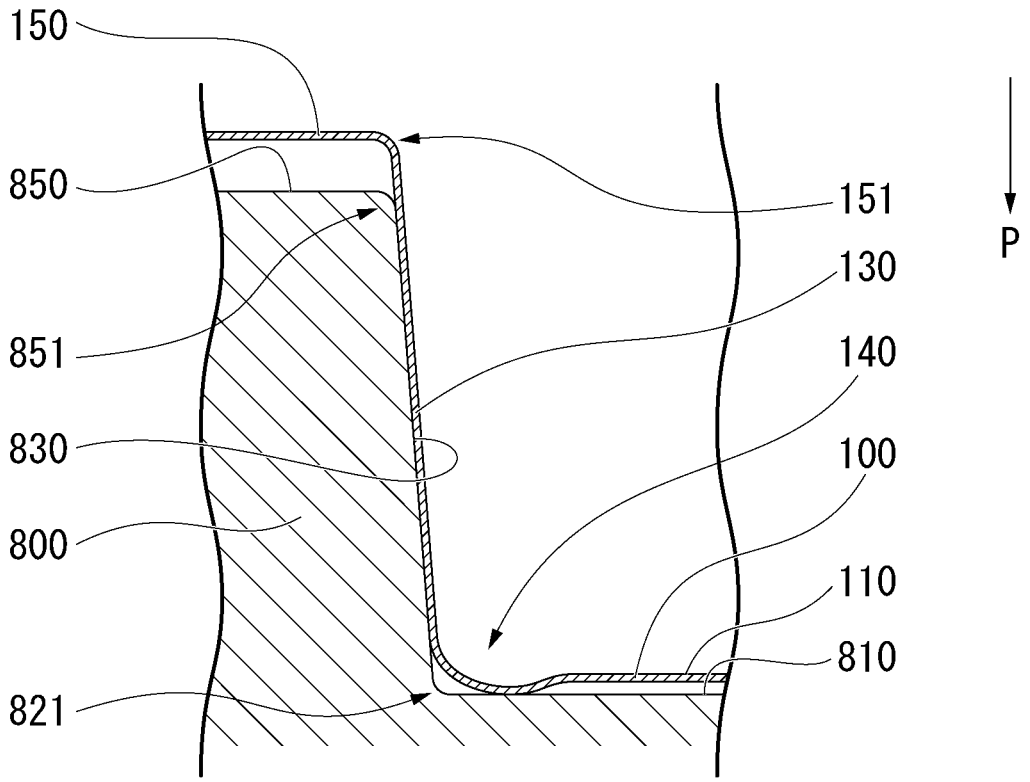
FIG. 29 is a view showing a state in which the preformed article is disposed in the second die (in the fourth die and punch) and the flange portion is separated from a support surface of the second die (fourth die and punch), and is a schematic cross-sectional view of the second die (fourth die and punch) and the preformed article in a cross-sectional view in a plane passing through the position of the line E-E' in FIG. 21.
Figure 30:
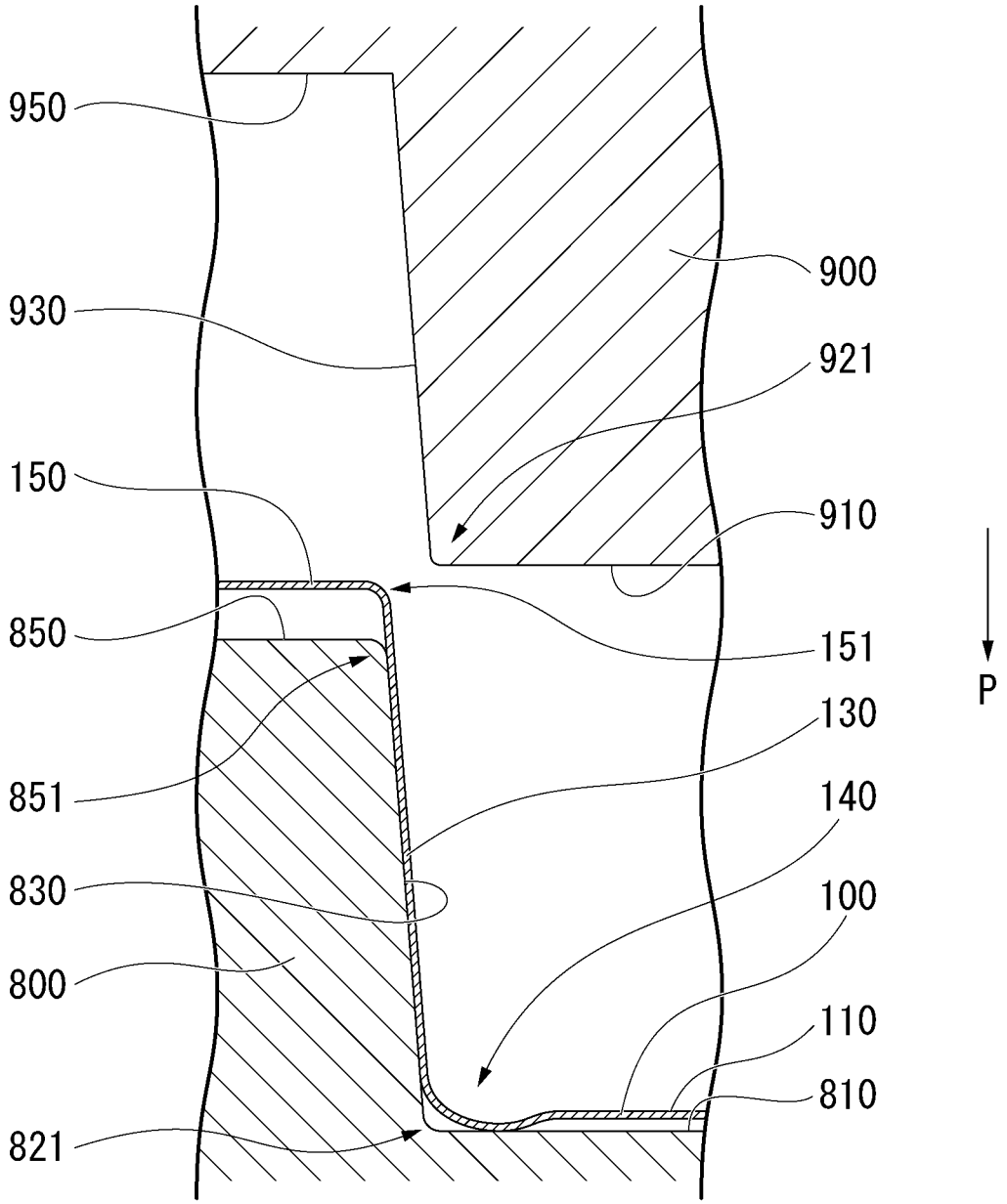
FIG. 30 is a schematic cross-sectional view of the die and punch for main forming and the preformed article in a cross-sectional view in a plane passing through the position of the line E-E' in FIG. 21.
Figure 31:
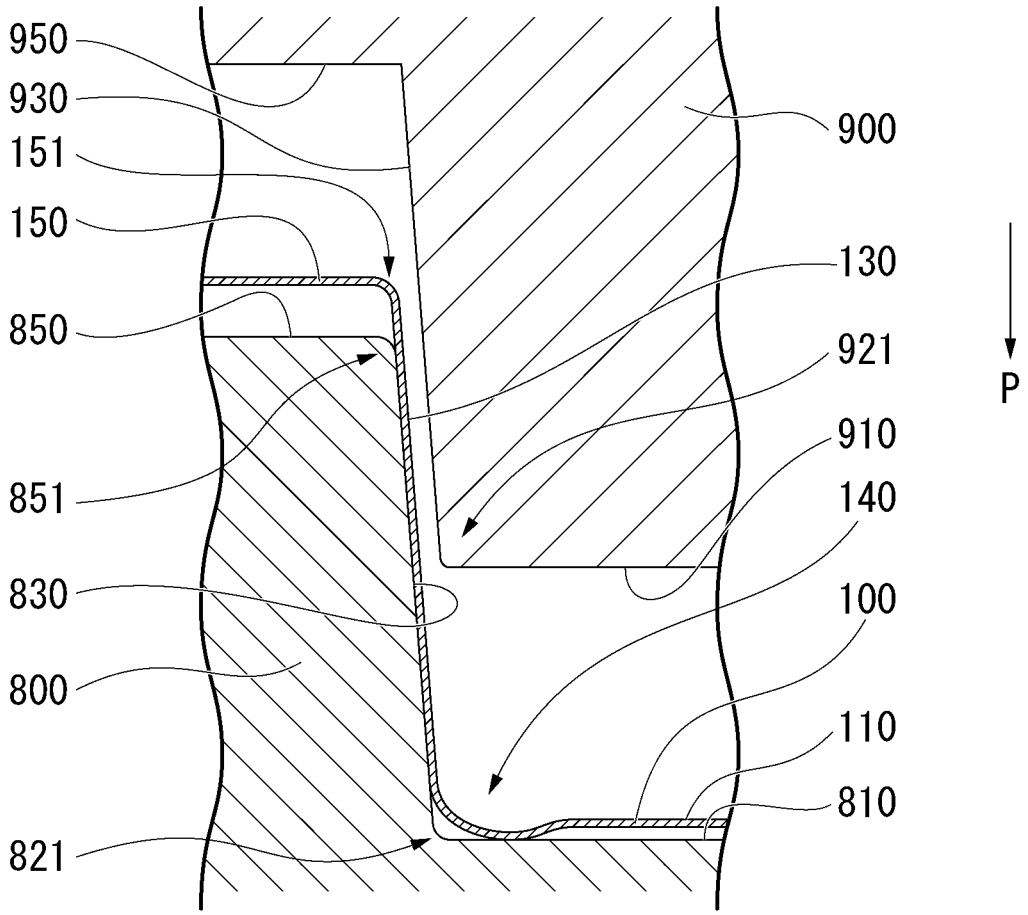
FIG. 31 is a schematic cross-sectional view showing a state in which the second punch (fifth die and punch) is relatively moved with respect to the second die (fourth die and punch) from the state of FIG. 29.

However, as described in the first embodiment, the flange portion 150 may be formed in the preforming step (S1), and in the main forming step (S2), the flange portion 150 may be relatively moved with respect to the bottom sheet portion 210 so that the flange portion 150 is put close to the bottom sheet portion 210 in a direction perpendicular to the sheet surface of the bottom sheet portion 210. In this case, as shown in FIG. 29, the distance from a point of the swollen portion 140 of the preformed article 100 farthest from the preformed bottom sheet portion 110 to the flange portion 150 in a direction perpendicular to the preformed bottom sheet portion 110 is set to be larger than the distance from the second die-bottom surface portion 810 of the second die 800 to the support surface 850 in a direction perpendicular to the second die-bottom surface portion 810. Similarly to the above description, the second punch 900 is relatively moved with respect to the second die 800 as in FIGS. 30 and 31.

Figure 32:
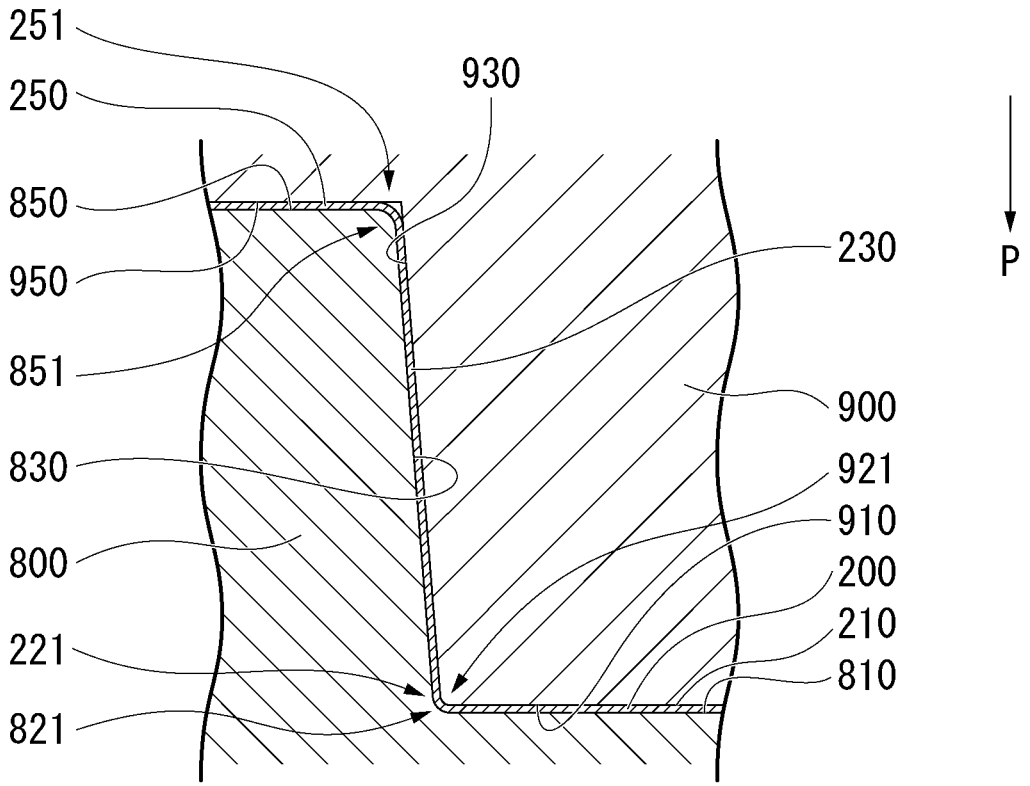
FIG. 32 is a schematic cross-sectional view showing a state in which the second punch (fifth die and punch) reaches the bottom dead point from the state of FIG. 30.

As shown in FIG. 32, in a case where the second punch 900 reaches the bottom dead point, the swollen portion 140 of the preformed article 100 is press-formed, and the flange portion 150 of the preformed article 100 is moved to the support surface 850 of the second die 800 by the support surface 950 of the second punch 900. In this case, a part of the preformed standing wall portion 120 and the preformed ridge portion 130 receives a deforming force by the second punch-side surface portion 920 and the support surface 950 of the second punch 900, and is sandwiched by the support surface 850 of the second die 800 and the support surface 950 of the second punch 900, and thus becomes a part of the flange portion 250 of the press-formed article 200. In this manner, the flange portion 150 is relatively moved with respect to the bottom sheet portion 210 so that the flange portion 150 and the bottom sheet portion 210 are close to each other in a direction perpendicular to the sheet surface of the bottom sheet portion 210, and thus in the ridge portion 230 of the press-formed article 200, the occurrence of cracks or wrinkles in the flange portion 250 in which the flange portion 150 is deformed can be suppressed.

In the press line according to the present embodiment, when the first die-cross section and the second die-cross section are overlapped so that the first die-bottom surface portion 610 and the second die-bottom surface portion 810 are overlapped and the first die-concave ridge portion 630 and the second die-concave ridge portion 830 are overlapped, the second part 642 may include a second A-part which is closer to the first part than a point recessed deepest in the second part 642 and a second B-part which is closer to a center portion of the first die-bottom surface portion 610 than the point, and the smallest radius of curvature in the second A-part and the first part 641 in the first die-cross section may be 16 times or greater a clearance between the first die 600 and the first punch 500.

By setting the radius of curvature of an inner surface of a smallest bend in the second A-part and the first part 641 in the above-described cross section to 16 times or greater the clearance between the first die 600 and the first punch 500, cracks can be more stably suppressed. In addition, it is more preferable that the radius of curvature is 18 times or greater the clearance between the first die 600 and the first punch 500.

In addition, in the press line according to the present embodiment, when the first die-cross section and the second die-cross section are overlapped so that the first die-bottom surface portion 610 and the second die-bottom surface portion 810 are overlapped and the first die-concave ridge portion 630 and the second die-concave ridge portion 830 are overlapped, the absolute value of a difference between the line length of the first die-bottom surface concave portion 640 and the line length of the second die-bottom surface portion 810 which is separated from the first die-bottom surface concave portion 640 may be 4 times or less the clearance between the first die 600 and the first punch 500.

In a case where the absolute value of the difference between the line length of the first die-bottom surface concave portion 640 and the line length of the second die-bottom surface portion 810 which is separated from the first die-bottom surface concave portion 640 is 4 times or less the clearance between the first die 600 and the first punch 500, the occurrence of cracks or wrinkles in the ridge portion 230 in the main forming step can be more stably suppressed. In addition, it is more preferable that the absolute value of the difference between the line length of the first die-bottom surface concave portion 640 and the line length of the second die-bottom surface portion 810 which is separated from the first die-bottom surface concave portion 640 is twice or less the clearance between the first die 600 and the first punch 500.

In addition, in the press line according to the present embodiment, when the first die-cross section and the second die-cross section are overlapped so that the first die-bottom surface portion 610 and the second die-bottom surface portion 810 are overlapped and the first die-concave ridge portion 630 and the second die-concave ridge portion 830 are overlapped, the distance from an intersection point C of an extension line of the second die-bottom surface portion 810 and an extension line of the second die-concave ridge portion 830 to an end portion of the second part 642 on the side of the first die-bottom surface portion 610 may be 60 times or less the clearance between the first die 600 and the first punch 500, and the distance from the intersection point C to an end portion of the first part 641 on the first die-concave ridge portion side in a direction perpendicular to the first die-bottom surface portion 610 may be 60 times or less the clearance.

In a case where the distance from the intersection point C of the extension line of the second die-bottom surface portion 810 and the extension line of the second die-concave ridge portion 830 to the end portion of the second part 642 on the side of the first die-bottom surface portion 610 is 60 times or less the clearance between the first die 600 and the first punch 500, the swollen portion 140 can be allowed to effectively flow toward the standing wall ridge portion 221 in the main forming step. In addition, it is more preferable that the distance is 45 times or less the clearance. The lower limit of the distance from the intersection point C of the extension line of the second die-bottom surface portion 810 and the extension line of the second die-concave ridge portion 830 to the end portion of the second part 642 on the side of the first die-bottom surface portion 610 is 5 times or greater the clearance between the first die 600 and the first punch 500.

In addition, in the press line according to the present embodiment, in a cross section passing through the first die-concave ridge portion 630 parallel to the first die-bottom surface portion 610, the radius of curvature of the first die-concave ridge portion 630 may be 31 times or less the clearance between the first die 600 and the first punch 500.

The radius of curvature of the first die-concave ridge portion 630 is the radius of curvature of the surface of the first die-concave ridge portion 630 viewed from a direction perpendicular to the pressing surface of the first die-bottom surface portion 610 of the first die 600 at a boundary between the first die-side surface portion 620 or the first die-concave ridge portion 630 and the first die-bottom surface concave portion 640. In addition, in a case where the radius of curvature changes in the first die-concave ridge portion 630, the radius of curvature may be 31 times or less the clearance between the first die 600 and the first punch 500 in the entire range.

The press portion according to the present embodiment can be preferably used in the manufacturing method of a press-formed article according to the first embodiment. That is, there is provided a manufacturing method of a press-formed article including a bottom sheet portion, a plurality of standing wall portions connected to the bottom sheet portion and standing from the bottom sheet portion, and a ridge portion connecting the standing wall portions to each other, the method including: a preforming step of press-forming a metal sheet to form a preformed article including a preformed bottom sheet portion corresponding to a bottom sheet portion, a plurality of preformed standing wall portions corresponding to standing wall portions and standing from the preformed bottom sheet portion, and a preformed ridge portion corresponding to a ridge portion and connecting the preformed standing wall portions to each other; and a main forming step of further press-forming the preformed article to form the bottom sheet portion, the standing wall portions, and the ridge portion, in which in the preforming step, using a first die 600, the first die 600 and a first punch 500, in an end portion region where the preformed standing wall portion stands in the preformed bottom sheet portion, a swollen portion is formed which is positioned closer to the preformed bottom sheet portion than the preformed standing wall portion as a whole so as to be connected to the preformed standing wall portion, and swells to the side opposite to the side on which the preformed standing wall portion stands so as to be connected to the preformed bottom sheet portion in a cross-sectional view orthogonal to a sheet surface of the preformed bottom sheet portion and passing through the preformed ridge portion, and in the main forming step, using a second die 800 and a second punch 900, the swollen portion is press-formed so as to be formed to be a part of the bottom sheet portion and the standing wall portion. In addition, the die and punch according to the present embodiment may be provided as a press forming apparatus further including a drive portion (including a gas cylinder, a hydraulic cylinder, a spring, a cam mechanism, and the like) constituted to relatively move each die and punch. The pressing apparatus may include a control portion for controlling the relative movement of the die and punch and the operation of the drive portion. The press forming apparatus can be preferably used in the manufacturing method of a press-formed article according to the first embodiment.

In the above-described embodiment, the sheet thickness of the metal sheet may be an average sheet thickness of the metal sheet as a workpiece. The average sheet thickness may be an average of sheet thicknesses at a plurality of arbitrary points (for example, three points in a range formed in the standing wall portion or the bottom sheet portion) of the metal sheet. In addition, the sheet thickness of the metal sheet may be substantially the same as the sheet thickness of the preformed standing wall portion or the preformed bottom sheet portion of the preformed article or the sheet thickness of the standing wall portion or the bottom sheet portion of the press-formed article. In addition, the sheet thickness of the metal sheet may be substantially the same as the clearance between the first die and the first holder or the clearance between the second die and the second punch.

Figure 33:
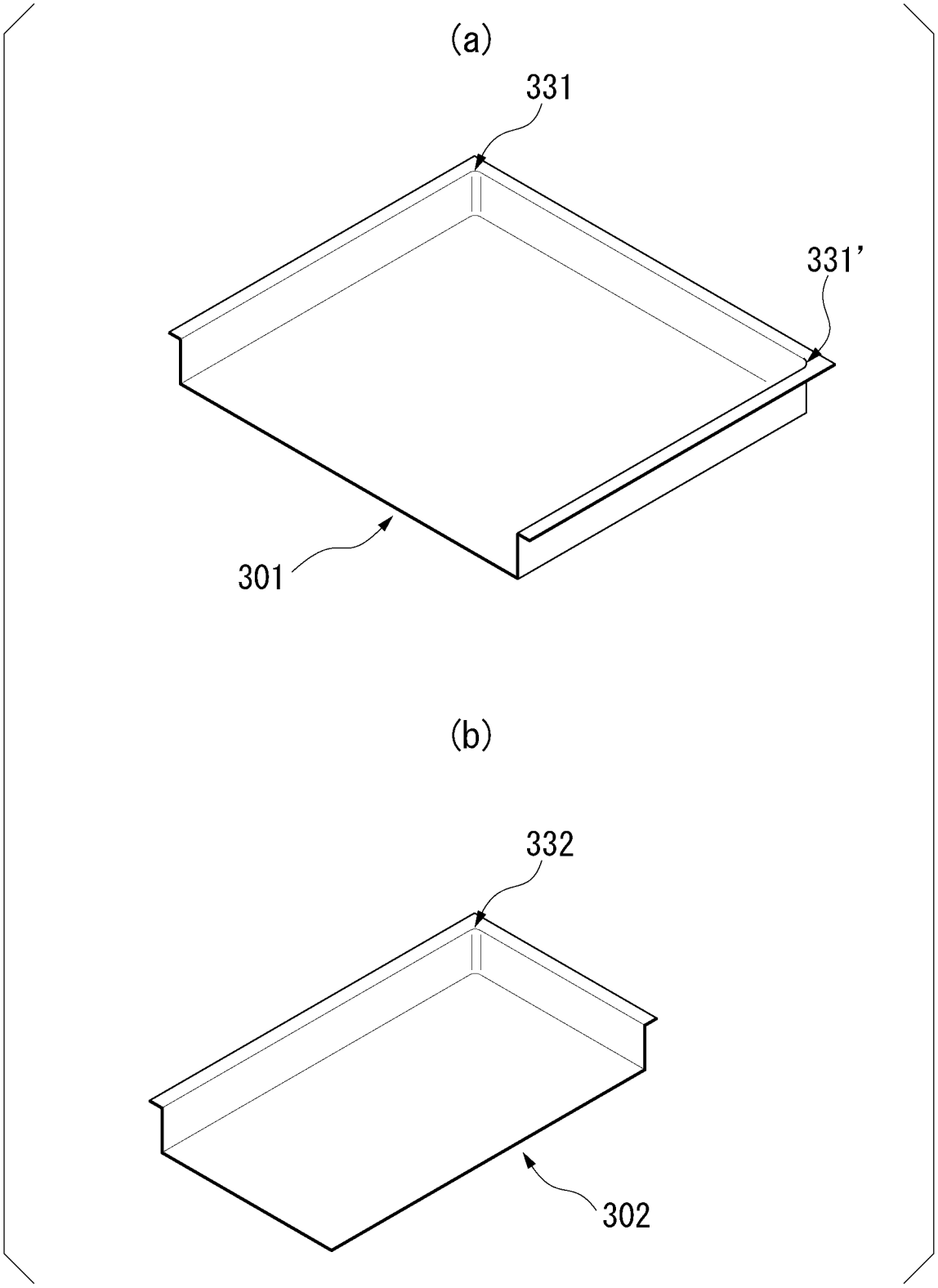
FIG. 33 is a view showing an example of a product which can be preferably produced using a manufacturing method of a press-formed article according to the present invention.
Figure 34:
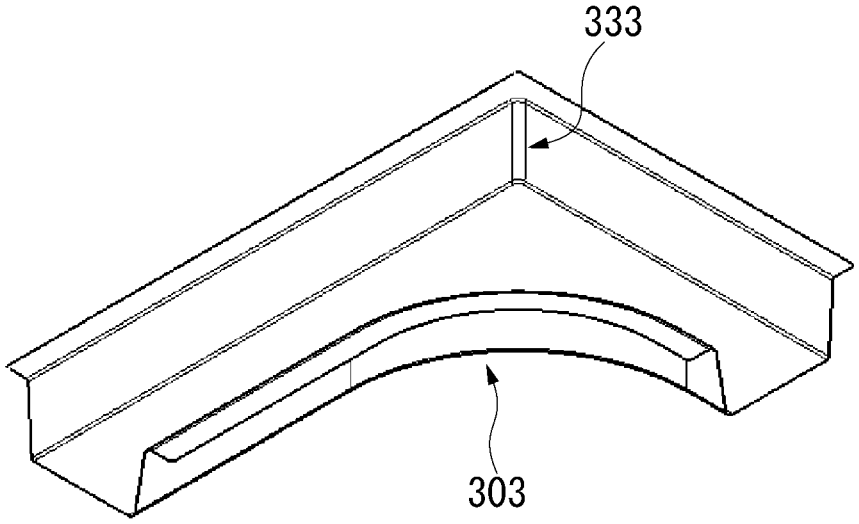
FIG. 34 is a view showing an example of a product which can be preferably produced using the manufacturing method of a press-formed article according to the present invention.
Figure 35:
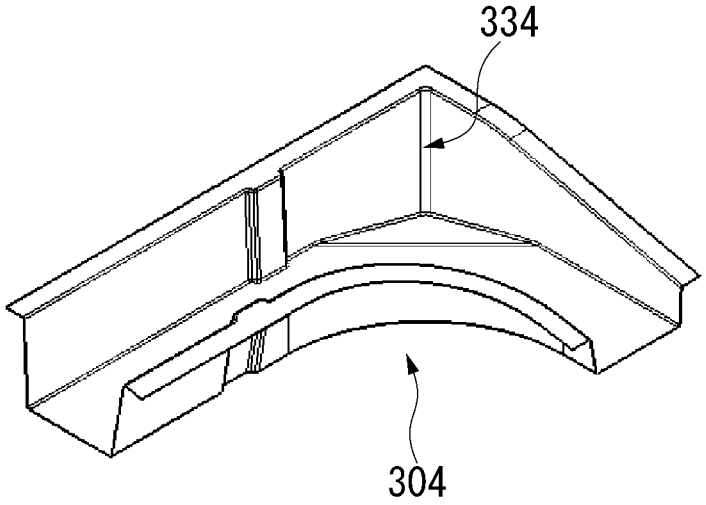
FIG. 35 is a view showing an example of a product which can be preferably produced using the manufacturing method of a press-formed article according to the present invention.
Figure 36:
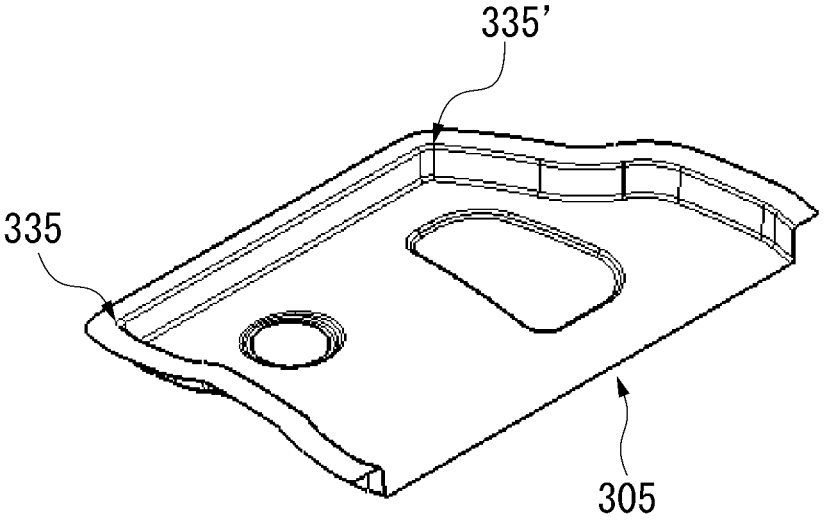
FIG. 36 is a view showing an example of a product which can be preferably produced using the manufacturing method of a press-formed article according to the present invention.

The press-formed article according to the above-described embodiment can be preferably used as a component for a vehicle such as a battery box represented by a battery box for a vehicle, a front pillar lower, a door inner, or the like, which has a ridge portion. FIGS. 33 to 36 are views showing an example of a product which can be preferably produced using the manufacturing method of a press-formed article according to the present invention. The press-formed article illustrated in (a) in FIG. 33 is a ridge component 301 of a battery box, which has two ridge portions 331 and 331'. The press-formed article illustrated in (b) in FIG. 33 is a ridge component 302 of the battery box, which has a ridge portion 332. The entire battery box may be formed by joining these press-formed articles to other members. The press-formed article illustrated in FIG. 34 is a front pillar 303 having a ridge portion 333. The present invention can also be preferably applied to such a member which is entirely curved in an L-shape. The press-formed article illustrated in FIG. 35 is a stiffener 304 of a C-pillar, and a standing wall near a ridge portion 334 is high. As described above, the present invention can also be preferably applied to a member in which the standing walls are not uniform in height. The press-formed article illustrated in FIG. 36 is a door inner 305. The present invention can also be preferably applied to a press-formed article having a plurality of ridge portions 335 and 335' having different radii of curvature and opening angles, such as the door inner 305.

In addition, the first press portion is a die and punch including a first die (second die and punch), a first holder (third die and punch) provided to sandwich a workpiece between the first holder and the first die, and a first punch (first die and punch) provided to movably sandwich the workpiece in an in-plane direction of the workpiece between the first punch and the first holder, in which the first die includes a first die-bottom surface portion, a plurality of first die-side surface portions (first die-first side surface portion and first die-second side surface portion) connected to the first die-bottom surface portion and standing from the first die-bottom surface portion, and a first die-concave ridge portion connecting the first die-side surface portions to each other, an end portion region where the first die-side surface portion stands in the first die-bottom surface portion has a first die-bottom surface concave portion which is positioned closer to the first die-bottom surface portion than the first die-side surface portion as a whole so as to be connected to the first die-side surface portion, and swells to the side opposite to the side on which the first die-side surface portion stands so as to be connected to the first die-bottom surface portion in a cross-sectional view orthogonal to a pressing surface of the first die-bottom surface portion and passing through the first die-concave ridge portion, and the first holder has an outer surface shape corresponding to an outer surface shape of a pressing surface of the first die.

In the first press portion having the above-described configuration, since the first die-bottom surface portion of the first die has a concave portion, and the first holder has an outer surface shape corresponding to an outer surface shape of a pressing surface of the first die, a preformed article having a swollen portion can be formed. By press-forming the swollen portion of the preformed article so that the swollen portion becomes a part of a bottom sheet portion and a standing wall portion of the formed article, a formed article in which cracks or wrinkles are suppressed in a ridge portion can be obtained.

EXAMPLES

Hereinafter, examples of the present invention will be described.

Example 1

In this example, as Experiment Nos. 1 to 9, preformed articles having a preformed ridge portion as shown in Table 1 below and FIGS. 37 to 42 were prepared, and then each of the preformed articles was further press-formed to prepare a press-formed article. A GA270 steel sheet was used as a workpiece. The sheet thickness of the workpiece was 0.8 mm. The high elongation material is JAC270F in standard notation of the cold-rolled hot-dip galvanized steel sheet for an automobile in the Japan Iron and Steel Federation Standard. The low elongation material is JAC270D in the same standard. A radius of curvature Rc of a ridge portion of the preformed article and the press-formed article was 10 mm, the height of a standing wall of the press-formed article was 100 mm, and a radius of curvature Rw of a standing wall ridge portion of the press-formed article was 3 mm. The overall shapes of the preformed article and the press-formed article were as shown in (a) and (b) in FIG. 1.

Regarding the preformed articles of Experiment Nos. 1 to 9, Table 1 shows a radius of curvature Rp from a point of a swollen portion connected to a preformed standing wall portion to a point farthest from a preformed bottom sheet portion, a line length difference ΔL between the preformed article and the press-formed article, a height e1 of the swollen portion, and a length e2 of the swollen portion. Each of (a) in FIGS. 37 to 42 shows a schematic perspective view of the vicinity of the ridge portion of each preformed article. Each of (b) in FIGS. 37 to 42 shows a schematic cross-sectional view of a preformed article 100 (chain double-dashed line) and a press-formed article 200 (solid line) in a cross-sectional view in a plane which is orthogonal to a sheet surface of a preformed bottom sheet portion 110 and forms an equal angle with a sheet surface of each of preformed standing wall portions 120 connected via a preformed ridge portion 130.

Figure 38:
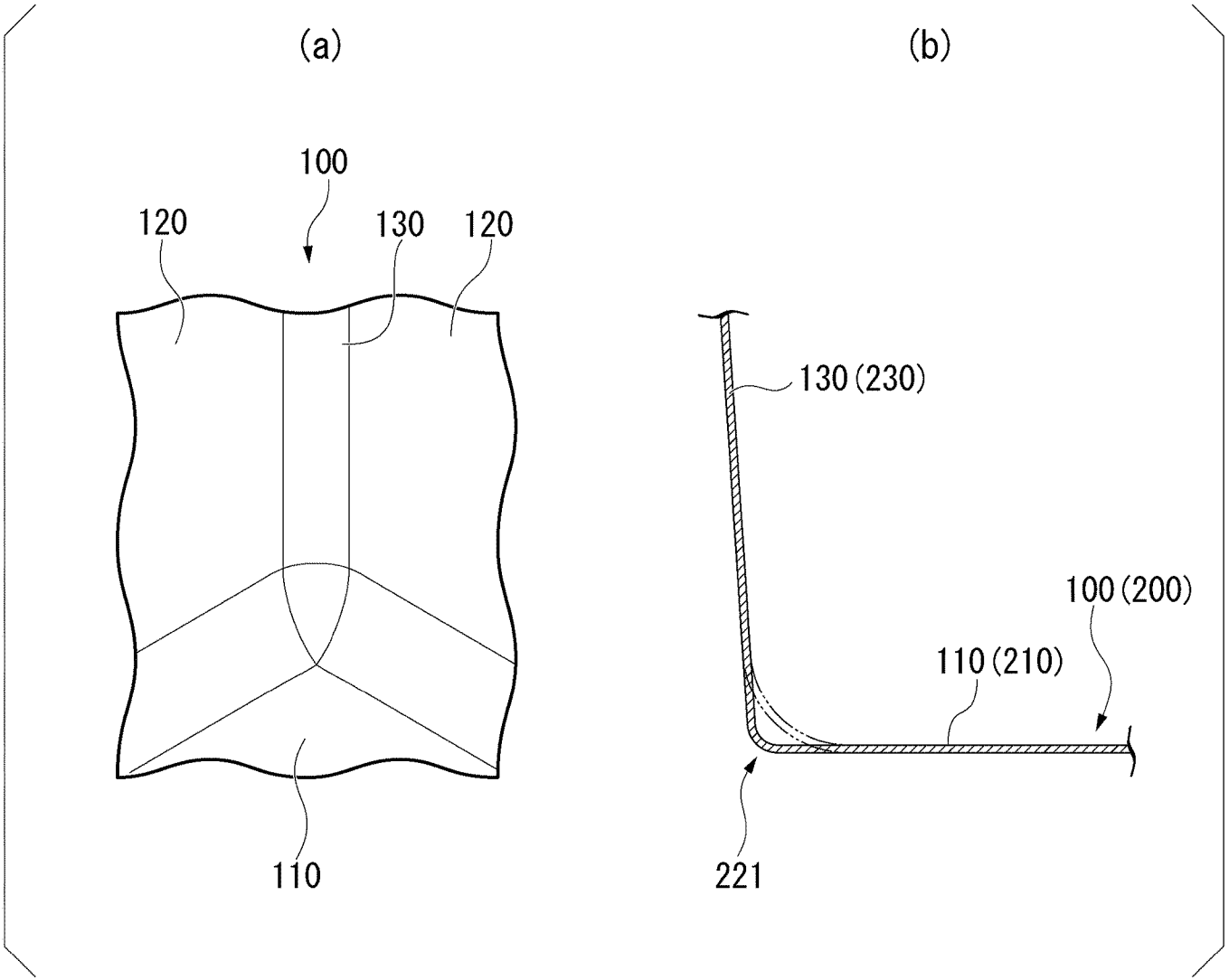
FIG. 38 is a view showing a swollen portion of a preformed article of Example 1, where (a) is a schematic perspective view of a ridge portion, and (b) is a schematic cross-sectional view in the ridge portion.

In the preformed article of Experiment No. 2, as shown in FIG. 38, without the swollen portion, the ridge connecting the preformed ridge portion 130 and the preformed bottom sheet portion 110 of the preformed article 100 was positioned on the inner surface side than the standing wall ridge portion 221 of the press-formed article 200. As shown in Table 1, cracks or wrinkles occurred in both the high elongation material and the low elongation material.

Figure 39:
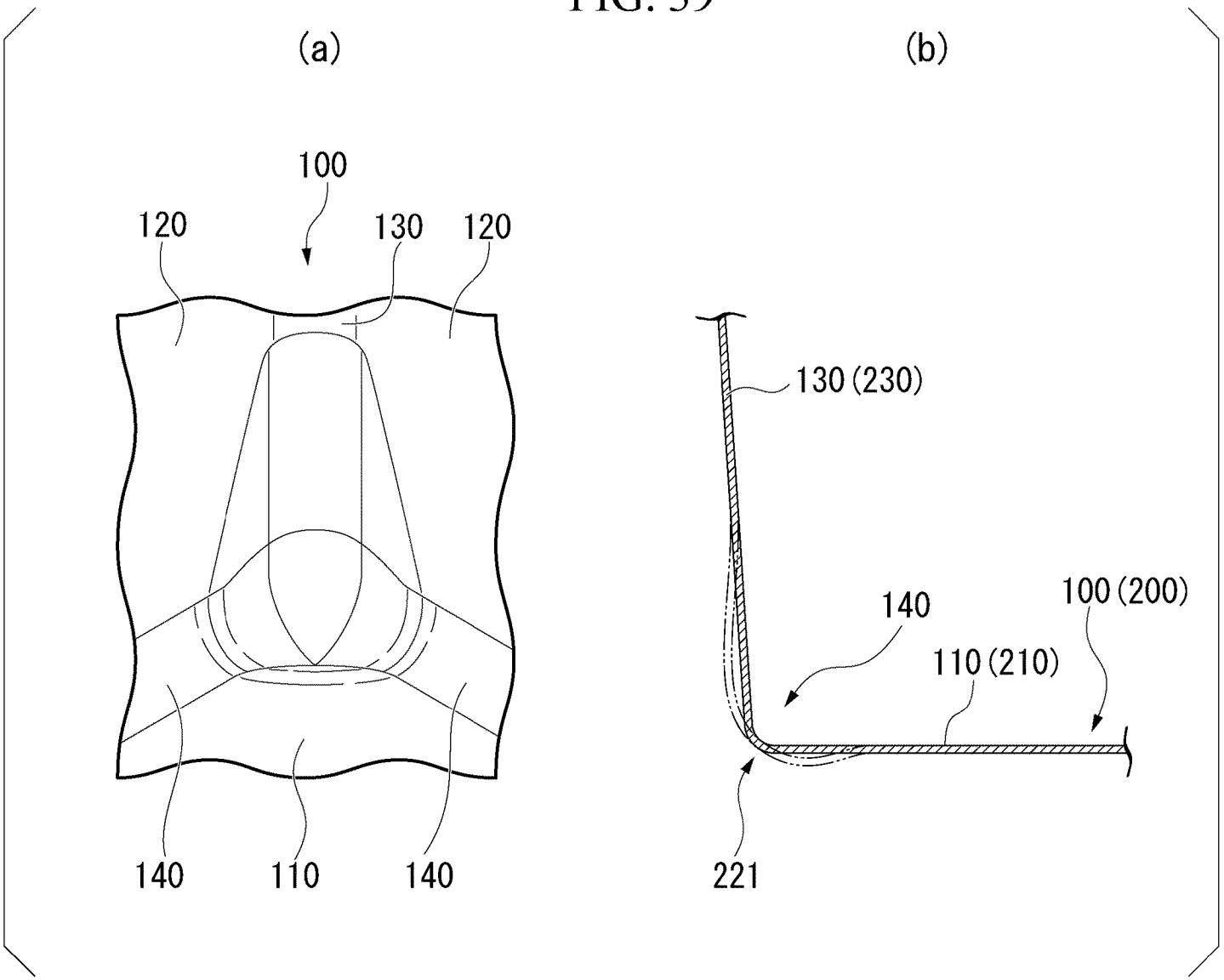
FIG. 39 is a view showing a swollen portion of a preformed article of Example 1, where (a) is a schematic perspective view of a ridge portion, and (b) is a schematic cross-sectional view in the ridge portion.

In the preformed article of Experiment No. 3, as shown in FIG. 39, the swollen portion 140 is positioned on the outer side than the ridge portion 230 of the press-formed article 200. That is, the swollen portion 140 is positioned on the side opposite to the preformed bottom sheet portion 110 with respect to the preformed ridge portion 130, and positioned on the side opposite to the side on which the preformed standing wall portion 120 stands with respect to the preformed bottom sheet portion 110. As shown in Table 1, cracks or wrinkles occurred in both the high elongation material and the low elongation material.

Figure 40:
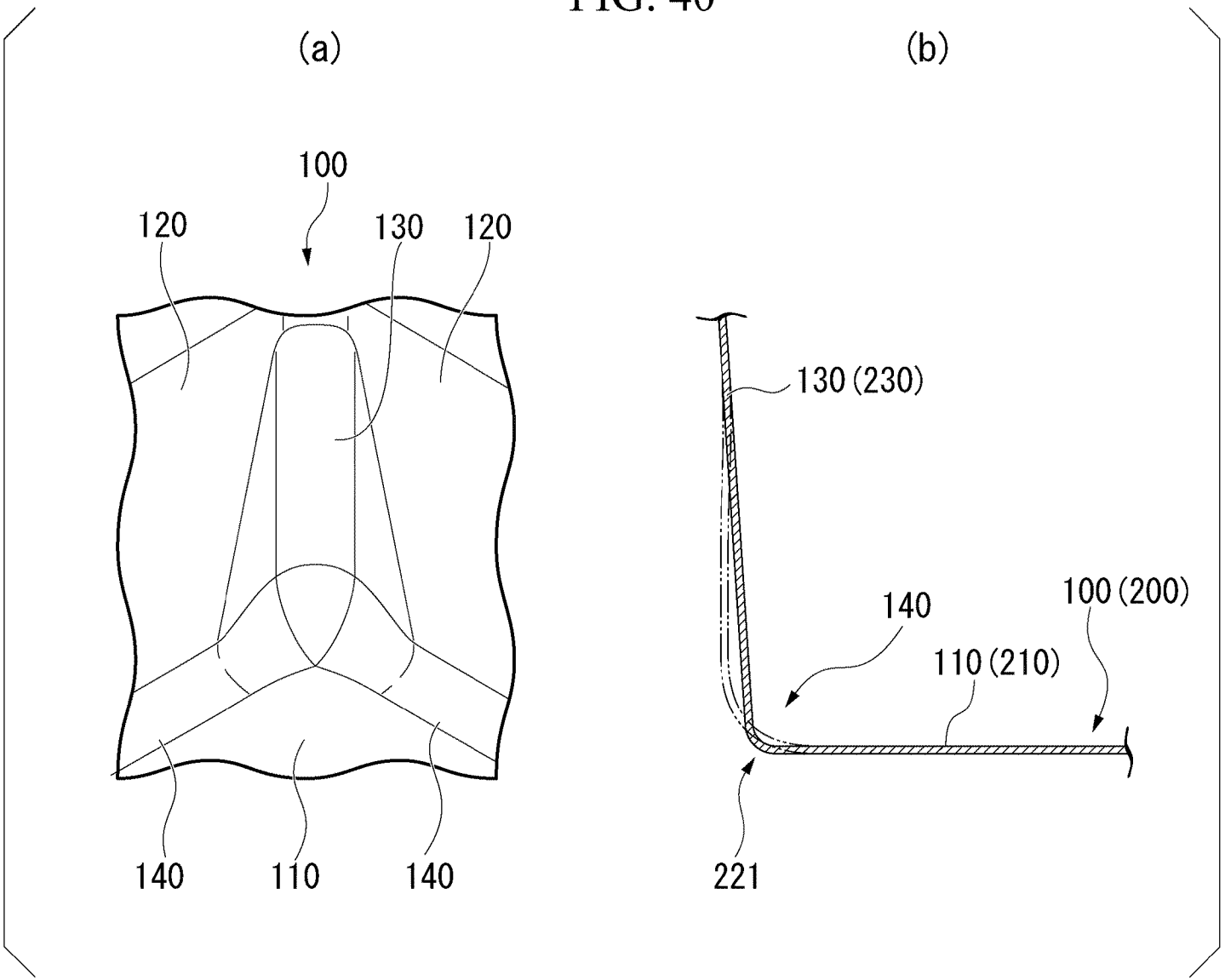
FIG. 40 is a view showing a swollen portion of a preformed article of Example 1, where (a) is a schematic perspective view of a ridge portion, and (b) is a schematic cross-sectional view in the ridge portion.

In the preformed article of Experiment No. 4, as shown in FIG. 40, the swollen portion 140 is positioned on the outer side than the ridge portion 230 of the press-formed article 200. That is, the swollen portion 140 is positioned on the side opposite to the preformed bottom sheet portion 110 with respect to the preformed ridge portion 130. In addition, the swollen portion 140 is positioned on the side on which the preformed standing wall portion 120 stands with respect to the preformed bottom sheet portion 110. As shown in Table 1, cracks or wrinkles occurred in both the high elongation material and the low elongation material.

TABLE 1

| Experiment No. | Rp (mm) | ΔL (mm) | e1 (mm) | e2 (mm) | High Elongation Material | Low Elongation Material | Remarks |
|---|---|---|---|---|---|---|---|
| 1 | 3 | 0.0 | 2.8 | 2.8 | C | C | Comparative Example |
| 2 | 15 | 4.7 | 14.0 | 16.0 | C | C | Comparative Example |
| 3 | 15 | 2.1 | 53.5 | 25.7 | C | C | Comparative Example |
| 4 | 15 | 0.1 | 81.4 | 11.8 | C | C | Comparative Example |
| 5 | 10 | 3.5 | 90.7 | 2.8 | C | C | Comparative Example |
| 6 | 10 | 0.0 | 11.0 | 20.6 | A | B | Example |
| 7 | 15 | 1.1 | 13.3 | 32.7 | A | A | Example |
| 8 | 15 | 4.0 | 15.9 | 24.0 | A | B | Example |
| 9 | 30 | −1.0 | 19.4 | 60.5 | A | B | Example |

In addition, Table 1 also shows the evaluation results of cracks or wrinkles in the experimental examples. As for the evaluation results, the examples in which the press-formed article had no cracks or wrinkles, the defective production rate was low, and the productivity was thus high were evaluated as "A (very good)", the examples in which no cracks or wrinkles occurred were evaluated as "B (good)", and the examples in which cracks or wrinkles (including necking, material breaking, and buckling) occurred were evaluated as "C (bad)" through the visual inspection.

Figure 37:
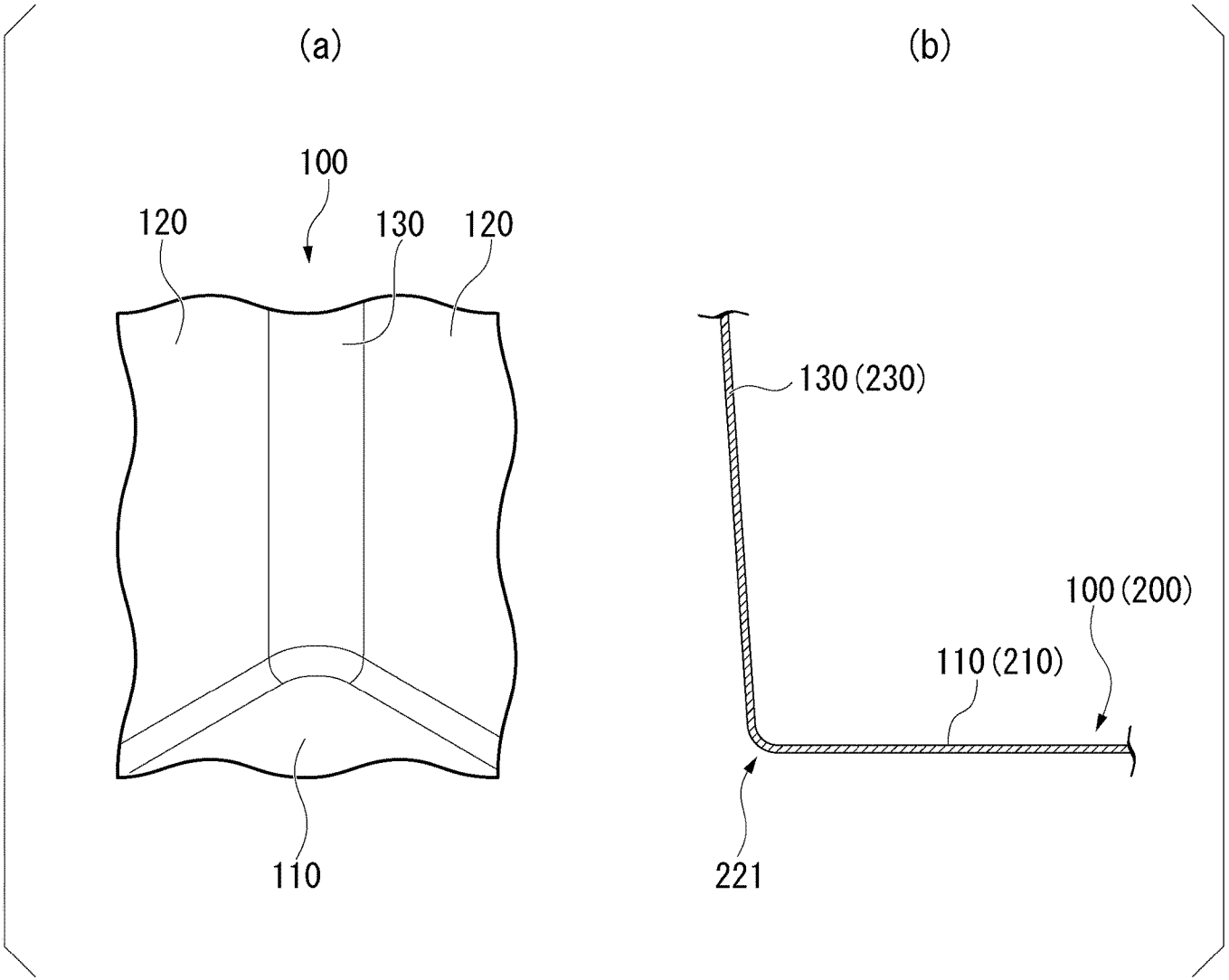
FIG. 37 is a view showing a swollen portion of a preformed article of Example 1, where (a) is a schematic perspective view of a ridge portion, and (b) is a schematic cross-sectional view in the ridge portion.

In Experiment No. 1, as shown in FIG. 37, a preformed article having the same shape as the press-formed article having the above-described shape was prepared. In other words, the workpiece was press-formed into the shape of the press-formed article without preforming. As shown in Table 1, cracks or wrinkles occurred in both the high elongation material and the low elongation material.

Figure 41:
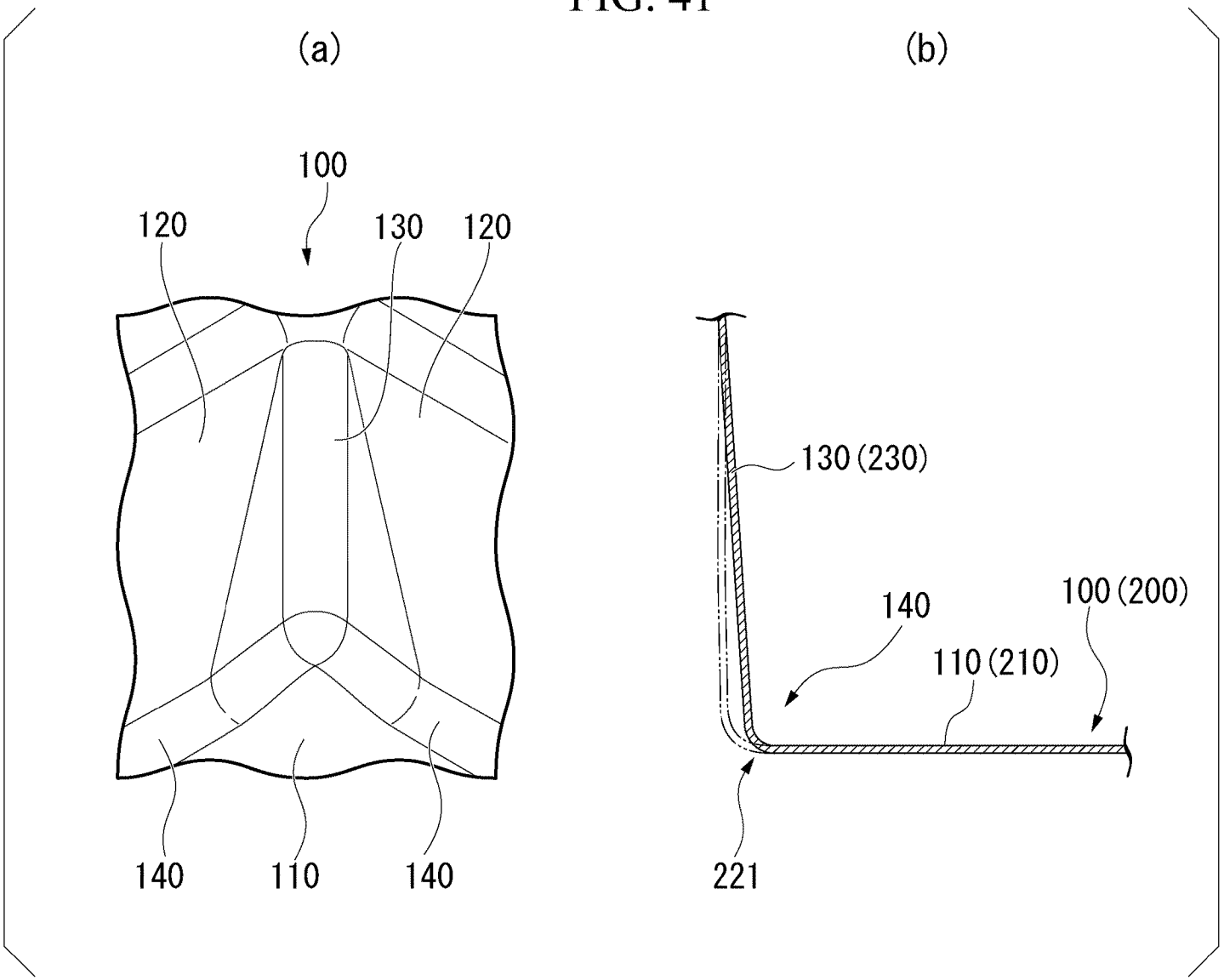
FIG. 41 is a view showing a swollen portion of a preformed article of Example 1, where (a) is a schematic perspective view of a ridge portion, and (b) is a schematic cross-sectional view in the ridge portion.

In the preformed article of Experiment No. 5, as shown in FIG. 41, the swollen portion 140 is positioned on the outer side than the ridge portion 230 of the press-formed article 200. That is, the swollen portion 140 is positioned on the side opposite to the preformed bottom sheet portion 110 with respect to the preformed ridge portion 130. As shown in Table 1, cracks or wrinkles occurred in both the high elongation material and the low elongation material.

Figure 42:
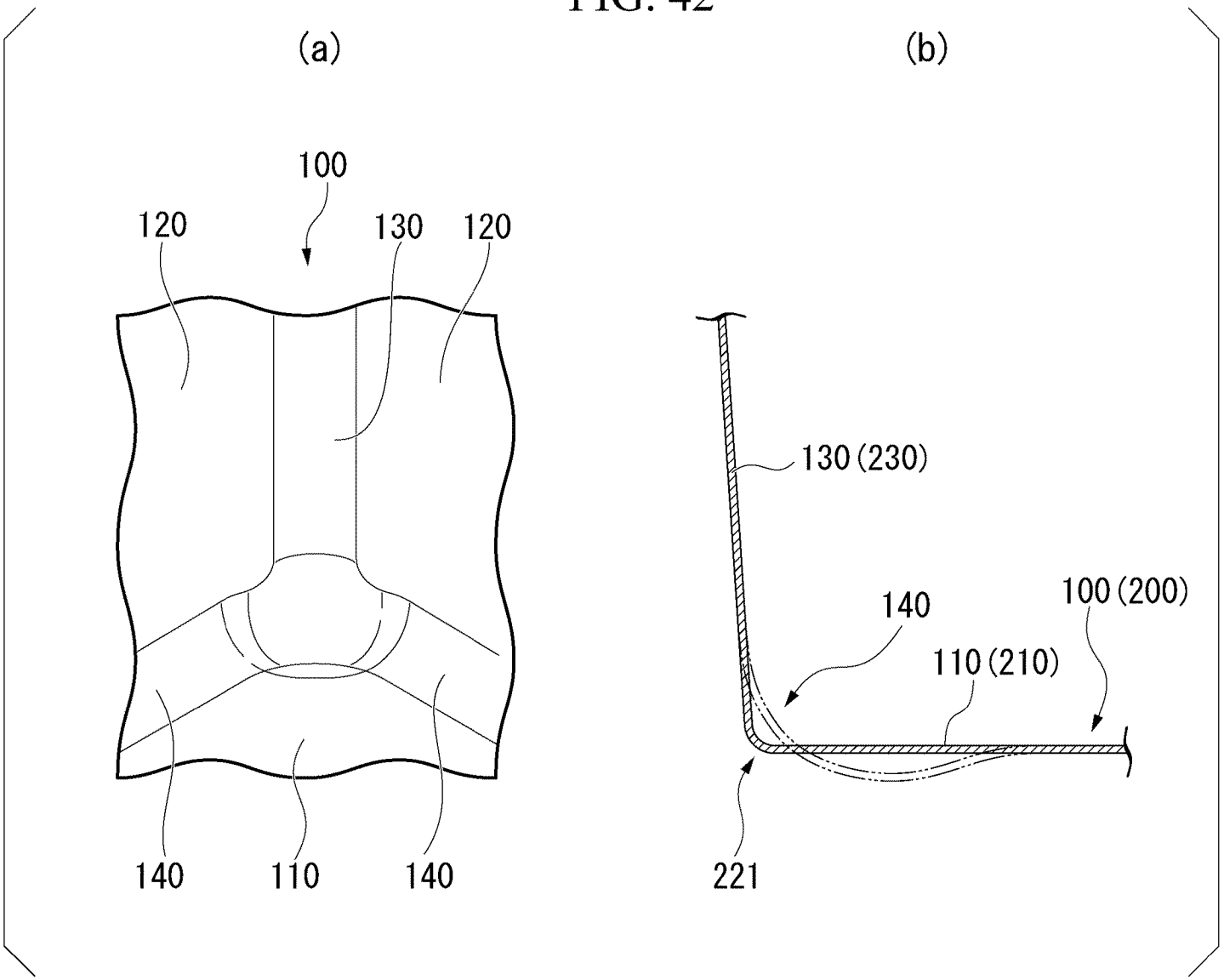
FIG. 42 is a view showing a swollen portion of a preformed article of Example 1, where (a) is a schematic perspective view of a ridge portion, and (b) is a schematic cross-sectional view in the ridge portion.

In each of the preformed articles of Experiment Nos. 6 to 9, the basic shape of the swollen portion 140 is as shown in FIG. 42, but the radius of curvature Rp, the line length difference ΔL, and the height e1 and the length e2 of the swollen portion were changed for each preformed article. In the preformed article of Experiment No. 6, the swollen portion 140 is positioned closer to the preformed bottom sheet portion 110 than the preformed standing wall portion 120 (preformed ridge portion 130) as a whole, and swells to the side opposite to the side on which the preformed standing wall portion 120 stands. As shown in Table 1, no cracks or wrinkles occurred in both the high elongation material and the low elongation material.

In the preformed article of Experiment No. 7, the swollen portion 140 was positioned closer to the preformed bottom sheet portion 110 than the preformed standing wall portion 120 as a whole, and had a shape swelling to the side opposite to the side on which the preformed standing wall portion 120 stood. As shown in Table 1, no cracks or wrinkles occurred in both the high elongation material and the low elongation material. In addition, in the preformed article of Experiment No. 7, it is found that the defective production rate is low and the productivity is thus high even in a case of the low elongation material. It is considered that this is because the radius of curvature Rp, the line length difference ΔL, and the height e1 and the length e2 of the swollen portion satisfy predetermined conditions.

In the preformed article of Experiment No. 8, the swollen portion 140 was positioned closer to the preformed bottom sheet portion 110 than the preformed standing wall portion 120 as a whole, and had a shape swelling to the side opposite to the side on which the preformed standing wall portion 120 stood. As shown in Table 1, no cracks or wrinkles occurred in both the high elongation material and the low elongation material.

In the preformed article of Experiment No. 9, the swollen portion 140 was positioned closer to the preformed bottom sheet portion 110 than the preformed standing wall portion 120 as a whole, and had a shape swelling to the side opposite to the side on which the preformed standing wall portion 120 stood. As shown in Table 1, no cracks or wrinkles occurred in both the high elongation material and the low elongation material.

Example 2

In this example, as Experiment Nos. 10 to 15, preformed articles having a preformed ridge portion as shown in Table 2 below and FIGS. 43 to 48 were prepared, and then each of the preformed articles was further press-formed to prepare a press-formed article. In this example, preformed articles including a flange portion having a shape shown in Table 2 below were prepared, and then the preformed article was further press-formed to prepare a press-formed article. As in Example 1, a GA270 steel sheet having a sheet thickness of 0.8 mm was used as a workpiece. The definitions of the high elongation material and the low elongation material are the same as in Example 1. The shapes of Experiment No. 7 of Example 1 were employed as shapes of the preformed article and the press-formed article, except for the shape of the flange portion. A radius of curvature Rc of a corner portion of the preformed article and the press-formed article was 10 mm, the height of a standing wall of the press-formed article was 100 mm, and a radius of curvature Rw of a standing wall ridge portion of the press-formed article was 3 mm.

Regarding the preformed articles of Experiment Nos. 10 to 15, Table 2 shows a distance ΔT for relatively moving the flange portion with respect to the bottom sheet portion when the preformed article is press-formed into the press-formed article, and a radius of curvature Rd of the flange portion of the preformed article. Each of (a) in FIGS. 43 to 48 shows a schematic perspective view of the vicinity of a preformed ridge portion 130 of each preformed article. Each of (b) in FIGS. 43 to 48 shows a schematic cross-sectional view of a flange portion 150 (250) of a preformed article 100 (chain double-dashed line) and a press-formed article 200 (solid line) in a cross-sectional view in a plane which is orthogonal to a sheet surface of a preformed bottom sheet portion 110 and forms an equal angle with a sheet surface of each of preformed standing wall portions 120 connected via a preformed ridge portion 130.

TABLE 2

| Experiment No. | ΔT (mm) | Rd (mm) | High Elongation Material | Low Elongation Material |
|---|---|---|---|---|
| 10 | 0 | 3 | C | C |
| 11 | 0 | 10 | C | C |
| 12 | 30 | 10 | C | C |
| 13 | 3 | 4 | B | C |
| 14 | 20 | 30 | B | C |
| 15 | 10 | 10 | B | B |

Table 2 also shows the evaluation results of cracks or wrinkles in the experimental examples. As for the evaluation results, the examples in which no cracks or wrinkles occurred in the flange portion 250 in the vicinity of the ridge portion 230, but the productivity was low were evaluated as "B (good)", and the examples in which cracks or wrinkles (including necking, material breaking, and buckling) occurred were evaluated as "C (bad)" through the visual inspection.

Figure 43:
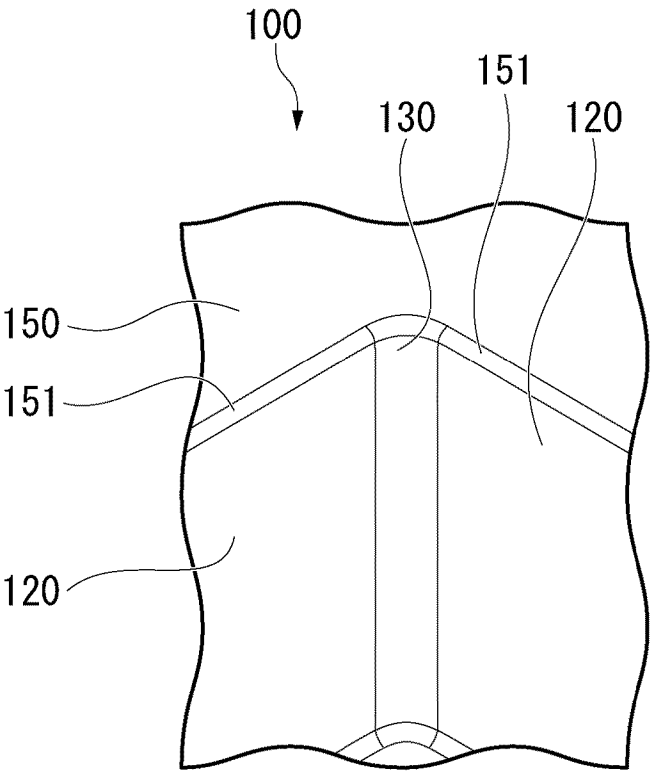
FIG. 43 is a view showing a flange portion of a preformed article of Example 2, where (a) is a schematic perspective view of a ridge portion, and (b) is a schematic cross-sectional view in the ridge portion.
Figure 43:
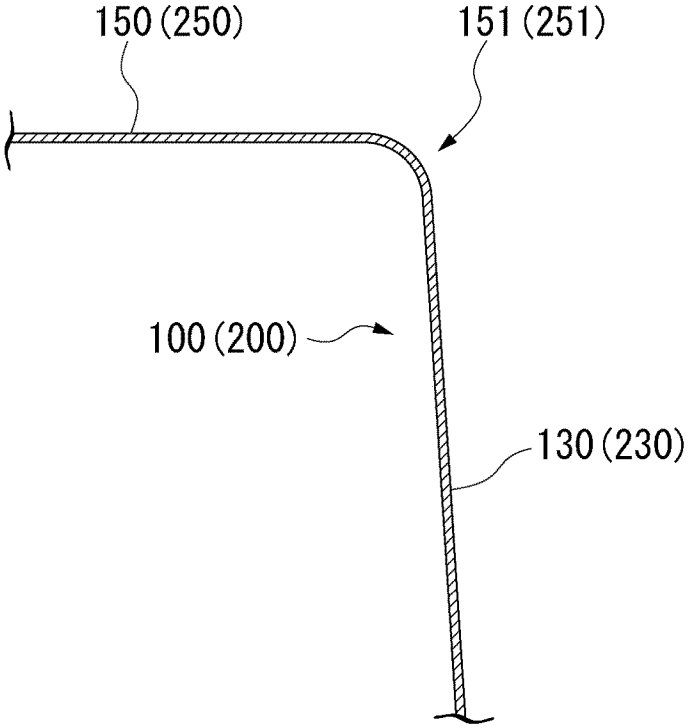

As shown in FIG. 43, in the preformed article of Experiment No. 10, the height of the flange portion and the radius of curvature Rd of the flange ridge portion 151 were not changed in the press-forming of the preformed article 100 into the press-formed article 200. As shown in Table 2, cracks or wrinkles occurred in both the high elongation material and the low elongation material.

Figure 44:
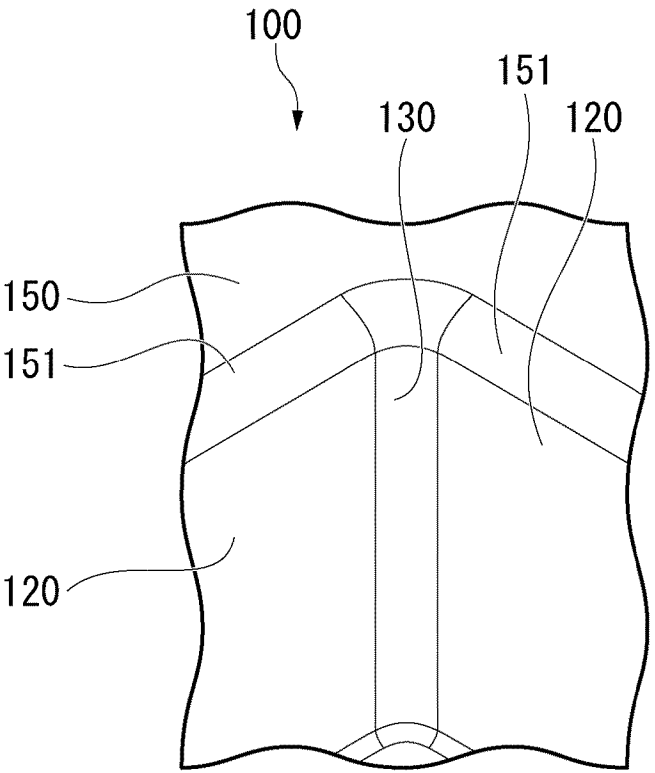
FIG. 44 is a view showing a flange portion of a preformed article of Example 2, where (a) is a schematic perspective view of a ridge portion, and (b) is a schematic cross-sectional view in the ridge portion.
Figure 44:
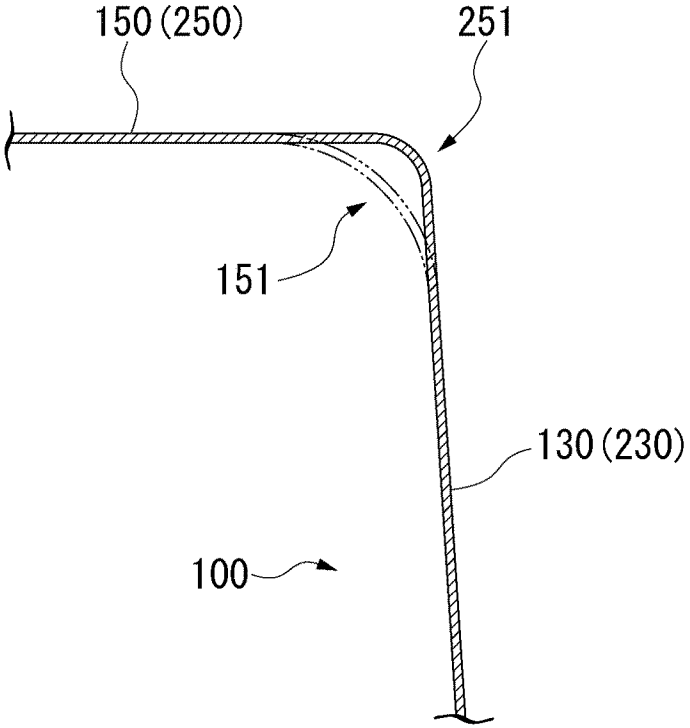

As shown in FIG. 44, in the preformed article of Experiment No. 11, the radius of curvature Rd of the flange ridge portion 151 of the preformed article 100 was set to be larger than the radius of curvature Rf of the flange ridge portion 251 of the press-formed article 200, but the height of the flange portion was not changed in the press-forming of the preformed article 100 into the press-formed article 200. As shown in Table 2, cracks or wrinkles occurred in both the high elongation material and the low elongation material.

Figure 45:
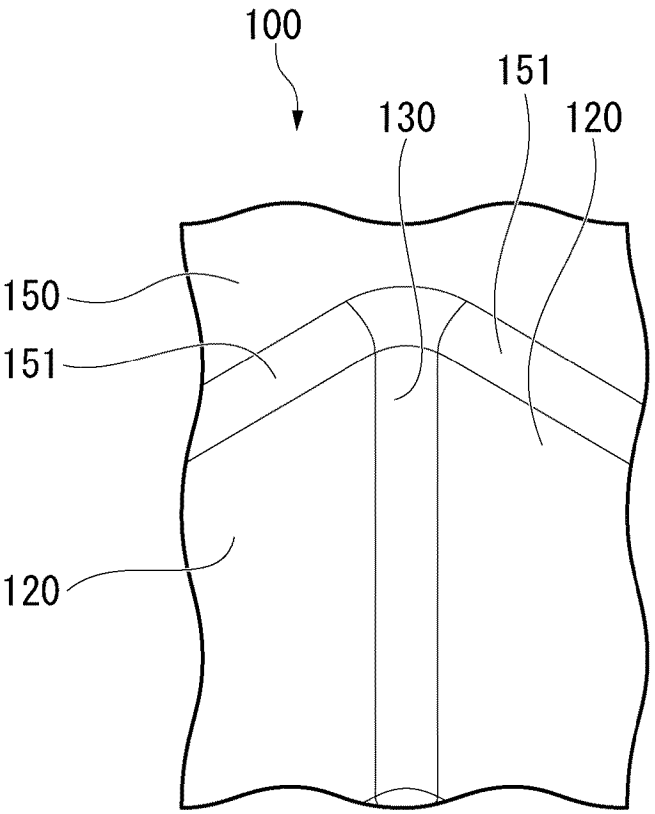
FIG. 45 is a view showing a flange portion of a preformed article of Example 2, where (a) is a schematic perspective view of a ridge portion, and (b) is a schematic cross-sectional view in the ridge portion.
Figure 45:
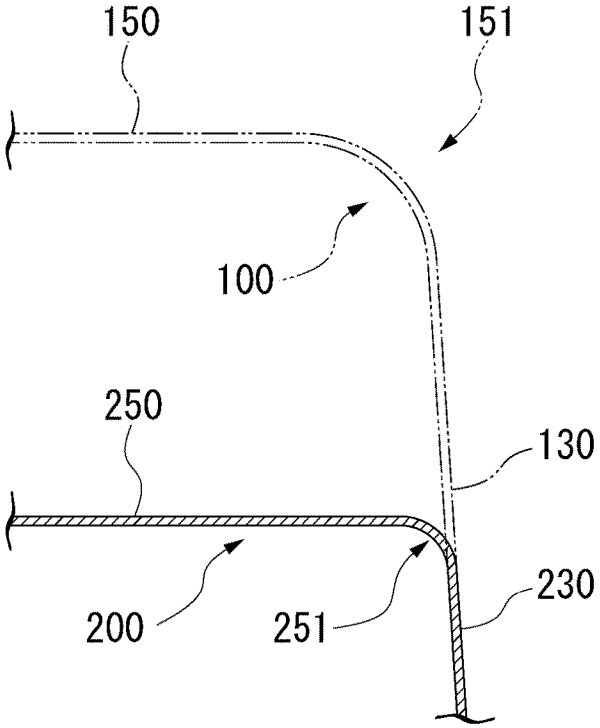

As shown in FIG. 45, in the preformed article of Experiment No. 12, the radius of curvature Rd of the flange ridge portion 151 of the preformed article 100 was set to be larger than the radius of curvature Rf of the flange ridge portion 251 of the press-formed article 200, and in the press-forming of the preformed article 100 into the press-formed article 200, the flange portion 150 was relatively moved with respect to the bottom sheet portion 210 so that the flange portion 150 and the bottom sheet portion 210 were close to each other in a direction perpendicular to the sheet surface of the bottom sheet portion 210. As shown in Table 2, cracks or wrinkles occurred in both the high elongation material and the low elongation material. It is considered that this is because the excessive material was gathered in the flange portion 150 because of too large AT.

Figure 46:
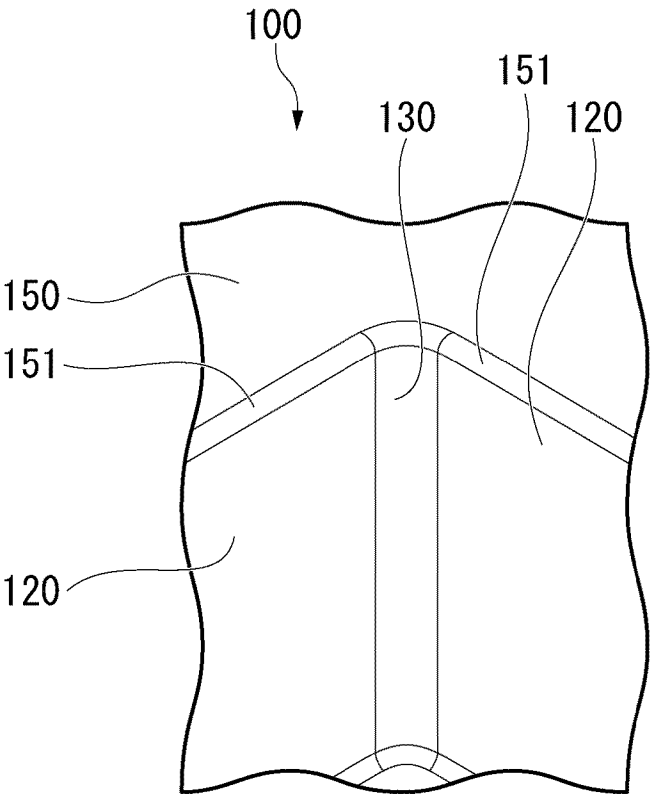
FIG. 46 is a view showing a flange portion of a preformed article of Example 2, where (a) is a schematic perspective view of a ridge portion, and (b) is a schematic cross-sectional view in the ridge portion.
Figure 46:
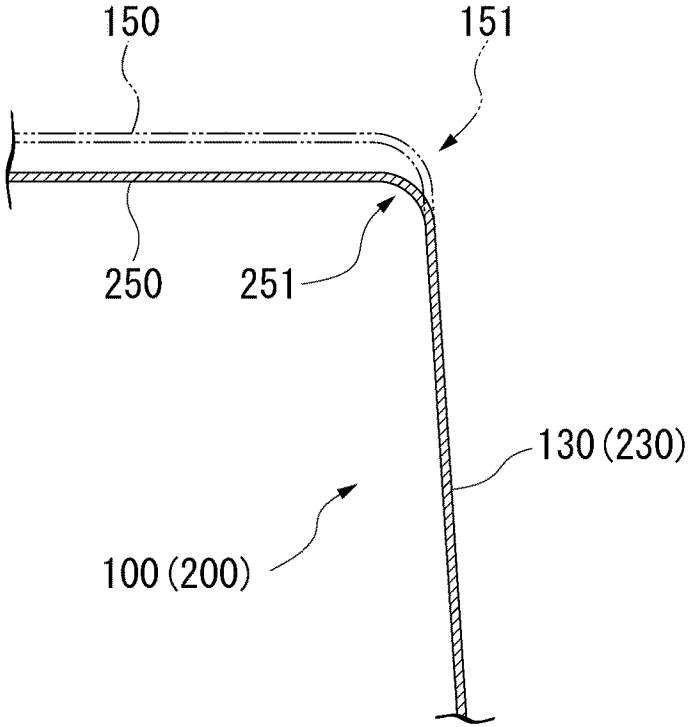

As shown in FIG. 46, in the preformed article of Experiment No. 13, in the press-forming of the preformed article 100 into the press-formed article 200, the flange portion 150 was relatively moved with respect to the bottom sheet portion 210 so that the flange portion 150 and the bottom sheet portion 210 were close to each other in a direction perpendicular to the sheet surface of the bottom sheet portion 210. In addition, the radius of curvature Rd of the flange ridge portion 151 of the preformed article 100 was set to be larger than the radius of curvature Rf of the flange ridge portion 251 of the press-formed article 200. As shown in Table 2, no cracks or wrinkles occurred in the high elongation material.

Figure 47:
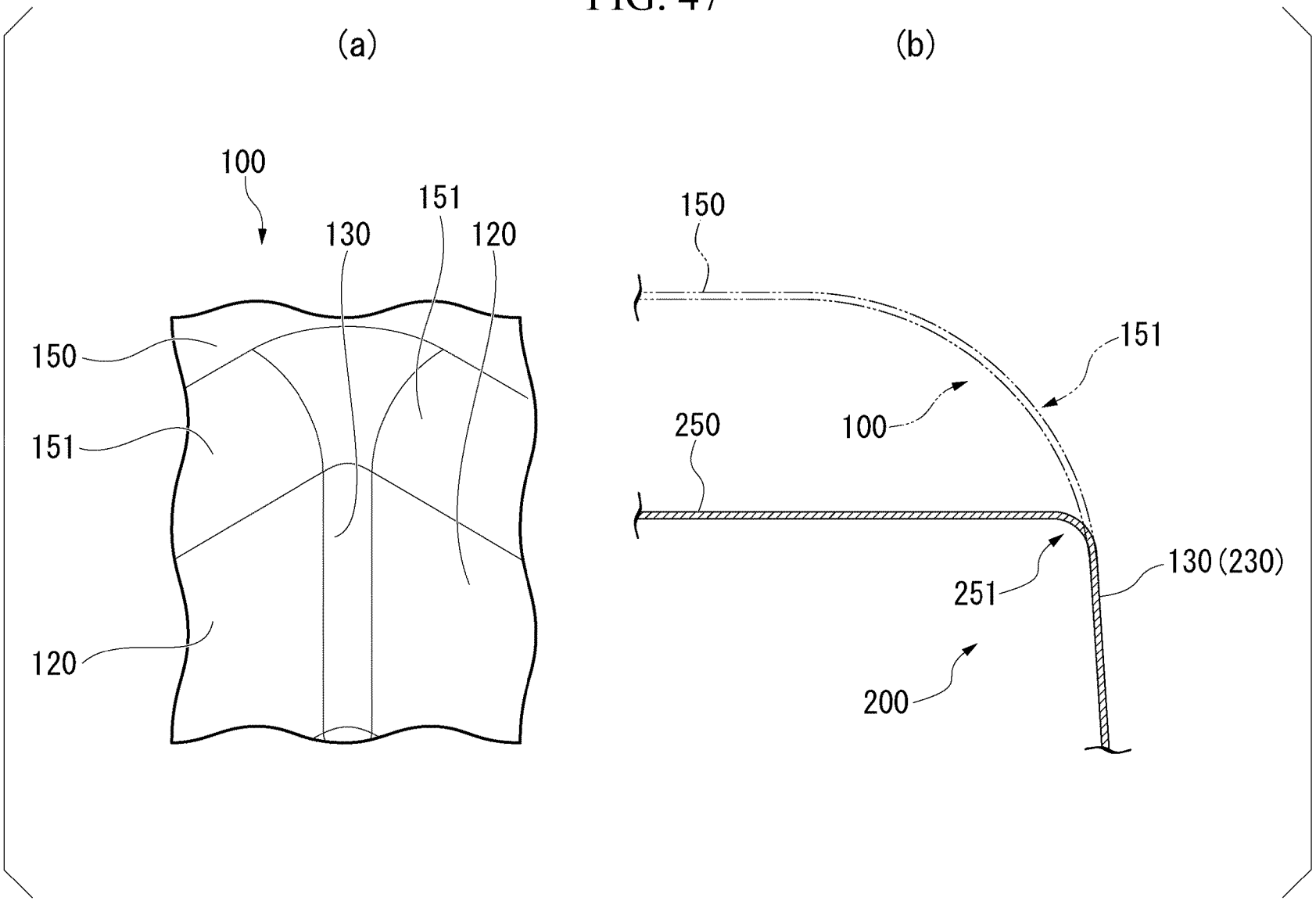
FIG. 47 is a view showing a flange portion of a preformed article of Example 2, where (a) is a schematic perspective view of a ridge portion, and (b) is a schematic cross-sectional view in the ridge portion.

As shown in FIG. 47, in the preformed article of Experiment No. 14, in the press-forming of the preformed article 100 into the press-formed article 200, the flange portion 150 was relatively moved with respect to the bottom sheet portion 210 so that the flange portion 150 and the bottom sheet portion 210 were close to each other in a direction perpendicular to the sheet surface of the bottom sheet portion 210. In addition, the radius of curvature Rd of the flange ridge portion 151 of the preformed article 100 was set to be larger than the radius of curvature Rf of the flange ridge portion 251 of the press-formed article 200. As shown in Table 2, no cracks or wrinkles occurred in the high elongation material.

Figure 48:
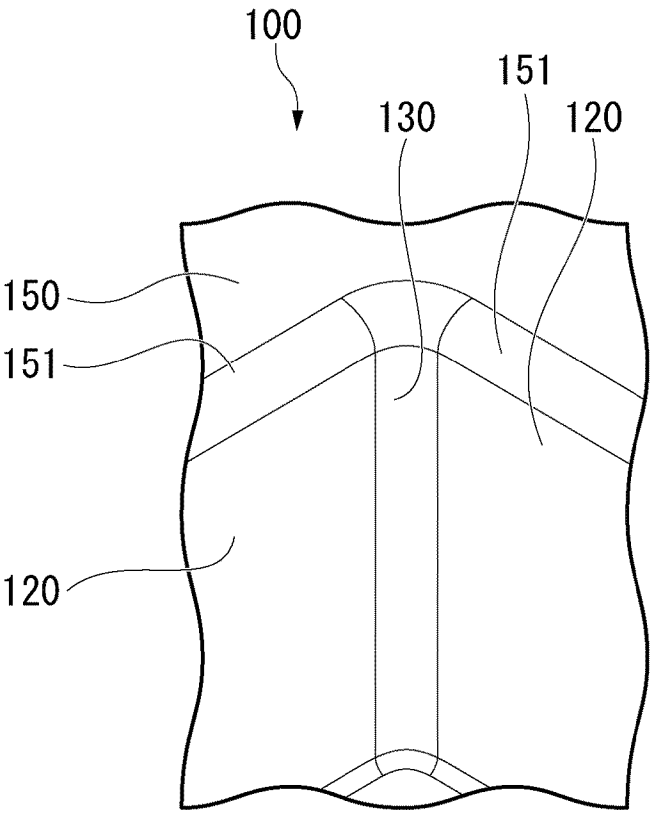
FIG. 48 is a view showing a flange portion of a preformed article of Example 2, where (a) is a schematic perspective view of a ridge portion, and (b) is a schematic cross-sectional view in the ridge portion.
Figure 48:
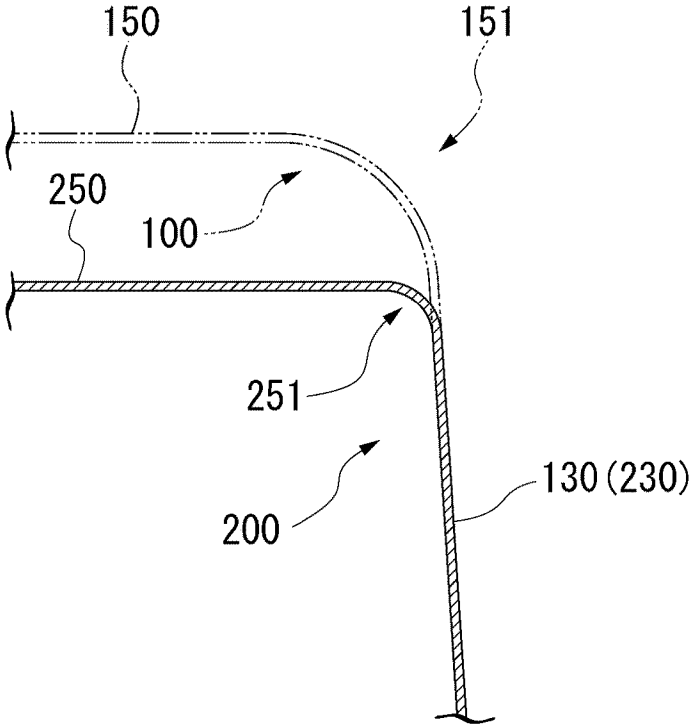

As shown in FIG. 48, in the preformed article of Experiment No. 15, in the press-forming of the preformed article 100 into the press-formed article 200, the flange portion 150 was relatively moved with respect to the bottom sheet portion 210 so that the flange portion 150 and the bottom sheet portion 210 were close to each other in a direction perpendicular to the sheet surface of the bottom sheet portion 210. In addition, the radius of curvature Rd of the flange ridge portion 151 of the preformed article 100 was set in a predetermined range. As shown in Table 2, no cracks or wrinkles occurred in both the high elongation material and the low elongation material.

INDUSTRIAL APPLICABILITY

A manufacturing method of a press-formed article and a press line according to the present invention are industrially extremely useful since it is possible to obtain a formed article in which cracks or wrinkles are suppressed at a ridge portion.

BRIEF DESCRIPTION OF THE REFERENCE SYMBOLS

1: workpiece
10: die and punch for preforming
20: die and punch for main forming
100: preformed article
110: preformed bottom sheet portion
111: end portion region
120: preformed standing wall portion
121: base end portion
122: tip end portion
130: preformed ridge portion
140: swollen portion
150: flange portion
151: flange ridge portion
200: press-formed article
210: bottom sheet portion
221: standing wall ridge portion
220: standing wall portion
230: ridge portion
300: product
500: first punch
510: first punch-bottom surface portion
520 first punch-side surface portion
530: first punch-convex ridge portion
540: first punch-bottom surface convex portion
600: first die
700: first holder
800: second die
900: second punch

What is claimed is:

1. A manufacturing method of a press-formed article comprising:

press-forming a metal sheet into a preformed article including:

a preformed bottom sheet portion, a first preformed standing wall portion, a second preformed standing wall portion, a preformed ridge portion provided between the first preformed standing wall portion and the second preformed standing wall portion, and a swollen portion provided between the preformed bottom sheet portion and the first and second preformed standing wall portions; and press-forming the preformed article into a press-formed article including:

a bottom sheet portion, a first standing wall portion adjacent to the bottom sheet portion, a second standing wall portion adjacent to the bottom sheet portion, and a ridge portion provided between the first standing wall portion and the second standing wall portion, wherein the press-forming the preformed article into a press-formed article includes:

moving a first part of the swollen portion, the first part being adjacent to the preformed ridge portion, toward an outside of the preformed article, and moving a second part of the swollen portion, the second part being adjacent to the bottom sheet portion, toward an inside of the preformed article, and the first part and the second part are adjacent to each other.

2. The manufacturing method of a press-formed article according to claim 1, wherein the second part includes a second A-part which is closer to the first part than a point, which is in the second part and which is farthest from the preformed bottom sheet portion in a thickness direction of the preformed bottom sheet portion, and a second B-part which is closer to the preformed bottom sheet portion than the point, and a radius of curvature of an inner surface of a smallest bend in the second A-part and the first part in the preformed article-cross section is 15 times or greater a sheet thickness of the metal sheet.

3. The manufacturing method of a press-formed article according to claim 1, wherein in a cross section passing through the ridge portion parallel to the bottom sheet portion, a radius of curvature inside a bend of the ridge portion is 30 times or less a sheet thickness of the metal sheet.

4. The manufacturing method of a press-formed article according to claim 1, wherein a cross section of the press-formed article parallel to the bottom sheet portion, which has the first standing wall portion, the second standing wall portion, and the ridge portion, is a closed cross section.

* * * * *